US008079969B2

(12) United States Patent
Rousso et al.

(10) Patent No.: US 8,079,969 B2
(45) Date of Patent: Dec. 20, 2011

(54) PORTABLE SELF-CONTAINED DEVICE FOR ENHANCING CIRCULATION

(76) Inventors: Benny Rousso, Rishon LeZion (IL); Eliahu Eliachar, Haifa (IL); Chen Barak, Shoam (IL); Uri David, Ness Ziona (IL); Yuval Avni, Tel Aviv-Yafo (IL); Nir Lilach, Kfar Yehoshua (IL)

( * ) Notice: Subject to any disclaimer, the term of this patent is extended or adjusted under 35 U.S.C. 154(b) by 1125 days.

(21) Appl. No.: 11/570,307

(22) PCT Filed: May 1, 2005

(86) PCT No.: PCT/IL2005/000445

§ 371 (c)(1),
(2), (4) Date: Jul. 30, 2007

(87) PCT Pub. No.: WO2005/120424

PCT Pub. Date: Dec. 22, 2005

(65) Prior Publication Data

US 2008/0146980 A1 Jun. 19, 2008

(30) Foreign Application Priority Data

Jun. 9, 2004 (WO) ..... PCT/IL2004/000487
Mar. 29, 2005 (IL) ..... 167733

(51) Int. Cl.
*A61H 7/00* (2006.01)

(52) U.S. Cl. ..... 601/148; 601/134; 601/151

(58) Field of Classification Search ..... 601/41, 601/44, 134, 148–152, 132, 133, 136, 143, 601/144, 147, DIG. 20; 606/201, 203
See application file for complete search history.

(56) References Cited

U.S. PATENT DOCUMENTS

| | | | |
|---|---|---|---|
| 718,766 | A | 1/1903 | Ingram |
| 2,118,699 | A | 5/1938 | Chappell |
| 3,804,084 | A | 4/1974 | Lehman |
| 3,853,121 | A | 12/1974 | Mizrachy et al. |
| 4,004,579 | A | 1/1977 | Dedo |
| 4,243,039 | A | 1/1981 | Aginsky |
| 4,333,181 | A | 6/1982 | Corriero |
| 4,396,010 | A | 8/1983 | Arkans |
| 4,732,140 | A | 3/1988 | Stoffregen |
| 4,770,164 | A | 9/1988 | Lach et al. |
| 4,928,674 | A | 5/1990 | Haperin et al. |
| 4,982,732 | A | 1/1991 | Morris |
| 5,009,222 | A | 4/1991 | Her |
| 5,277,697 | A | 1/1994 | France et al. |
| 5,334,131 | A | 8/1994 | Spector et al. |
| 5,399,153 | A | 3/1995 | Caprio et al. |

(Continued)

FOREIGN PATENT DOCUMENTS

| | | |
|---|---|---|
| CH | 187824 | 11/1936 |

(Continued)

OTHER PUBLICATIONS

International Search Report for PCT/IL2005/000445, completed Feb. 21, 2006, mailed on Mar. 9, 2006.

(Continued)

*Primary Examiner* — Quang D Thanh

(57) ABSTRACT

The present invention provides a device for enhancing circulation by intermittently tightening and relaxing a closure encircling a limb. The device comprises a continuously operating motor, at least one rotating element and a mechanism driven by the motor for intermittently rotating the rotating element in a first direction to tighten the closure and in a second opposite direction to relax the closure, thereby applying a cyclic pressure on the limb.

51 Claims, 40 Drawing Sheets

U.S. PATENT DOCUMENTS

| | | | |
|---|---|---|---|
| 5,407,418 | A | 4/1995 | Szpur |
| 5,454,831 | A | 10/1995 | McEwen |
| 5,472,413 | A | 12/1995 | Detty |
| 5,513,658 | A | 5/1996 | Goseki |
| 5,575,761 | A | 11/1996 | Hajianpour |
| 5,738,637 | A | 4/1998 | Kelly et al. |
| 5,769,801 | A | 6/1998 | Tumey et al. |
| 5,865,776 | A | 2/1999 | Springs |
| 5,873,848 | A | 2/1999 | Fulkerson |
| 6,010,470 | A | 1/2000 | Albery et al. |
| 6,135,116 | A | 10/2000 | Vogel et al. |
| 6,174,295 | B1 | 1/2001 | Cantrell et al. |
| 6,231,532 | B1 | 5/2001 | Watson et al. |
| 6,290,662 | B1 | 9/2001 | Morris et al. |
| 6,478,757 | B1 | 11/2002 | Barak |
| 6,494,852 | B1 | 12/2002 | Barak et al. |
| 6,551,280 | B1 | 4/2003 | Knighton et al. |
| 6,616,620 | B2 | 9/2003 | Sherman et al. |
| 6,780,163 | B1 | 8/2004 | Krusenklaus |
| 7,004,919 | B2 | 2/2006 | Gaylord et al. |
| 7,025,738 | B2 | 4/2006 | Hall |
| 2002/0026131 | A1 | 2/2002 | Halperin |
| 2002/0169399 | A1 | 11/2002 | Rastegar et al. |
| 2002/0177793 | A1 | 11/2002 | Sherman |
| 2004/0073146 | A1 | 4/2004 | Weintraub et al. |
| 2005/0043657 | A1 | 2/2005 | Couvillon, Jr. |
| 2005/0267387 | A1 | 12/2005 | Baldauf et al. |
| 2006/0047232 | A1 | 3/2006 | Bourne et al. |
| 2006/0074362 | A1 | 4/2006 | Rousso et al. |
| 2006/0122546 | A1 | 6/2006 | Rousso |
| 2007/0055188 | A1 | 3/2007 | Avni |
| 2007/0173886 | A1 | 7/2007 | Rousso et al. |
| 2008/0015630 | A1 | 1/2008 | Rousso |
| 2008/0039752 | A1 | 2/2008 | Rousso |
| 2008/0097268 | A1 | 4/2008 | Rousso |
| 2008/0146980 | A1 | 6/2008 | Rousso et al. |
| 2008/0255494 | A1 | 10/2008 | Rousso et al. |
| 2008/0269543 | A1 | 10/2008 | Rousso |
| 2009/0118651 | A1 | 5/2009 | Rousso et al. |

FOREIGN PATENT DOCUMENTS

| | | | |
|---|---|---|---|
| DE | 19815487 | | 10/1999 |
| WO | WO97/04820 | | 2/1997 |
| WO | WO00/23034 | | 4/2000 |
| WO | WO00/27334 | | 5/2000 |
| WO | WO01/32124 | | 5/2001 |
| WO | WO01/91364 | | 11/2001 |
| WO | WO02/69879 | | 3/2002 |
| WO | WO-02/069879 | A1 | 9/2002 |
| WO | WO2005/051250 | | 6/2005 |
| WO | WO/2005/072674 | | 8/2005 |
| WO | WO2005/072674 | | 8/2005 |
| WO | WO2005/074376 | | 8/2005 |
| WO | WO2005/120424 | | 12/2005 |
| WO | WO2005/120500 | | 12/2005 |
| WO | WO2005/122269 | | 12/2005 |
| WO | WO2006/033114 | | 3/2006 |
| WO | WO2006/033115 | | 3/2006 |
| WO | WO2006/035449 | | 4/2006 |
| WO | WO2006/117771 | | 11/2006 |

OTHER PUBLICATIONS

International Preliminary Report on Patentability for PCT/IL2005/000445 issued on Dec. 14, 2006, mailed on Dec. 28, 2006.

PORTABLE SELF-CONTAINED DEVICE FOR ENHANCING CIRCULATION

RELATED APPLICATIONS

The present invention relates to international patent application serial number PCT/IL02/00157 titled A PORTABLE DEVICE FOR THE ENHANCEMENT OF CIRCULATION AND FOR THE PREVENTION OF STASIS RELATED DVT filed on 3 Mar. 2002 and to international patent application serial number PCT/IL04/00487 titled A PORTABLE DEVICE FOR ENHANCING CIRCULATION filed on 9 Jun. 2004.

BACKGROUND OF THE INVENTION

1. Field of the Invention

The present invention generally relates to enhancement of blood and lymph flow in a limb and in the body. More specifically, the present invention relates to a portable, self-contained device for enhancing circulation which allows for gradient controlled fast transitions from high to low pressure and vice versa.

2. Discussion of the Related Art

The development of a "blood clot" or Deep Vein Thrombosis (DVT) in a limb, specifically in the lower limbs, is a significant health hazard. It may lead to local symptoms and signs such as redness, pain and swelling of the affected limb. It may also be a life hazard by sending small parts of a blood clot towards the lungs corking the circulation through the lungs (called Pulmonary Embolism), leading to reduced ability of the lungs and sometimes of the heart to function. This is accompanied by pain, shortness of breath, increased heart rate and other clinical signs and symptoms. The development of DVT is believed to be related pathologically to Virchow's triad. More specifically, a DVT has increased incidence if three conditions are met in the vasculature; stasis (reduced blood flow), hypercouagulability (increased tendency of clotting in a blood vessel during normal conditions) and endothelial damage (damage to the internal layer of the blood vessel promotes clot formation).

In the ambulatory person the muscles of the leg compress the deep venous system of the leg pushing the blood towards the heart. This phenomena is called the "muscle pump". The muscles of the calf are traditionally implicated in the mechanism of the "muscle pump". During period of immobilization, stasis is believed to be the major risk factor for the formation of DVT. Immobilization includes any period of lack of physical activity whether in the supine or sitting position e.g. bed or chair ridden persons, during long automobile trips, long flights, long working hours in the sitting position and the like.

Recently the medical community named the formation of DVT during long journeys, the "travelers' thrombosis". It is believed that around 5% of manifested DVT originate during traveling. This is believed to occur due to the prolonged immobilization, especially while in the sitting position. This position further compromises blood flow due to kinking of veins in the limb during the sitting position. It was further shown that enhancing the venous blood flow (via a compressing device) during flight, reduced discomfort, limb swelling, fatigue and aching when used on flight attendants.

Limb swelling and discomfort may be present also in states of lymph stasis such as after a mastectomy, pelvic operations during which lymph tissue is removed and in other conditions in which lymphatic return to the heart is impaired. Reduced circulation through a limb can also be observed in conditions affecting the arterial system such as in Diabetes Mellitus (DM). It is believed that various vascular alterations such as accelerated atherosclerosis, where the arterial walls become thickened and loss their elasticity, diabetic microangiopathy, affecting capillaries, as well as neuropathy (loss and dysfunction of nerves) are responsible for the impaired circulation in the diabetic limb. The reduced blood supply to the limb entails stasis and ischemia in the distal limb. This ischemia leads to tissue death (Necrosis) and secondary infections and inflammations. In addition lack of cutaneous sensation caused by the loss of sensory nerves due to the diabetic neuropathy prevents the patient from being alert to the above-mentioned condition developing. Other conditions having similar effect include any diseases involving widespread damage to the arterial tree.

Increasing the flow of blood in the limb during periods of immobility is already a proven method to reduce the risk of DVT formation in the limb. It secondarily prevents the formation of pulmonary embolism (PE) that commonly originates from a DVT. Increasing the venous return from the lower limb can also prevent formation of edema, pain and discomfort in the limb during periods of immobilization. Prevention of DVT related to stasis is commonly achieved via large and cumbersome devices. Most of these devices can be used only by trained medical staff. Such devices operate by either of two methods: Pneumatic or hydraulic intermittent compressions or by direct intermittent electrical stimulation of the "muscle pump". The pneumatic and hydraulic devices use a sleeve or cuff with a bladder that is inflated and deflated by air or fluid compressor thus causing stimulation of the physiological "muscle pump". The pneumatic and hydraulic devices usually require a sophisticated set of tubes and valves, a compressor, a source of fluid and a sophisticated computer control. Moreover, such devices emit substantial noise while operating. The electrical stimulators work by delivering electrical impulses to the calf muscles. These devices require a sophisticated electronic apparatus and may be painful or irritating to patient. Most existing devices aimed at preventing DVT are designed for use in the medical setting, by trained personal. Such devices are generally non-portable. Furthermore, existing devices have slow inflation or deflation time as well as covering a large surface area of the limb while at operation. These operation parameters may render them ineffective for treatment and prevention of arterial insufficiency conditions.

Accordingly, it is the object of the present invention to provide a device for the enhancement of blood and lymph flow in a limb and the prevention of DVT or other conditions development during periods of immobility which simulate intermittent muscle compression of a limb and is portable, self-contained, does not relay on, but is compatible with, external power source, and is easily carried, small, and lightweight. It is a further an object of the present invention to provide a device that enhances the blood flow in the arterial vasculature tree thus aiding in the prevention and healing of diabetic foot and other arterial related diseases. It is a further object of the present invention to provide such a device which is simple to operate by a lay person without any special training in the field of medicine, is easily strapped over or attached to a limb and can be easily be adjusted to fit persons of any size. Another object of the present invention is to provide such a device for the prevention of DVT and other conditions which does not involve air compression and which operates silently, thus allowing its operation in a populated closed space, such as during a flight, without causing any environmental noise annoyance, or at the home of the patient. Another object of the present invention is to provide the intermittent muscle compression by mechanical means, more specifically by transforming energy, electrical or magnetic, into mechanical activity. Another object of the present invention is to provide an energetically effective and efficient apparatus that utilizes a continuous low power input energy source while providing short high power output in order to provide fast intermittent muscle compression and relaxation. A further object of the present invention is to provide such a device for the prevention of DVT and other related conditions that is easy to manufacture and is low cost.

SUMMARY OF THE PRESENT INVENTION

The present invention provides a small portable limb mounted light-weight device for applying intermittent pressure to a limb. The device is likely to improve the circulation of blood and other bodily fluids, improve circulation for Peripheral Vascular Disease patients, assist in Prophylaxis or reduce the chance of Deep Vein Thrombosis. The device may also assist patients of arterial or heart disease, peripheral arterial disease and limb ischemia and improve distal perfusion. The weight of the device is of less than 1 Kg, optionally in the range of 200-400 gr.

The device of the invention intermittently tightens and relaxes a closure encircling a limb. The device comprises a motor, at least one rotating element and a mechanism driven by the motor for intermittently rotating the rotating element in a first direction to tighten the closure and in a second opposite direction to relax the closure, thereby applying a cyclic pressure on the limb. The pressure cycle comprises a first period of relaxed state followed by a first transition to a compressed state and a second period of a compressed state followed by a second transition back to the relaxed state. Preferably, the motor operates continuously during the pressure cycle wherein the motor's shaft continuously revolves in one direction.

The device mechanism includes a first clutch for locking/unlocking the rotating element and a mechanical energy storage element coupled to the rotating element. The mechanical energy storage element, optionally a spring, is configured to be charged by the motor during at least the relaxation period and to be discharged to effectuate at least one of two transitions. The device may include a second clutch for coupling/decoupling between the motor and the mechanical energy storage element and a first and a second disengaging elements for disengaging the first and the second clutches. In accordance with the invention, unlocking the first clutch effectuates rotation of the rotating element in the first direction and unlocking the second clutch effectuates rotation the rotating element in the second opposite direction. Optionally, the device includes a strap returning spring assembly biased to rotate the rotating element in the second opposite direction and a deceleration assembly interposed between the mechanical energy storage element and the rotating element.

In accordance with one embodiment, the rotating element, the mechanical energy storage element, the first and the second clutch and the deceleration element are all arranged in a hamburger-like configuration about one common axis.

The closure may comprise at least one strap portion connectable to the rotating element and configured to be drawn inwardly when the rotating element is rotated in the first direction and to extend outwardly when the rotating element is rotated in the second opposite direction. Optionally, the strap portion is connected to the rotating element by means of a cable configured to wind/unwind around the rotating element. In accordance with an embodiment of the invention, the closure comprises two strap portions connectable to the rotating element and wherein each of the two strap portions is configured to wind about the rotating element when the element is rotated in the first direction and to unwind when the rotating element is rotated in the second opposite direction. Yet in accordance with another embodiment, the device comprises two strap rollers coupled to the rotating element and each of the two strap portions is connected to one of the strap rollers so as to wind around the roller when the rotating element is rotated in the first direction and to unwind when the rotating element is rotated in the second opposite direction. The two strap portions may be connectable to each other to form a loop or alternatively, the two strap portions may be attachable to a separate sleeve encircling the limb.

In accordance with a preferred embodiment of the invention, the device comprises a mainspring having a one end coupled to the rotating element and the other end coupled/decoupled to the motor by means of the second clutch. The mainspring may be housed in a two-part mainspring housing ratable with respect to each other wherein one end of the mainspring is fixedly connected one part of the mainspring housing and the second end is fixedly connected to the second part of the mainspring housing. The two parts may have a limited rotation with respect to each other so as to limit the operative range of the mainspring to 80%-100% of the maximal torque built in the mainspring during operation. In accordance with one embodiment, the first and the second disengaging elements may be mounted on a camshaft driven by the motor and the device comprises a first speed reducing gear coupling between the motor and the camshaft and a second reducing gear coupling between the camshaft and the second end of the spring. Yet in accordance with alternative embodiment the mainspring, the first and second clutches and the first and second disengaging elements are arranged around one common axis. The device may further comprise a deceleration assembly configured to slow down rotational motion of said at least one rotating element. The deceleration assembly comprises two parts, wherein one part is coupled to, or housed within, the first part of the mainspring housing and the second part is coupled to, or housed within, the second part of the mainspring housing.

Optionally, the present device further includes a power source for powering said motor wherein the power source may be at least one battery, optionally a chargeable battery. Optionally, the device includes a detector and an indicator for detecting and indicating, respectively, a low battery condition. The device may further include an electronic circuit including an on/off switch for controlling the power source and with a detector for detecting the transition from the compressed state to the relaxed state so that in response to switching the on/off switch to the off position, the electronic circuit switches off the power source at a predetermined time after the transition is detected.

Optionally, the device is provided with a sensor for monitoring the device activity wherein monitoring the device activity includes detecting a loose strap condition and/or an over-tight strap condition and/or a malfunction condition. The device may be further provided with at least one indicator for indicating a loose strap condition and/or a tight strap condition and/or a malfunction condition. The device may further include a memory component for storing information regarding the device activity and with an output means coupled to the memory component for allowing downloading the information into an external computer device. The information may include start and stop time records of operation periods of the device. The sensor for activity monitoring is optionally located opposite a rotating component that is coupled to the rotating element, thus reflecting the rotational movement of the rotating element wherein the rotating component is provided with at least one marker configured to be detected by the sensor. The sensor may be an opto-coupler comprising a light transmitter and a light detector wherein the marker is configured to block/unblock light passage therebetween. Alternatively, the sensor may be an optical reader wherein the marker is at least one line marked on the rotating component.

BRIEF DESCRIPTION OF THE DRAWINGS

The present invention will be understood and appreciated more fully from the following detailed description taken in conjunction with the drawings in which:

FIG. 8 depicts an enhanced sixth embodiment of the present invention, referred to as a reverse propulsion embodiment:

FIG. 9 describe a seventh enhanced embodiment of the present invention:

FIG. 10 illustrate an eighth embodiment of the present invention having a continuous operating motor; FIG. 10C shows the device with the protecting cover on;

DETAILED DESCRIPTION OF PREFERRED EMBODIMENTS

A device for the intermittent compression of the extremities muscles for the enhancement of blood and lymph flow in a limb is disclosed. The present invention can be helpful in the prevention of Deep Vein Thrombosis (DVT), reduce lymph edema, prevent and reduce incidence and complications of diabetic as well as other arterial insufficiency states by applying periodic squeezing forces on a limb, in particular a lower limb. More specifically, the present invention relates to a portable, self contained, mechanical device for enhancing the blood in a limb, enhancing the lymph and venous return from a limb, specifically a lower limb, towards the heart, aiming at reducing the risk of DVT formation, edema formation, lymphedema, and improving the general circulation in a limb during periods of immobility, increased stasis as well as conditions of reduced circulation such as in diabetic patients, post surgical patients and the like. The present invention discloses a mechanical apparatus and the method of operation of the same having favorable energetic features allowing the operation of the apparatus at a maximum output with minimal energy input. The device and the method of operation of the present invention operates at a best energetic efficiency by utilizing low input energy having an energy saving machinery thus enhancing energy output, more specifically by utilizing energy source optimization, internal machinery energy saving features as well as tissue characteristics enhances the favorable energetic profile of the present apparatus as well as reducing the energy requirement of the apparatus. The present invention can also operate at different energetic profiles suitable for the multitude of purposes more specifically for enhancing venous, arterial as well as lymph flow through a limb.

Figure 1:
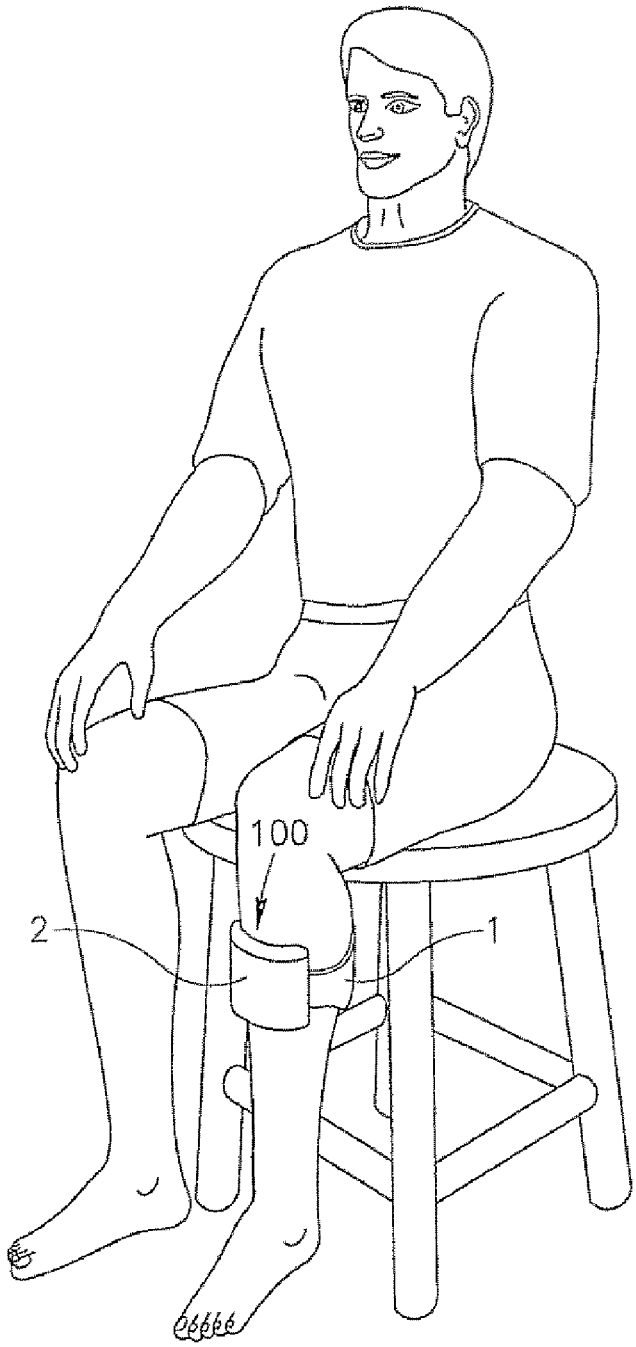
FIG. 1 is a pictorial illustration of the device of the present invention strapped to the calf of a sitting person.

The portable device of the present invention, generally designated 100, is shown in FIG. 1, worn on the calf of a sitting person, Device 100 can be worn directly on the bare limb, or on a garment, such as trousers, worn by the person using the device. Device 100 comprises two main components, an assembly box 2 which contains all the machinery parts responsible for the device operation, and a strap 1 connected to said assembly box such as to form a closed loop (designated 50, see FIG. 2) for encircling a person limb. The power supply for the device may be of the internal power supply type such as a rechargeable or non rechargeable low voltage DC batteries or an external power supply type such as an external power outlet connected via an AC/DC transformer such as a 3-12V 1 Amp transformer, fed through electrical wires to a receptacle socket in the device (not shown). As shown in FIG. 1, strap 1 is preferably wide in the middle and narrow at the ends where it connects to assembly box 2. Strap 1 however may assume any other shape and form such as a constant width belt. The strap can be fabricated from any flexible material that is non-irritating to the skin, such as thin plastic, woven fabric and the like. Strap 1 can be fabricated from one material or alternatively can combine more than one material. For example, strap 1 can be made of both non stretchable material and stretchable material wherein such an arrangement may be dispose of a stretchable material for example rubber fabric in the center of the strap 1 and a non stretchable material such as plastic flanking the stretchable material and comprising the rest of the strap. Such an arrangement facilitates a more uniform stretch forces on the strap as well as preventing the slippage of the strap from the limb. According to the preferred embodiment shown in FIG. 1, hereinafter called the anterior box embodiment, strap 1 is placed against the muscles while assembly box 2 is placed against the calf bone. However, according to another embodiment of the present invention, hereinafter called the posterior box embodiment, assembly box 2 can be placed against the muscles.

Figure 2A:
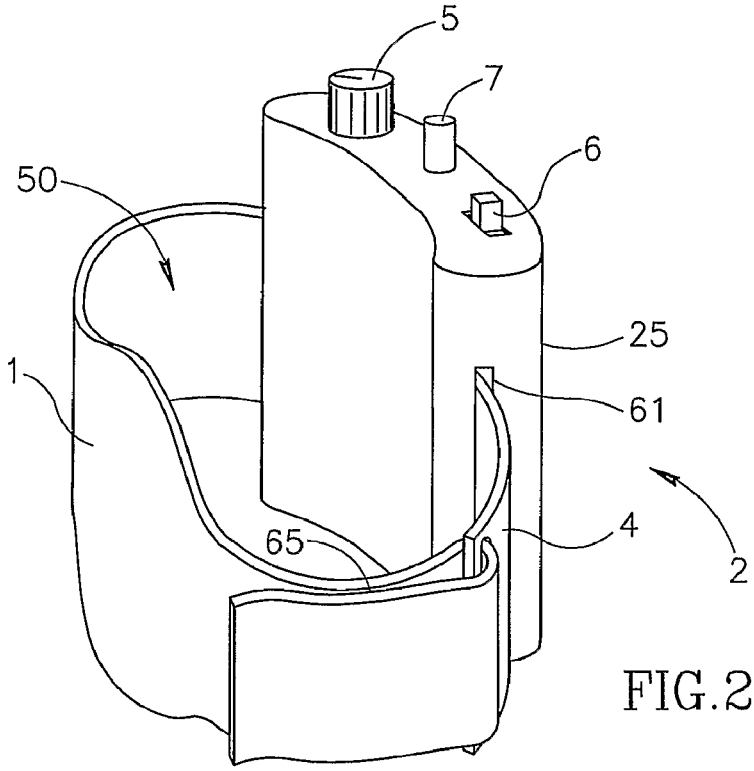
FIG. 2A is a side external view of a preferred anterior box embodiment of the present device, in which squeezing the limb muscles is performed by intermittent shortening the circumference of a loop created by an assembly body and strap.
Figure 2B:
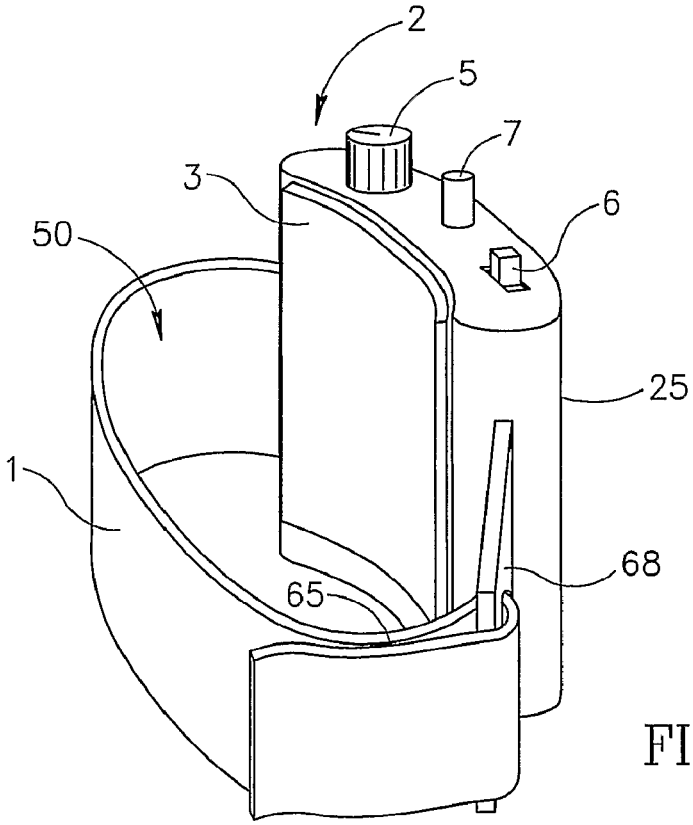
FIG. 2B is a side view illustration of an posterior box embodiment in which the assembly box is the active intermittent compressing part placed against the calf muscles.

FIGS. 2A, 2B illustrate two possible embodiments of the device of the present invention. FIG. 2A represents a preferred embodiment of the present device, in which squeezing the limb muscles for promoting the increase of blood and lymph flow in the limb, is performed by pulling and releasing strap 1, thus, intermittently shortening the effective length of loop 50 encircling the limb. This embodiment is preferably used as an anterior box embodiment of the present invention. However, it will be easily appreciated that the device of FIG. 2A can be used as a posterior box embodiment as well. FIG. 2B presents another embodiment of the present device in which assembly box 2 is the active intermittent compressing part by means of mobile plate 3 attached to the box. This embodiment, which can be used only as a posterior box embodiment, will be explained in conjunction with FIG. 6.

Turning back to FIG. 2A, assembly box 2 comprises a thin, curved flask-shaped casing 25 which contains all the parts of internal machinery responsible for intermittent pulling and releasing strap 1. Casing 25 is preferably fabricated from, but not limited to, a plastic molding, a light metal, or any other material which is light, non irritating to the skin, and cheep to produce. Strap 1 is connected at both its ends to assembly box 2 by means of two buckles 4 and 42 at the sides of casing 25 (buckle 42 not shown). At least one of said buckles (here buckle 4) is a mobile buckle, which can move in and out of casing 25 through slit (opening) 61, thus pulling and relaxing strap 1 between a retracted and a relaxed positions. The retraction protraction motion shortens and lengthens the effective length of strap 1, thus causing intermittent compression of the underlying muscle and increasing the blood and lymph flow in the underlying vessels. Possible inner machinery responsible for activating the intermittent pulling of strap 1 is described in the following in conjunction with FIGS. 3 to 6. Strap 1 can be adjusted to fit the size of the limb, on which device 100 is to be operated, by having at least one of its ends free to move through its corresponding buckle, such that the strap can be pulled by said end for tightening the strap around said limb. Said end is then anchored in the appropriate position. In the example shown here, the strap is folded back on itself and the overlapping areas are fastened to each other by fastening means 65, such as Velcro™ strips, snap fasteners or any other fastening or securing means. Alternatively, said strap end can be secured to casing 25 by fastening means such as Velcro strips, opposite teeth-like protrusions both on casing 25 and on strap 1, and the like. The other end of strap 1 can be connected to its corresponding buckle either in a permanent manner by attaching means such as knots or bolts, or can be adjustable in a similar manner to what had been described above, allowing both ends to be pulled and anchored simultaneously for better fitting. Yet, in accordance with another embodiment of the invention, the strap can be wound around a retracting mechanism positioned at one side of casing 25. The free end of the strap can be provided with a buckle for allowing connection into the opposite side of casing 25 either by one of the aforementioned means described or by means of a quick connector. Outer casing box 25 also includes an on/off switch 6, a force regulator 5 for regulating the force exerted on the calf muscle by strap 1 and a rate regulator 7 for regulating the frequency of intermittent compressions. Alternatively, force regulator 5 and on/off switch 6 can be combined into one button. Force regulation can be obtained for example by way of controlling the length of the strap interval between retracted and protracted positions. The length interval between contracted and relaxed positions is preferably, but not limited to, 1-50 millimeters. Frequency regulation can be obtained by way of regulating, but not limited to, the speed of the inner machinery. A person skilled in the art will readily appreciate that the present invention can be used for the enhancement of both arterial and venous blood and lymph flow in a limb (upper and lower). The examples provided in the following discussion serve as an example and should not be construed as a limitation to the application of the preset invention.

Figure 3A:
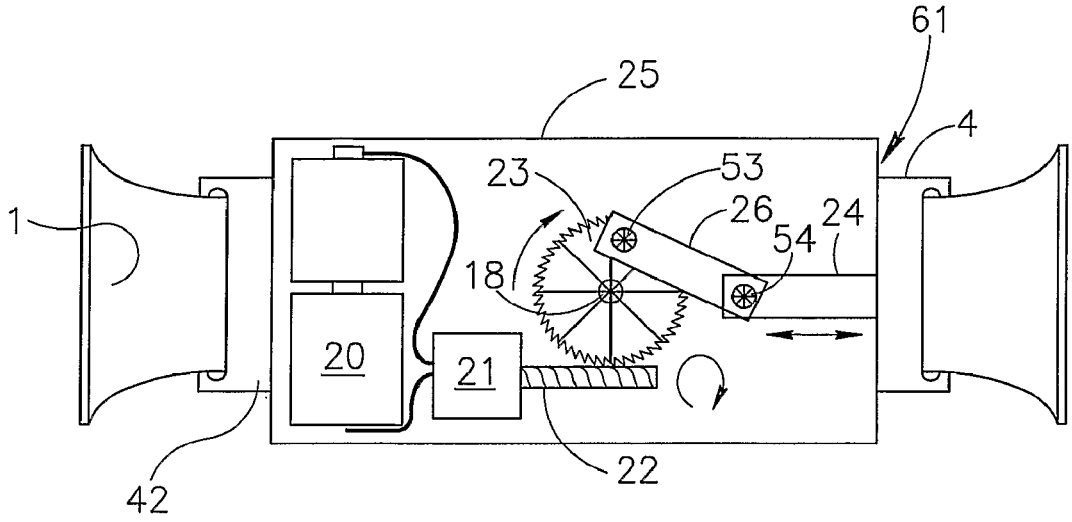
FIG. 3A is a cross section of a device in accordance with the embodiment of FIG. 2A, showing a first embodiment of an internal mechanism of the assembly box.
Figure 3B:
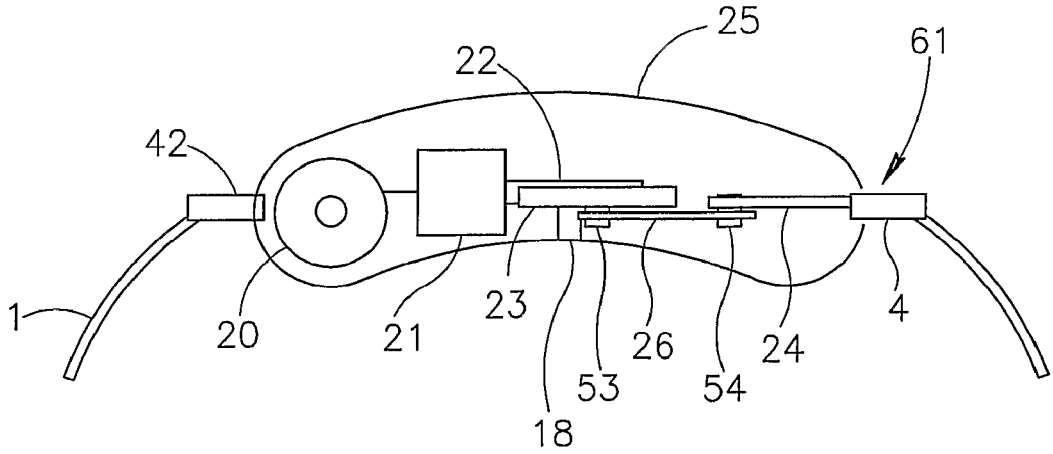
FIG. 3B is a top view of the device of FIG. 3A.

Referring now to FIGS. 3A and 3B, there is shown a side view and a top view respectively of first inner machinery for the device of FIG. 2A. The numerical are corresponding in both drawings. According to this embodiment, one end of strap 1 is connected to assembly box 2 via a fixed fitting 42 by means such as bolts, knots glue, etc. The second end is connected via a movable buckle 4, which traverses slit 61 located at the side of casing 25. Buckle 4 can retract and protract through opening 61, as described above. Movable buckle 4 is connected to the inner machinery by means of attachment to a rigid push/pull rod 24. The inner machinery responsible for the motion of movable buckle 4 is herein described. Energy source 20 such as low voltage DC batteries, supplies electrical energy to an electrical motor 21 such as, but not limited to, a 3-12 V DC motor, via electrical contacts such as wires. Electric motor 21 converts electric energy into kinetic energy, spinning a spirally grooved (worm) central shaft 22. Shaft 22 is coupled to a (speed reduction) wheel 23, having complementary anti-spiral circumferential grooves or teeth, causing wheel 23 to revolve around its center which is fixed by axis 18 perpendicular to its surface. An elongated connector plate 26 is pivotally jointed at one end to off-center point 53 on wheel 23 and at its second end to rod 24 at point 54, such that the rotation of wheel 23 actuates plate 26 to intermittently push and pull rod 24, in a crankshaft manner. Consequently, mobile buckle 4 is intermittently pulled inward and outward casing 25 through slit 61, thus intermittently shortening the circumference of loop 50.

Figure 3C:
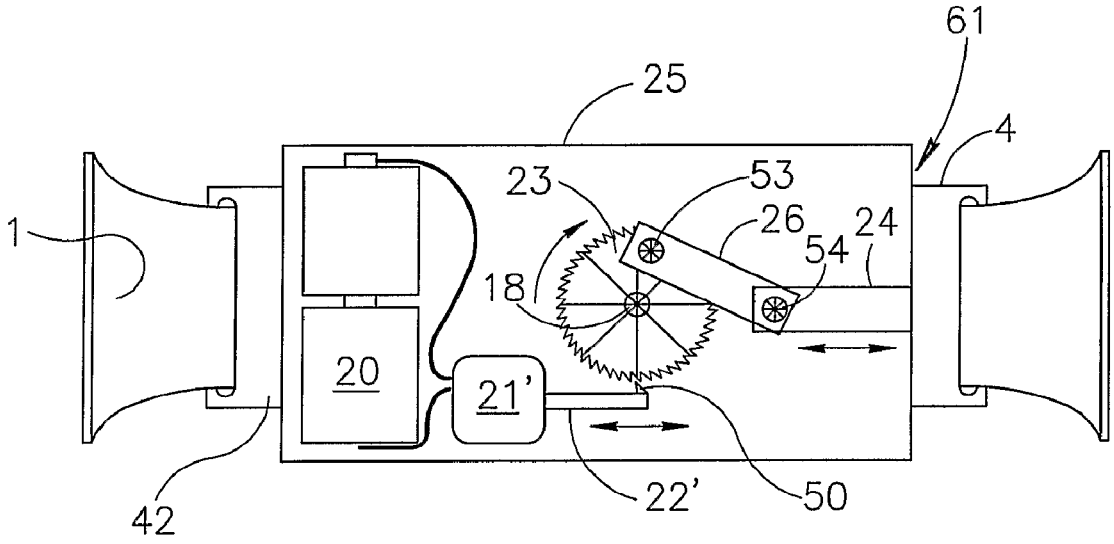
FIG. 3C depicts a modified mechanism of the embodiment of FIGS. 3A and 3B.

Modified machinery, represented in FIG. 3C, includes the following changes with reference to FIGS. 3A and 3B. The electric motor 21 and spinning worm shaft 22 are replaced with an electromagnetic motor 21' (such as a push-pull solenoid 191C distributed by Shindengen electric Ltd.) having a reciprocating central rod 22' with an upwardly inclined spike-tooth projection 50 at its end. Rod 22', via projection 50 is coupled to wheel 23, having complementary teeth. As reciprocating rod 22' slightly protrudes from, and retracts into the motor body, projection 50 latches sequential teeth of wheel 23 as it protrudes and pulls wheel 23 as it retracts, causing wheel 23 to revolve around its axis. The mechanism of FIG. 3C generates a large force output while minimizing the power input. Such machinery is very cost effective. The above description clearly shows how the internal mechanical machinery of the proposed device acts to intermittently shorten loop 50, culminating in intermittent compression of the leg or hand muscle and leading to increase of venous return and helping in the prevention of the formation of deep vein thrombosis.

Figure 4A:
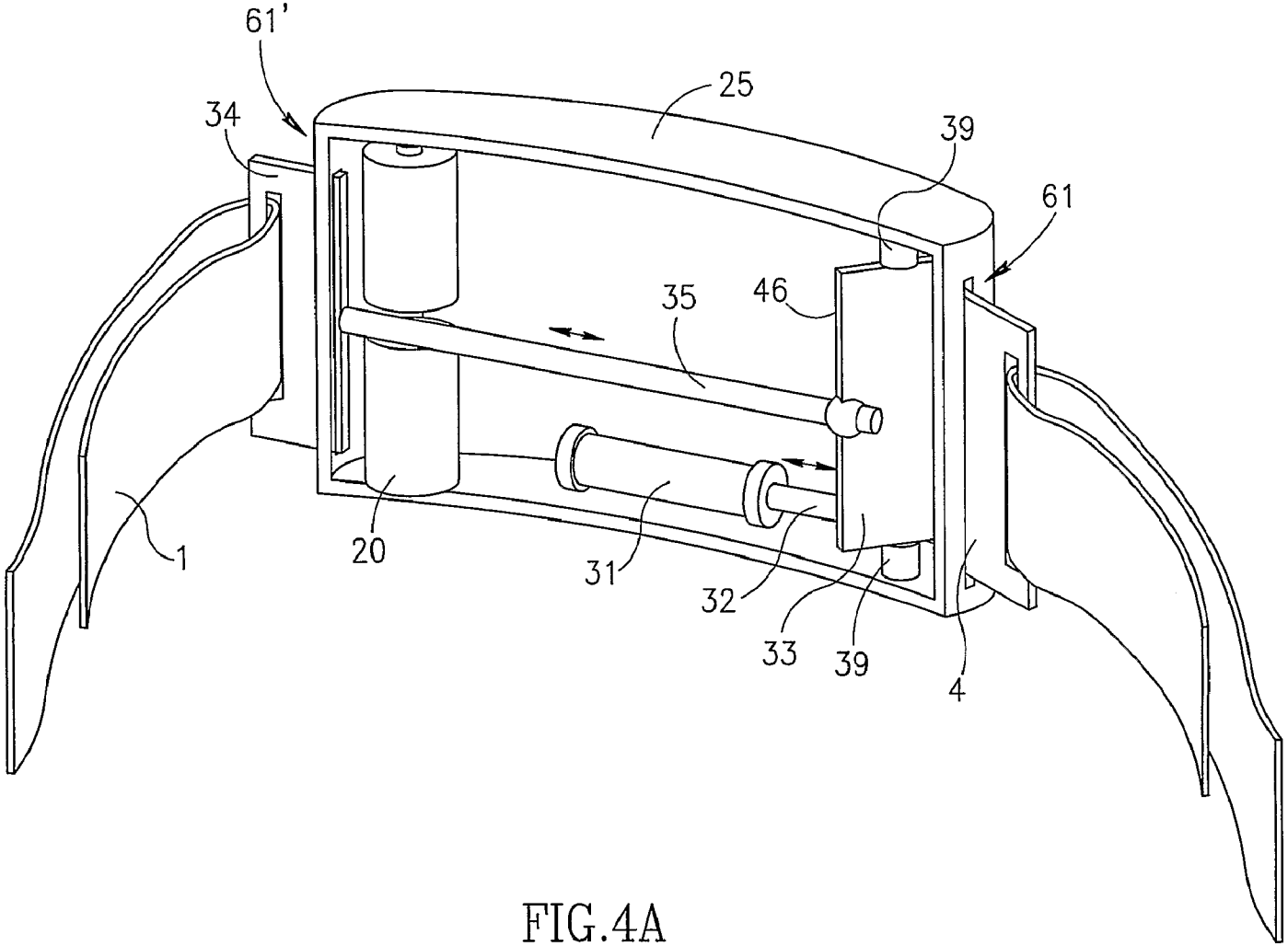
FIG. 4A is pictorial representation of a second alternative mechanism for the embodiment of FIG. 2A using electromagnetic motor, a centrally hinged rotating rectangular plate and a longitudinal bar connecting both sides of the strap.
Figure 4B:
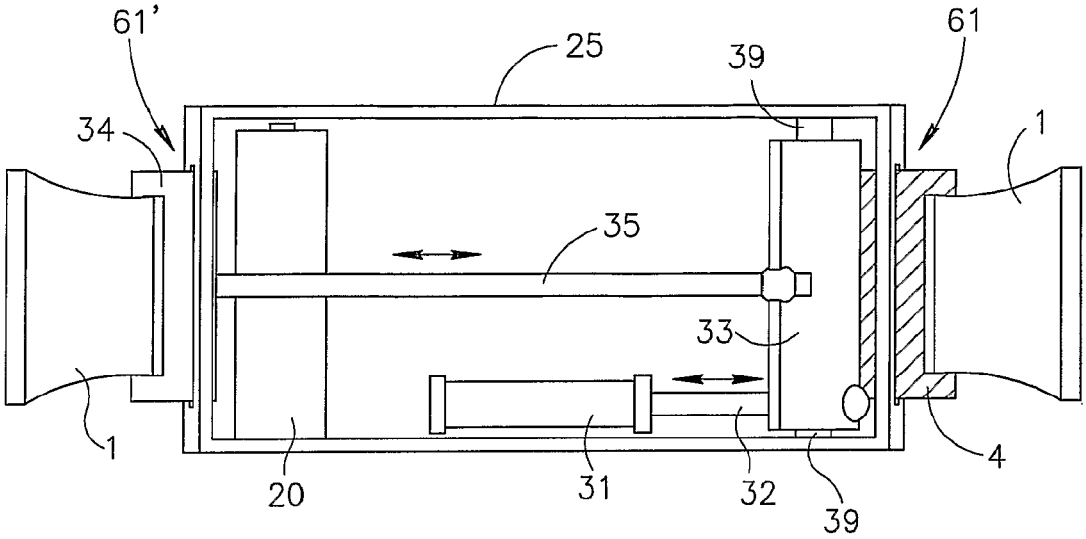
FIGS. 4B and 4C are side and top view respectively of the embodiment presented in FIG. 4A.
Figure 4C:
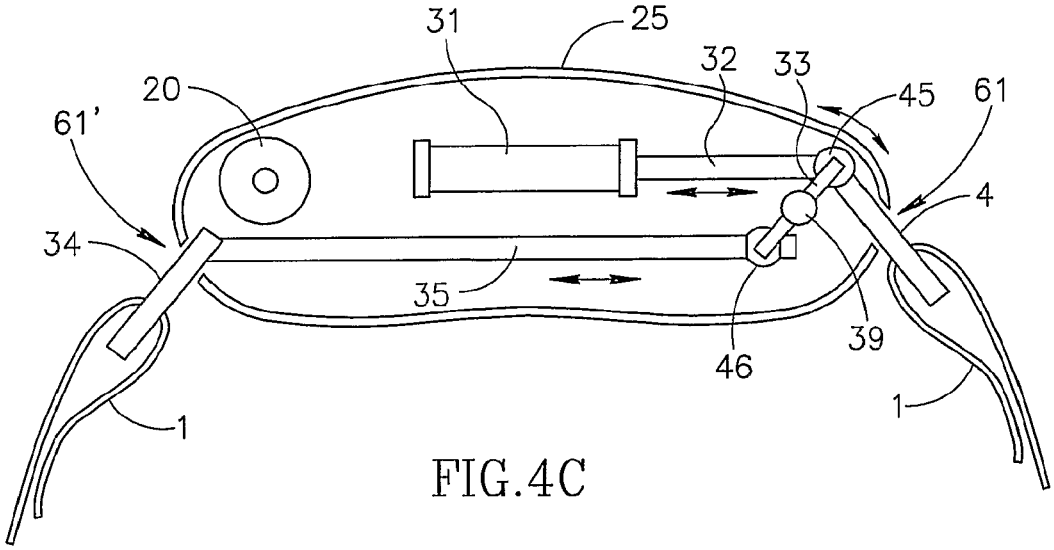

An alternative machinery embodiment for the device embodiment of FIG. 2A is shown in FIGS. 4A, 4B and 4C. FIG. 4A is a perspective drawing view showing the internal parts of assembly box 2 with the frontal part of casing 25 removed. FIGS. 4B and 4C side and top view, respectively of the embodiment shown in FIG. 4A. According to this embodiment, both ends of strap 1 are connected to the inner machinery of assembly box 2 by means of two movable buckles 4 and 34, which can move inwardly and outwardly casing 25 through slits 61 and 61', respectively. This alternative embodiment combines the following elements: A rectangular plate 33 positioned close to one side wall of casing 25, adjacent to slit 61. Plate 33 having two parallel rectangular surfaces, two narrow vertical edges, designated 45 and 46, and two narrow horizontal edges. Plate 33 is pivotally mounted at its narrow horizontal edges to the top and bottom walls of casing 25, by pivoting means 39, such as to allow rotational movement of the plate around the vertical axis connecting between pivoting means 39; A push-pull electromagnetic motor 31 (such as pull tubular solenoid 190 distributed by Shindengen electric Ltd.) connected via its reciprocating central rod 32 to one vertical edge (45) of the centrally hinged rectangular plate 33, at about mid point of said edge; A longitudinal rod 35 spans the length of casing 25. Said longitudinal rod 35 is connected at one end to the opposite vertical edge (46) of plate 33 and at its second end to movable buckle 34 positioned at the other side of casing 25. Centrally hinged rectangular plate 33 is thus connected on one side to the electromagnetic motor 31 via central rod 32, and on the other side to longitudinal rod 35 (as best seen in FIG. 4C). Movable buckle 4 is also connected to narrow edge 45 of plate 33 but extends outwardly, through slit 61, in the opposite direction to rods 32 and 35.

As can be best seen in FIG. 4C, the reciprocating movement of rod 32 causes plate 33 to turn back and forth around its central axis, preferably the angular displacement is in the range of 20 to 60 degrees. Consequently, buckles 4 (coupled directly to plate 33) and 34 (by means of connecting rod 35) are synchronously pulled and pushed inward and outward of casing 25, resulting in intermittent shortening of the limb encircling loop. This embodiment is advantageous because the longitudinal rod 35 allows both buckles 34 and 4 to approximate each other at the same time, thus enhancing the efficiency of the device (by enhancing the reciprocating displacement of electromagnetic motor 31) and requiring less energy.

Figure 5A:
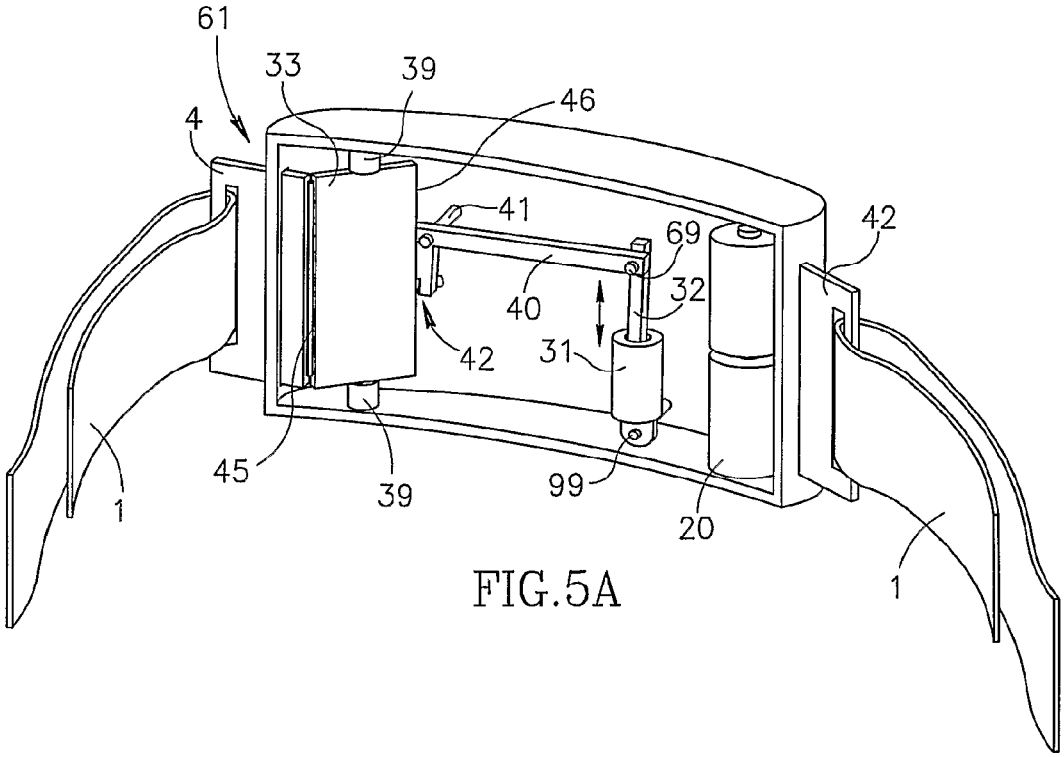
FIGS. 5A and 5B depict a third mechanism for the embodiment of FIG. 2A using an enhanced power transmission by means of an "L" shaped lever bar.
Figure 5B:
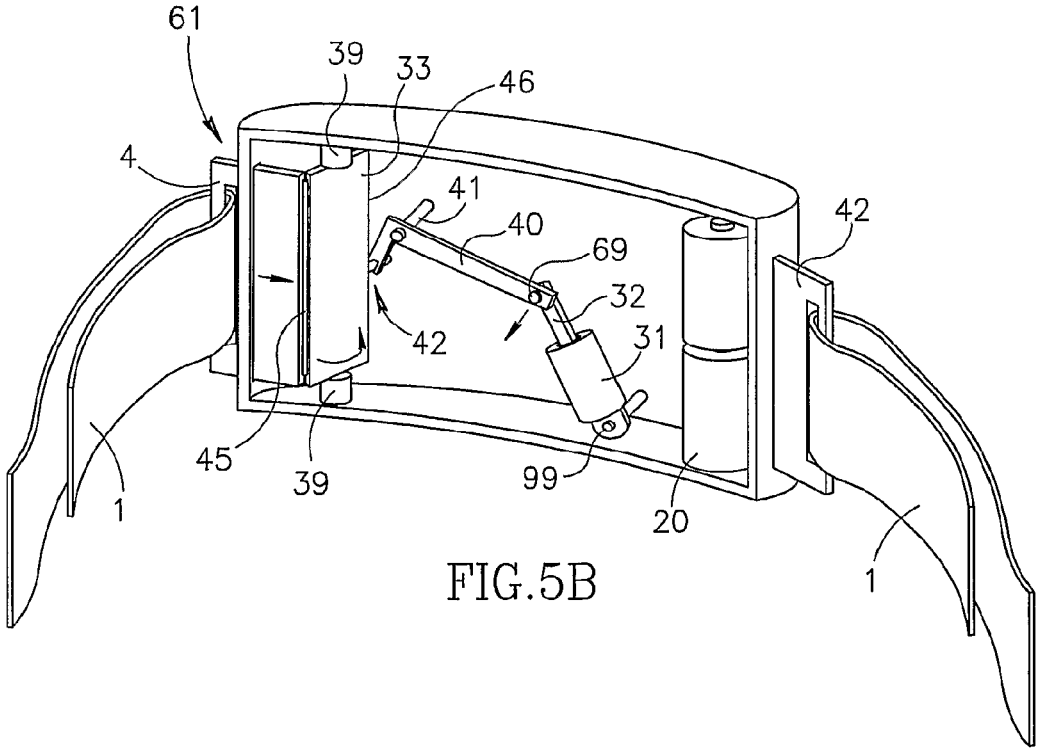

FIGS. 5A and 5B illustrate yet another alternative machinery for the device embodiment of FIG. 2A. The embodiment of FIG. 5 also uses a pull-push electromagnetic motor as the driving force but allows force enhancement by the addition of an "L" shaped lever bar 40 to the said centrally displaced rod 32 of the embodiment shown in FIG. 4. According to this embodiment, one edge of strap 1 is connected to fixed buckle 42 while the second end is connected to movable buckle 4 which transverse casing 25 through side slit 61. The movable buckle 4 is connected to centrally hinged rectangular plate 33 in a similar manner to what have been described in conjunction with FIG. 4. In accordance with the present embodiment, electromagnetic motor 32 is pivotally mounted at its rear end to the base by pivoting means 99. The "L" shaped lever bar 40 pivotally mounted at its longer arm end to reciprocating rod 32 by pivoting means 39, and at its shorter arm end is attached to narrow edge 46 of plate 33, by attaching means 42, in a manner which allows it to slide up and down said edge. Such attaching means can be obtained, for example, by railing means such as a groove engraved along the edge of the short arm of lever 40 and a matching protruding railing extending from narrow edge 46 of plate 33. The right-angled corner of "L" shaped bar 40 is pivotally anchored to casing 25 by means of axis 41 perpendicular to the bar surface. FIG. 5A represents the "relaxed" mode (i.e., buckle 4 in protracted position), while FIG. 5B is in a "contracted" mode (buckle 4 in retracted position). To understand the action of this embodiment a static description of the "relaxed" mode followed by the "contracted" mode description is herein given. The "relaxed" mode in FIG. 5A, illustrates the electromagnetic motor 32 at a perpendicular position to the base of casing 25, and "L" shaped lever 41 in a perpendicularly positioned to reciprocating rod 32.

The "contracted" mode is shown in FIG. 5B. When reciprocating rod 32 retracts into electromagnetic motor 31, it causes the "L" shaped to rotate around axis 41, such that connection 69 moves toward electromagnetic motor 31 as well as toward the rectangular plate 33. This rotation is allowed due to pivot attachment 99 of electromagnetic motor 31 and pivot attachment 41 of "L" shaped lever bar 40. The other end of the "L" shaped lever bar 41 slides in the upward direction on edge 46 of rectangular plate 33 and at the same time it pushes plate 33 causing it to rotate counterclockwise such that edge 45 and consequently buckle 4 are drawn deeper into casing 25. When reciprocating rod 32 reciprocates its motion, "L" shaped bar 41 returns to its "relaxed" perpendicular position (FIG. 5A) and consequently edge 45, along with buckle 4 are pushed outwardly. Thus, this chain of events leads to an effective intermittent shortening of the limb encircling loop (50) and to an intermittent compression of the underlying muscle enhancing the blood flow.

Figure 6:
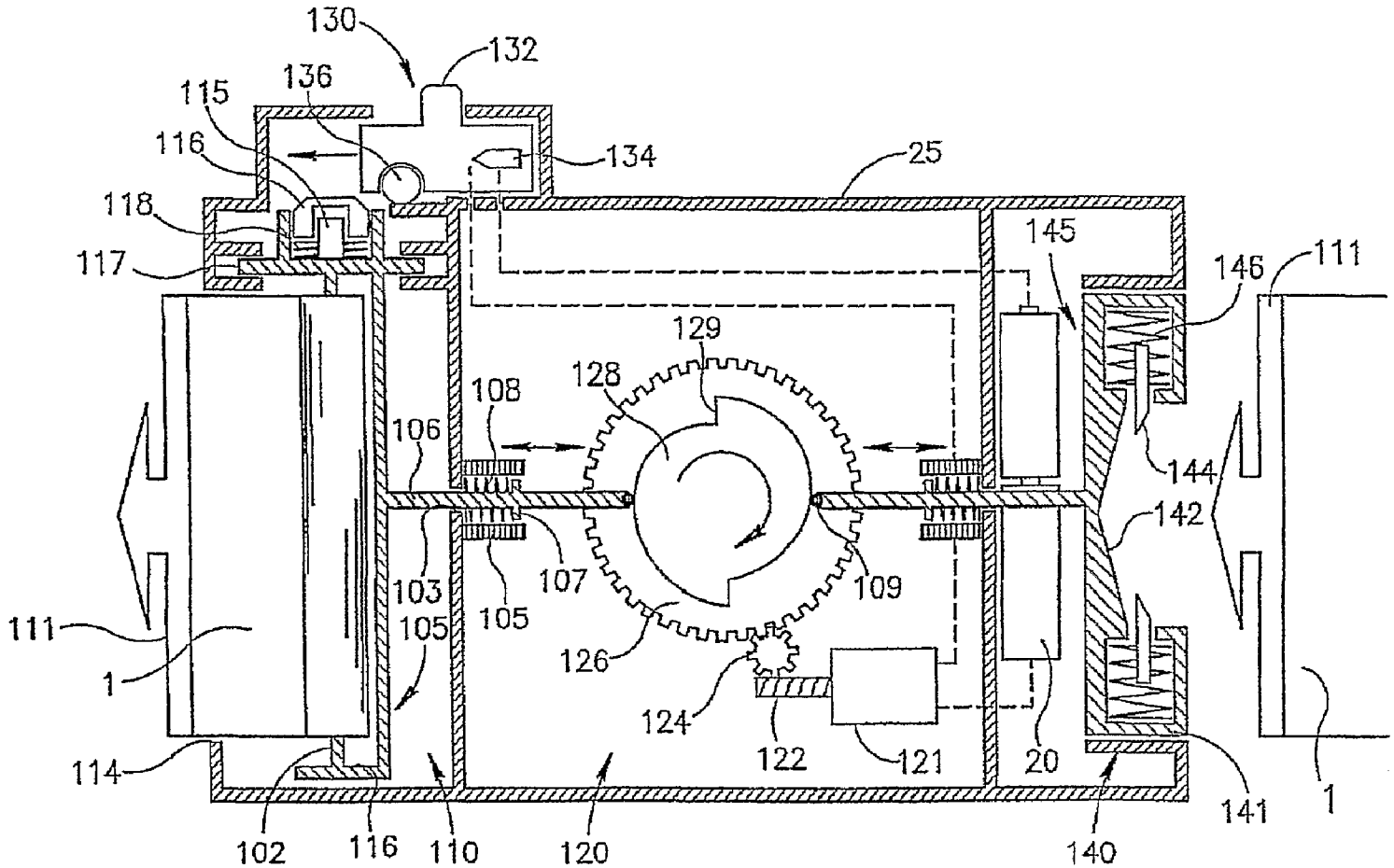
FIG. 6 is a side view of a fourth embodiment of a device in accordance with the present invention.

FIG. 6 illustrates yet another preferred embodiment of the present invention, including means for allowing asymmetrical contraction-relaxation cycle and in particular for allowing fast contractions, followed by much longer periods of relaxation. Such a cyclic pattern is found to have the most beneficial effect for enhancing blood and lymph flow. In accordance with this embodiment, the machinery components responsible for intermittent pulling and releasing strap 1 comprises a motor 121 having a worm shaft 122, a speed reducing gear comprising wheels 124 and 126, coupled to shaft 122, and a disk 128 of irregular perimeter, concentrically mounted on wheel 126. Double-tooth disk 128 is shaped as two identical halves of varying curvature radius, each having a gradual slope at one end and a cusp 129 where the radius changes abruptly from maximum to minimum at its second end, wherein between two ends the radius of curvature is almost constant. The machinery components, including motor and wheels, are accommodated in a central compartment 120 of casing 25. Two side compartments, 110 and 140, accommodate laterally movable strap connectors 105 and 145, respectively. Compartments 110 and 140 are provided with side slits 114 and 141, through which strap 1 can slide in and out. In accordance with the embodiment shown here, strap 1 is retractably mounted at one side of casing 25 (compartment 110) and having its free end provided with a quick male connector for connecting into complementary female connector in compartment 140. This strap fastening arrangement allows for quick and simple adjustment of the strap to the size of the limb and for exerting primary pressure on the muscles. Accordingly, connector 105 includes a vertical rod 102 rotate ably mounted between two horizontal beams 116 and 117, allowing rod 102 to revolve around its axis for rolling or unrolling strap 1. Strap 1 is affixed to rod 102 at one end and is wound around the rod. Rod 102, acting as a spool for strap 1, is provided with a retraction mechanism (not shown). The retraction mechanism can be any spring loaded retracting mechanism or any other retraction mechanism known in the art, such as are used with seat belts, measuring tapes and the like. For example, the retraction mechanism can comprise a spiral leaf spring having one end secured to rod 102 so as to present torque on the rod when strap 1 is withdrawn and to cause the strap to roll back once its free end is released. The upper end of rod 102 terminates with head 115 and a cap 116 of a larger diameter mounted on springs 118. The inner surface of cap 116 fits onto outer surface of head 115, such that when cap 115 is pressed downward, it locks head 115, preventing free rotation of rod 102 and consequently preventing strap 1 from being rolled or unrolled. The second free end of strap 1 terminates with buckle 111 which fits into a complementary accepting recess 142 of connector 145 for allowing quick connection into the second side of casing 25. In the example illustrated here, buckle 111 has an arrow shape while connector 145 has a complementary arrow shape recess 142 provided with slanted protrusions 144 mounted on springs 146. When buckle 111 (duplicated on the right side of FIG. 6 for description sake only) is pushed toward recess 142, protrusions 144 are pressed aside, and then fall behind the arrow head of buckle 111, locking the buckle.

The device is further provided with an on/off switch 130 comprising button head 132, electrical connector 134 made of electric conductive material, and a bottom protrusion 136. When switch 130 is pushed to the left by means of head 132, connector 134 closes the electric circuit (shown in broken line), setting the machinery into action. Simultaneously, protrusion 136 presses cap 116 downward, locking head 115 and preventing rod 102 from turning around its axis, for fixing the available length of strap 1. Button 132 can be further provided with a force regulator for regulating the frequency. Movable connectors 105 and 145 are coupled to the machinery components by means of horizontal rods 106, which extend through openings 103 into central compartment 120 and are in contact with disk 128 perimeter. Horizontal rods 106 terminate with bearings 109 which allow the rods to smoothly slide along disk 128 perimeter as the disk revolves around its axis. Thus, the distance between rods 106, and consequently the periodical change of the circumference of the loop encircling the limb, mimics the outline shape of disk 128. In order to maintain constant contact between bearings 109 and disk 128 and to facilitate fast transition between strap relaxed to contracted position, rods 106 are mounted on biasing springs 108 positioned between walls 105 and are provided with plates 107 perpendicular to the rod axis and pressed against springs 108. Thus, springs 108 bias connectors 105 and 145 in the inward direction toward each other. As disk 128 revolves around its axis, springs 108 are compressed by plates 107 in accordance with disk 128 varying radius. When disk 128 rotates to the point where cusps 129 simultaneously face bearing 109, rods 106 momentarily lose contact with disk 128 and the potential energy stored in springs 105 is released, pushing rods 106 inwardly. This causes a sudden inward pulling of strap 1 by both rods 106, leading to sharp squeezing of the limb muscles. It will be easily realized that the length interval between contracted and released states of the limb encircling loop, and hence the squeezing force exerted on the muscles, is directly proportional to the radius change at cusp 129. Following the sudden strap contraction, the rods are gradually pushed outwardly leading to strap relaxed mode which lasts for substantially half a cycle. Hence, one revolution of disk 128 around its axis results in two fast strap contractions. Typically, the transition from relaxed to contacted position takes about 0.5 seconds, the transition from contracted to relaxed position takes about 5 seconds and the relaxed position is maintained for about 50 seconds. However, it will be easily realized that the perimeter of disk 128 can be shaped such as to obtain any desired contraction-relaxation cyclic pattern. For example, using alternative disk 128 shapes having four cusps rather than two can shorten each cycle by half as well as change the output force of each cycle. It can also be easily realized that disk 128 having a changing radius is energetically efficient allowing the steady build up of energy to be stored in springs 108 during each cycle and to be released in a short burst of high energy output at the end of each cycle. During operation, a low energy output is provided constantly by power source 20 for the operation of motor 121. Constant low energy input is supplied by motor 121 to rotate disk 128 via worm shaft 122 and speed reducing gear wheels 124 and 126, coupled to shaft 122. Rotation of disk 128 coupled to springs 108 via pushing rods 106 provide a steady spring compression as bearing 109 traverses the outer perimeter of disk 128. Energy accumulates in springs 108 in a constant manner until bearings 109 reach cusps 129 when cusps 129 drop from largest diameter to smallest diameter of disk 128 thus allowing pushing rods to quickly slide towards center of disk 128 releasing the energy stored in springs 108 compressing belt 1. It will be easily perceived by persons skilled in the art that this operation is energetically efficient. Furthermore, operating motor 10 at a constant power can be disadvantageous when used with the present invention due to the fact that the force required to compress springs 108 escalates during compression. In order to further enhance the energetic efficiency of the device, the device may be provided with an electric control unit for controlling the voltage applied to the motor for modulating the motor output to match the changing requirements of the system, thus optimizing the motor efficiency. The control unit can be programmed in advance knowing the system requirements during the cyclic course or can operate in accordance with a feedback fed by the motor itself or by another component of the system.

Figure 29A:
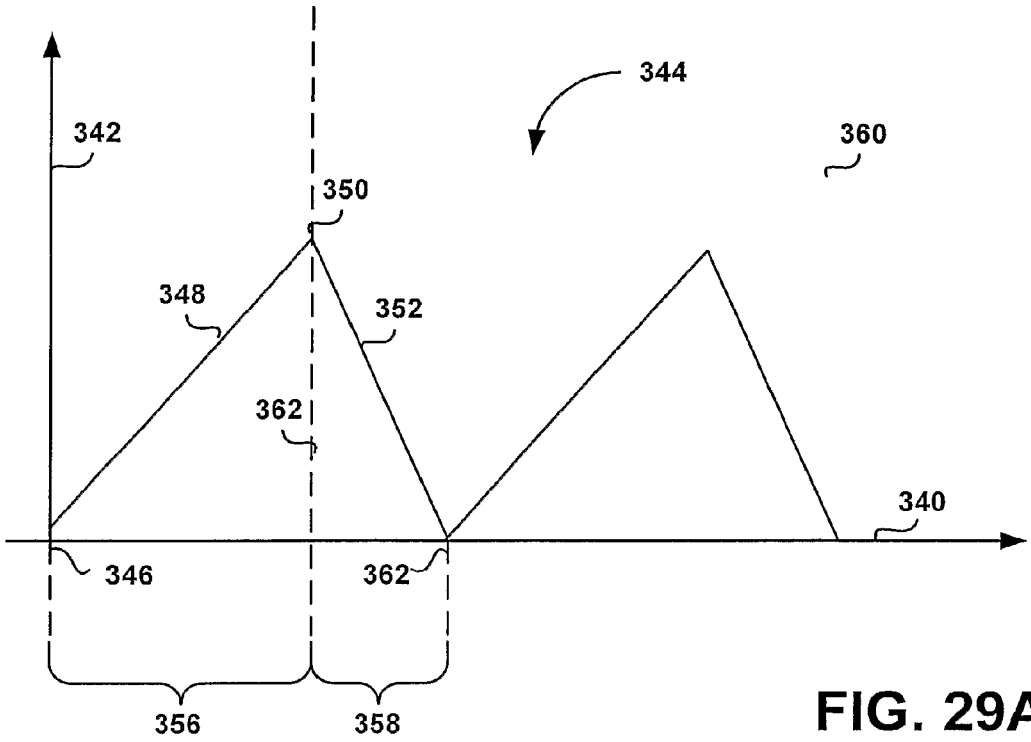
FIGS. 29A, 29B and 29C are examples of energetic patterns of the apparatus and method of the present invention.
Figure 29B:
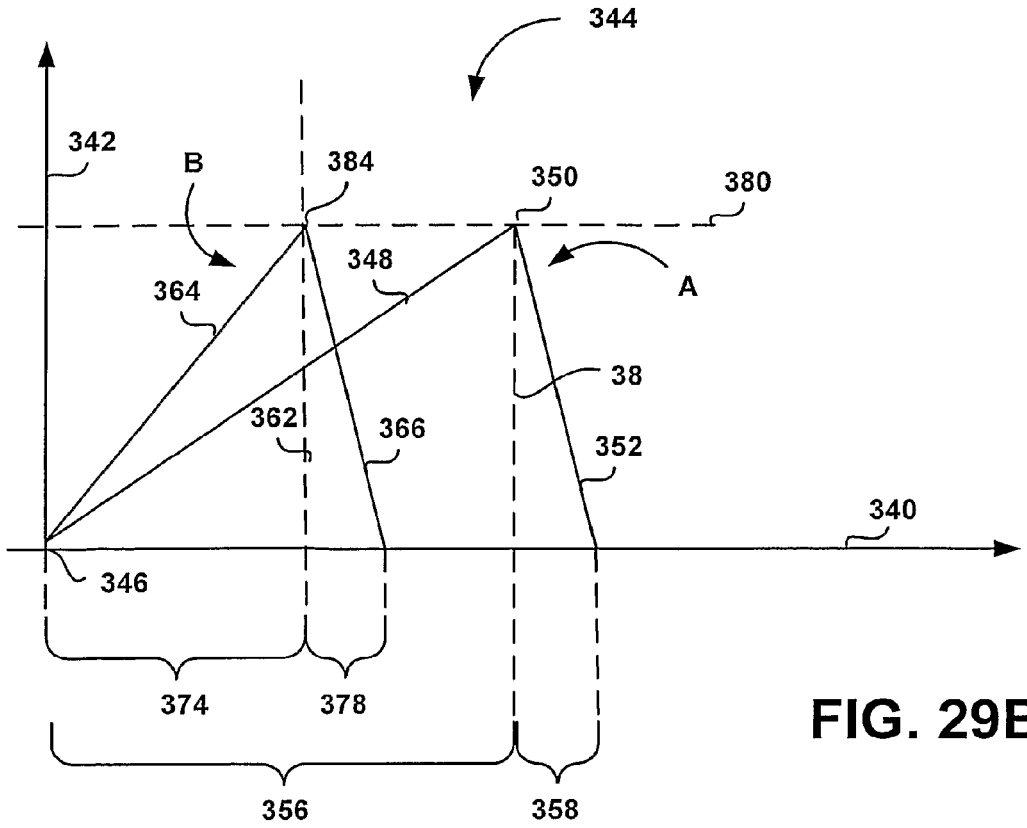
Figure 29C:
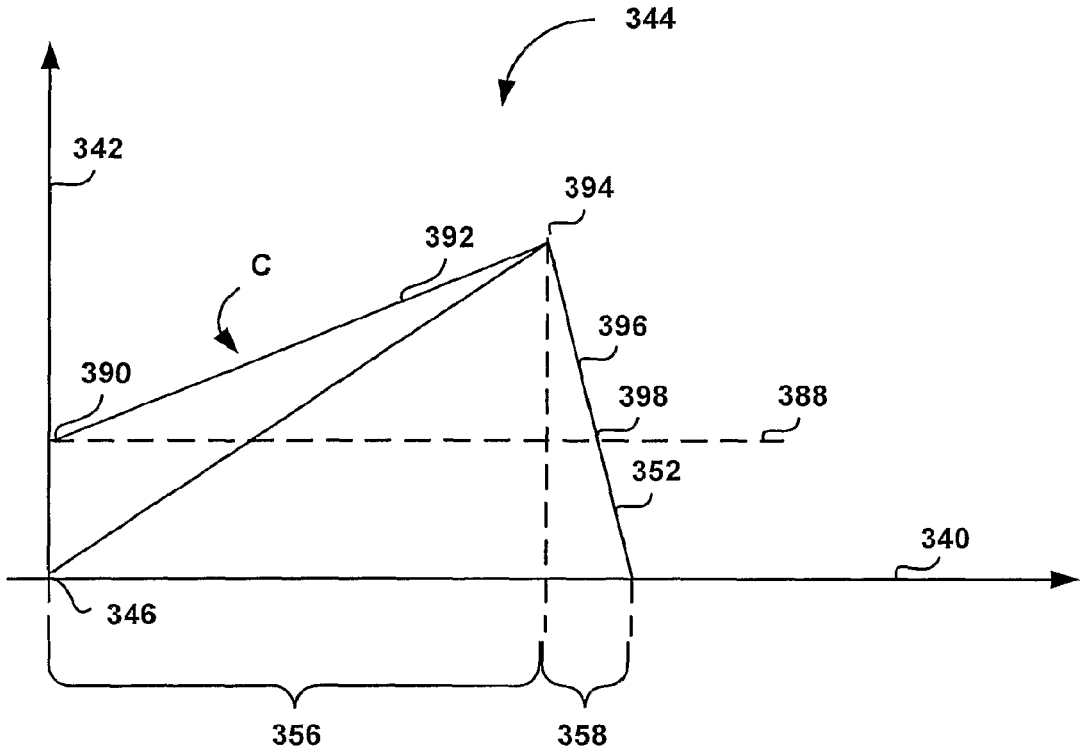

FIG. 29A illustrates one energetic model of the present invention, more specifically a spring energy content graph. The energetic model described hereforth and in FIG. 29A through 29C is a pictorial description of the energy content change in springs 108 of FIG. 6 during periodical operation of the present invention also of FIG. 6 as well as in other figures illustrating the inner machinery of the present invention. Relevant parts described hereforth refer to same parts of the present invention described in FIG. 6. FIG. 29A is a graph describing the energy content of springs 108 versus time during a periodical operation of the present invention. Abscissa 340 depicts a linear flow of time such as in seconds. Other scales can be used such as milliseconds, minutes and the like. Ordinate 342 describes energy content in joules. It should be obvious that Ordinate 342 can describe other elements describing products of energy such as work, pressure, spring length etc. Abscissa 340 and ordinate 342 intersect at point 344 where point 344 is an arbitrary point in time where the energy content of springs 108 is zero and where this point of time is arbitrarily depicted as time of one periodical cycle of operation of the present invention. This point also denotes the time when energy flow through the present invention begins to accumulate via the internal operation of the present invention as further illustrated hereforth.

The energy content of springs 108 is now described in conjunction with a partial description of the operation of the present invention with reference to FIG. 6. At point 344 horizontal rods 106 and their corresponding bearings 109 are situated in close proximity of cusps 129 base. At this point springs 108 are in relaxed state where no tension is present on said springs and where the length of said springs is the spring's natural length at zero energy state. As motor 121 is set in motion, constant low energy is produced. This energy transferred constantly through worm shaft 122 as well as speed reducing gear comprising wheels 124 and 126 to a inconstant radius disk 128. Disk 128 is torque to revolve around its axis at a constant speed determined by motor 121 speed output and also determined by shape and size of worm shaft 122 as well as speed reducing gears 124 and 126. As Disk 128 start spinning horizontal rods 106 with their terminal bearings 109 found in constant contact with disk 128 surface starts sliding along disk 128 perimeter. Disk 128 has an inconstant radius such that at each cusp base the smallest diameter exists and at each cusp peak the largest diameter exists. Horizontal rods 106 slide along perimeter of disk 128 from the smallest diameter to the largest one. Such rotational movement of disk 128 imparts linear motion to said horizontal rods 106 pushing them towards side compartments 110 and 140 as diameter of disk 128 increases. Rods 106 via plates 107 which is horizontal to said rods press springs 108 during said motion. As springs 108 shorten, kinetic energy is transferred into spring potential energy. This process of increasing spring potential energy is illustrated in FIG. 29A as line 348. Spring potential energy 348 is accumulated as rods 106 move linearly in the direction side compartment 110 and 140. When rods 106 reach the largest diameter of disk 128 at the peak of cusps 129 springs 108 are at its maximal compression and minimal length. The potential energy stored there at this point of time 362 is maximal and is represented by point 350 on FIG. 29A. The length of time from point 346 to point 350 or the length of time from fully relaxed spring state to fully compressed spring state of springs 108 denoted as time interval 356 in FIG. 29. A typically takes 5 seconds but can be in the range of 0.5 to 50 seconds. At this point in time of the operation of the present invention rods 106 momentarily loss contact with perimeter of disk 128 and briskly move from cusps 129 peak to cusps 129 base towards the center of disk 128. Rapid movement of rods 106 away from springs 108 release compression of plates 107 on springs 108. Springs 108 then return to their natural relaxed state rapidly while releasing their potential spring energy quickly. Peppy energy release 352 of springs 108 is described by line 352 in FIG. 29A. The Potential spring energy is released while spring 108 is lengthening. This produces rapid work utilized for pulling straps 1 towards the center of disk 128 thus enabling the squeezing force of strap 1 on the limb to which the present invention is attached. The peppy energy release time 358 length is typically 0.2 seconds but can be in the range of 0.05 seconds to 0.5 seconds. Disk 128 continues to revolve around its axis continuously, thus starting another cycle of spring contraction-relaxation. This is denoted by another energy pattern 360. It can be clear to the person skilled in the art that energetic patterns illustrated in FIG. 29A can be changed by changing disk 128 diameter, changing disk 128 revolving speed as well as by adding other elements to the internal machinery which may influence the speed and rate of rods 106 motion through each cycle.

FIG. 29B exemplify the effect of speed change of disk 128 on the energy content graph previously illustrated in FIG. 29A and where like numbers represent like parts. The energy content graph of springs 108 as discussed in FIG. 29A is presented in FIG. 29B where the time interval from spring energy content zero to maximum is represented by the interval 356 and where the peak energy content level of springs 108 is represented by point 350. When spinning speed of disk 128 is increased to twice disk speed discussed in FIG. 29A, represented by graph A, a new spring energy content graph B is created. In this case spring potential energy 348 is accumulated twice the rate as discussed in FIG. 29A and is illustrated by line 364. The maximal energy content 384 of springs 108 is also reached faster. Time interval 374 representing the new time interval from fully relaxed to fully contracted springs 108 also shortens by half, thus time interval 374 is half that of time interval 356. Thus in a different operation mode or in same apparatus having modified internal machinery (not shown) capable of spinning disk 128 faster energy is accumulated within springs 108 faster thus allowing for rapid cycling of the present invention operation. Peppy energy release time 378 is same as peppy energy release time 358 as springs 108 are unchanged and peppy release time 358 and 378 is a function of internal spring properties. It should be clear to the person skilled in the art that different springs with different spring constant (K) can be used as well as internal machinery that regulates springs 108 release time such that peppy energy release time 358 and 378 can be modified thus further modifying the spring energy content graphs. It is clear to the person skilled in the art that a similar but unlike energy content graph (not shown) can be generated by slowing disk 128 spinning speed.

FIG. 29C illustrates yet other spring energy content graphs. Graph A is similar to graph A of FIG. 29B. Two spring energy content graphs are illustrated; spring energy content graphs A which is identical to spring energy content graphs A of FIG. 29A and represent spring energy content related to internal machinery illustrated in FIG. 6 as well as a novel spring energy content graphs C which represent yet another internal machinery characteristics of the present invention discussed hereforth verbally. Spring energy content graph C starts at point 390 on line 388. At this point springs 108 are not fully relaxed where their energy content at the beginning of each operation cycle is not zero. This means that some mechanical or other element such as a stopper (not shown in FIG. 6) is preventing springs 108 from stretching to their fully relaxed state. Spring potential energy accumulation 392 is represented in FIG. 29C by a non linear line starting at point 390 and ending in point 394. The non linearity of line 392 represents a non-linear diameter change of disk (not shown in FIG. 6). Such non-linear diameter disk can alter the operational mode of the present apparatus to suit the specific need of each person using the device. Other elements within the internal machinery of the present invention may also contribute to the creation of such spring potential energy accumulation 392 such as having rod 106 being of an elastic material, having rods 106 being assembled from two stiff rods interspersed by a spring and the like. It is clear from the illustration that peak spring energy of both springs Peppy energy release 396 is similar in slope to peppy energy release 352 indicating springs of same internal constant. Peppy energy release 396 however ends in point 398 where not all the potential energy stored within springs 108 is released as work. This may be achieved by having a stopper (not shown) or other element (as illustrated hereforth in other embodiments of the present invention) with internal machinery of the present invention known in the art for achieving such result. It is clear to the person skilled in the art that only partial springs functionality is achieved with spring energy content graph C such that spring of said graph C stretch and relax at a fraction of their capability. Such a design may be advantageous for certain modes of operation of the present invention.

FIG. 29A through 29C illustrate different energy content graphs representing in actuality different stretching and relaxation times and strength of strap 1 of FIG. 2A thus attaining the purpose of suiting the present invention to aid in the flow of blood and lymph in limbs of persons using the present invention. It Each condition requires a different operational mode for best results that are achieved by using said alternate internal machinery alterations. For example, in patients with diabetes mellitus suffering from related circulation disturbances a fast release of strap 1 of FIG. 1A is advantageous for achievement of best circulation pattern. This is achieved by using disk 128 of FIG. 6 having smaller diameters thus reducing relaxation time. This can also be achieved by using different springs 108 also of FIG. 6 having properties allowing fast contraction. This relatively fast relaxation of strap 1 creates a vacuum like effect within the tissue which is optimal for blood flow enhancement in said patients. It is obvious that pressure gradients and flow volume within vessels of person using the present invention are different from ones generated by Intermittent Pneumatic Contraction (IPC) devices used for the same purpose due to the different machinery and material used. It is also obvious to the person skilled in the art that changing parameters of stretch and relaxation patterns as well as energetic patterns stemming from the material and parameters change stated above is relatively easily achieved and performed.

The present device also uses the human tissue (leg matrix) of the user of the present invention as a recoil spring. During the fast squeeze of the human tissue of the user of the present invention some potential energy is stored in tensile elements of the tissue. When relaxation period arrives this kinetic energy is transferred via relaxing tissue to the relaxing strap 1 and thereby aiding indirectly the action of motor 121 of FIG. 6. This allows the usage of smaller and less powerful motor for the achievement of the same results. In the examples discussed above it can be seen that the present invention is also very efficient apparatus for the purpose of blood flow and lymph flow enhancement.

Furthermore, operating a motor at a constant power can be disadvantageous when used with the present invention due to the fact that the force required to compress a spring escalates during compression. In order to further enhance the energetic efficiency of the device, the device may be provided with an electric control unit for controlling the voltage applied to the motor modulating the motor output to match the changing requirements of the system, thus optimizing the motor efficiency. The control unit may be programmed in advance, knowing the system requirements during the cyclic course, or can operate in accordance with a feedback fed by the motor itself or by another component of the system.

It will be realized that the energetic profiles shown in FIG. 29 are given as examples only and that other energetic profile are possible. For example, during operation, the spring may be limited to operate between a limited range, namely to relax only to a certain level of the maximal potential energy reached during operation, and not to zero energy. It will be also realized that the spring used is not limited to a compression springs and that other springs, for example torque spring, leaf springs etc, may be used as well as other mechanical energy storing elements.

A different embodiment of the present invention in which box assembly 2 is the active intermittent compressing part is depicted in FIG. 2B. According to this embodiment, assembly box 2 further comprises a compressing plate 3 lying substantially parallel to casing 25 at a predetermined distance from its surface. According to this embodiment, the assembly 2, more specifically said compressing plate 3 is pressed against the muscle and intermittently extend and retracts from casing 25 thus producing intermittent compression of the calf muscle. According to this embodiment strap 1 is connected to casing 2 by two fixed slited latches, such that at least one end of strap 1 is threaded through one of latches 68 and is folded onto itself to allow comfortable fitting, as described in conjunction to FIG. 2B. An on/off switch 6, a power regulator 5 and a rate regulator 7 are located at the top of the device in the same fashion as in FIG. 2B.

Figure 7:
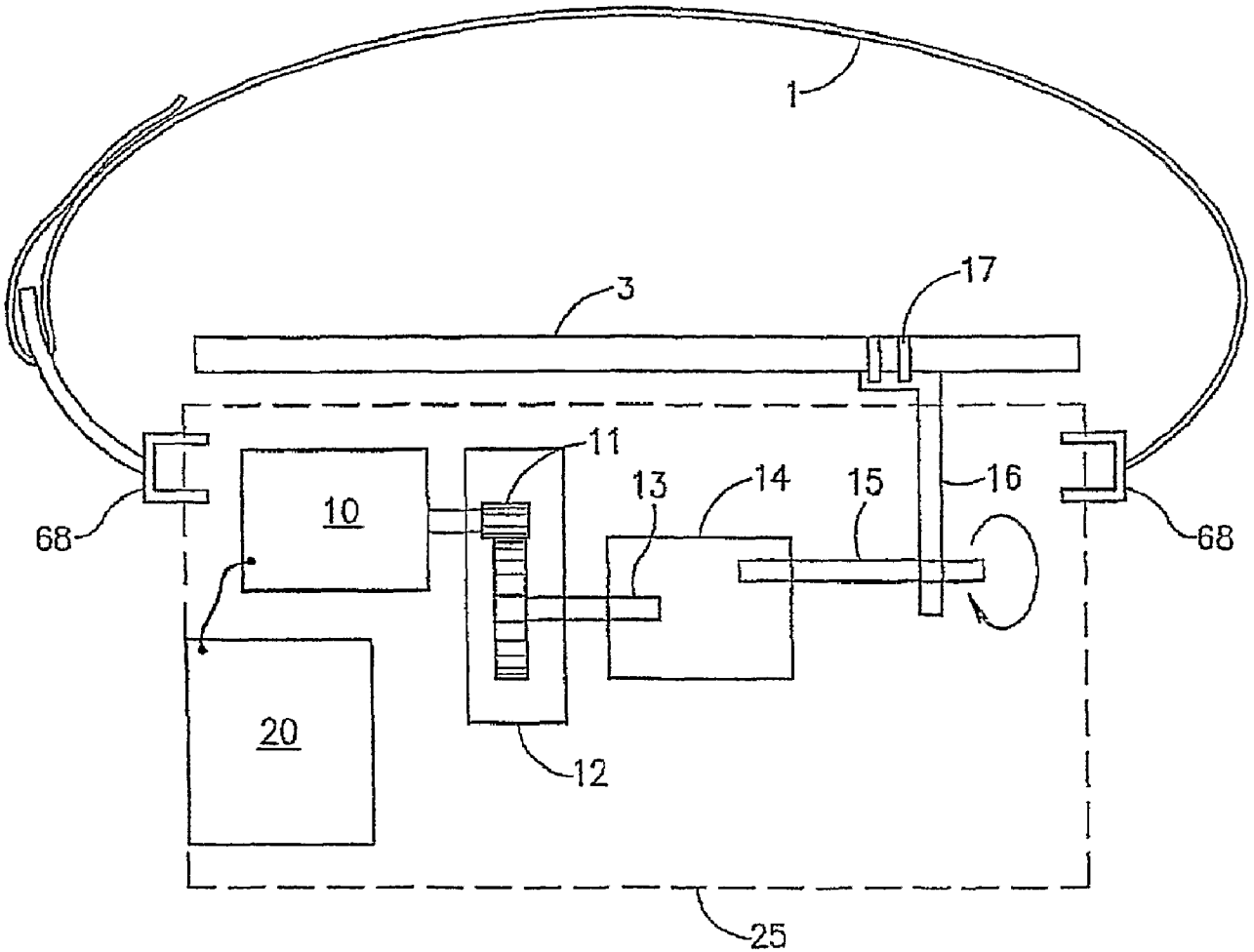
FIG. 7 is a top view of a device in accordance with the anterior box embodiment of FIG. 2B showing a the internal mechanism of the assembly box.

A top view of a machinery embodiment in accordance with the device embodiment of FIG. 2B is shown in FIG. 7. A power source 20 powers an electrical motor 10 that has a centrally located shaft 11. Said centrally located shaft 11 is coupled to a velocity reduction gear 12 which reduces the spinning velocity of the rod 11 and increases the power output. Reduction gear 12 has a centrally located rod 13 that is connected to drum 14 that has an eccentric located rod 15. The eccentric located rod 15 is connected perpendicularly to the longer arm of a motion transfer L-shaped bar 16, wherein the shorter arm of said L-shaped bar 16 is connected to compressing plate 3 by connection means 17. Connection means 17 may be for example bolts, pins, screws and the like. Electrical motor 10 converts electrical energy into kinetic energy stored in the spinning of the centrally located rod 11. The kinetic energy stored in the spinning of the said centrally located rod 11 is converted into power by the said velocity reduction gear 12. The power stored in the said centrally located rod 13 connected to the said velocity reduction gear 12 is converted to the rotation of the said drum 14 which has the said fitted eccentrically located rod 15. The circular motion of the said eccentrically located rod 15 is transferred to the extension and retraction of the said compressing plate 3 via the said motion transfer rod 16 and connection means 17. According to this arrangement, the circular motion of the eccentrically located rod 15 is transferred into periodical motion of plate 3. Said periodical motion of plate 3 is a combination of a first periodic motion in the extension-retraction direction (i.e., increasing and decreasing the distance between plate 3 and casing 25) as well as a second periodic motion which is perpendicular to said first periodic motion. (In accordance with FIG. 6, this second periodic motion is in a direction perpendicular to the drawing surface). Thus, further to the obvious effect of applying intermittent compression on the limb by the extension-retraction motion of plate 3, the present embodiment also imparts the device a "massage-like" effect, thus enhancing the squeezing efficacy. It will be easily realized by persons skilled in the art that the embodiments described in FIGS. 3-7 are only examples and that different features described separately in conjunction with a particular embodiment, can be combined in the design of a device of the present invention. For example, a retractable strap feature as illustrated in FIG. 6 can be combined with any of the other embodiments described herein before and after. Much the same, an asymmetrical component such as disk 128 of FIG. 6 can be added to any of the other embodiments for allowing a particular pattern of a contraction-relaxation cycle.

Referring now to FIG. 8, there is illustrated a further embodiment of the present invention with an enhanced contraction—relaxation internal machinery, which provides reverse propulsion mechanism. In particular, the present embodiment allows for a fast transition from relaxed to contracted state, as well as, from contracted to relaxed state. A fast transition from contracted to relaxed state, which induces sudden expansion of blood vessels, is of particular benefit in some circulation disorders, such as for example those resulting from diabetes mellitus, congestive heart disease and the like. Furthermore, the present embodiment is highly efficient in terms of power consumption as it utilizes a relatively low power motor to charge potential energy into springs for enabling fast high power transitions.

Figure 8A:
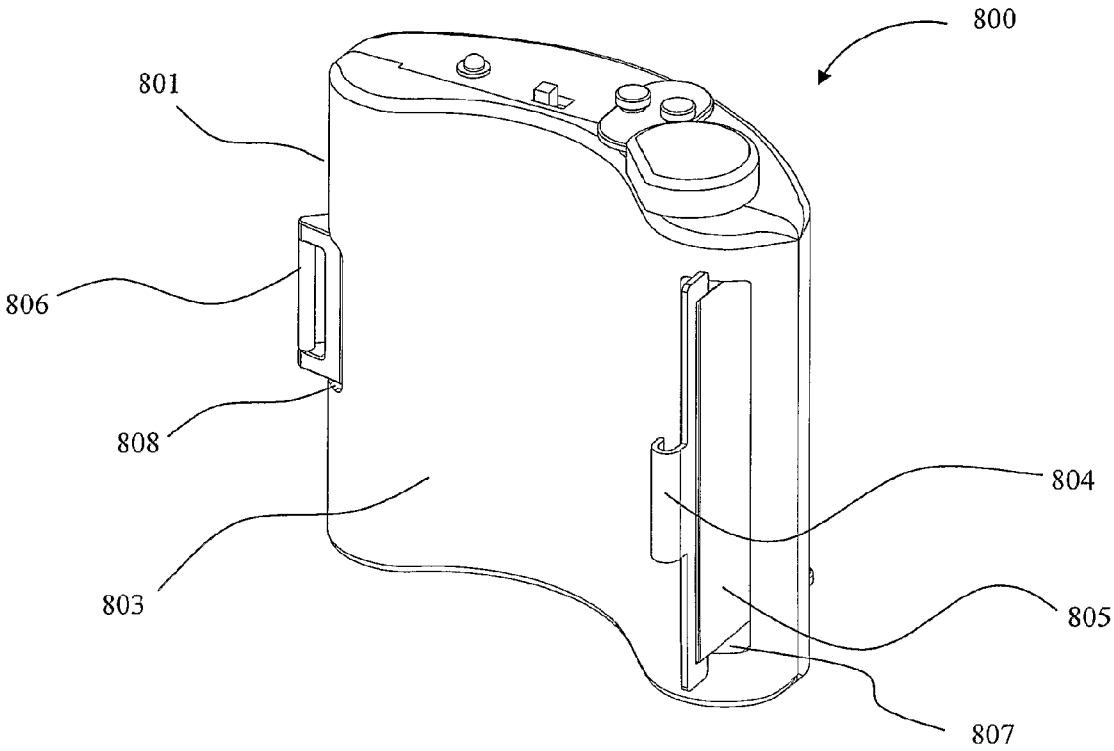
FIGS. 8A and 8B are rear and frontal perspective views, respectively, of a device in accordance with the reverse propulsion embodiment.
Figure 8B:
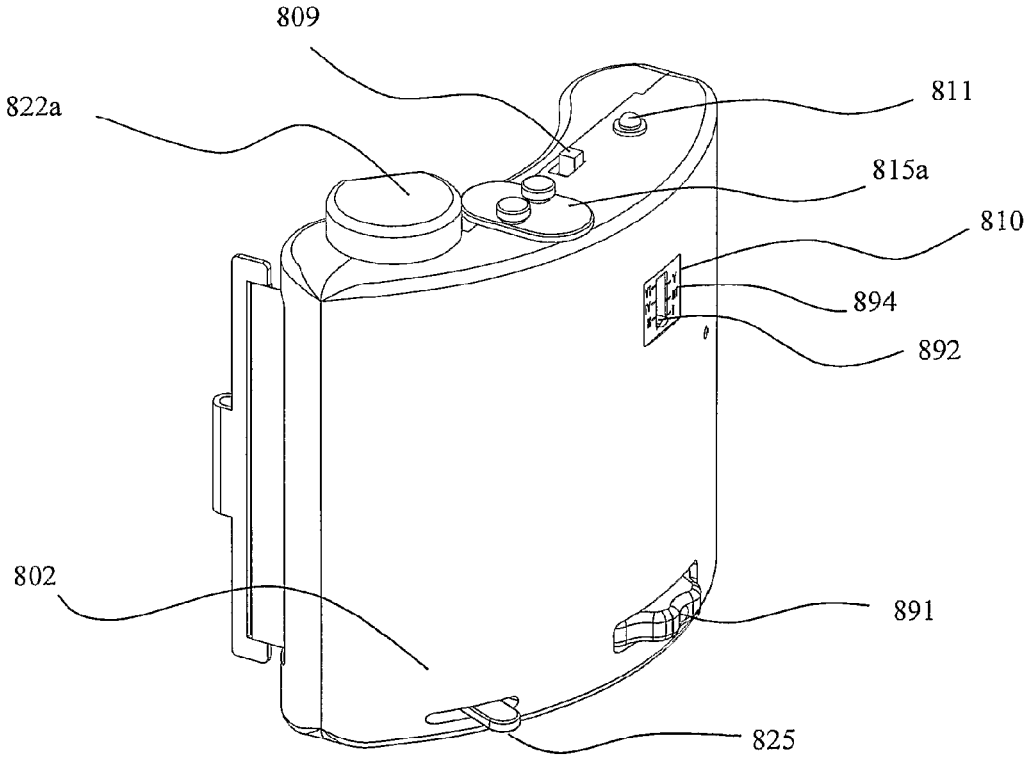
Figure 8C:
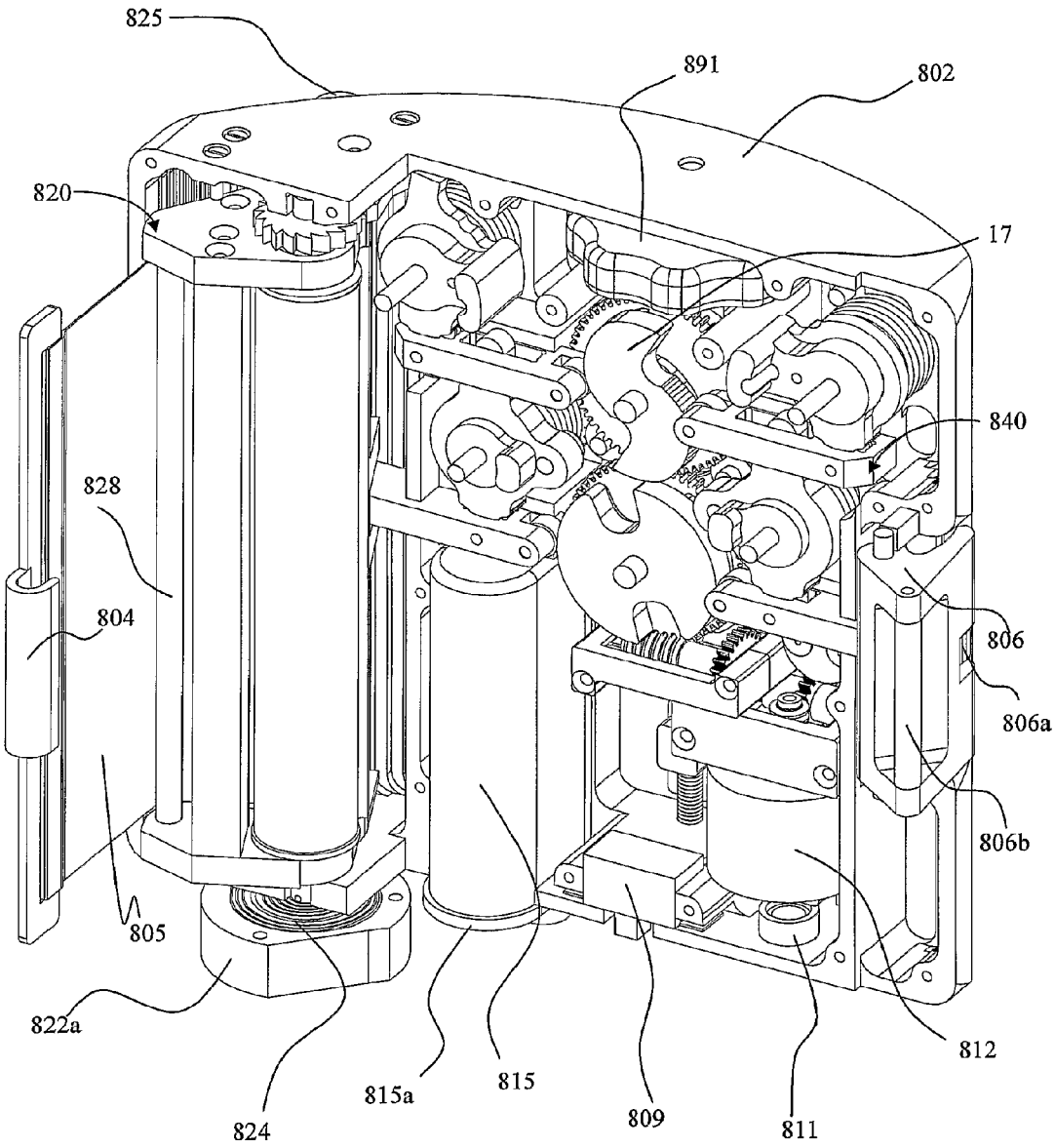
FIG. 8C is a rear perspective view of the reverse propulsion embodiment of FIGS. 8A and 8B in an upside down position with back cover removed to show internal components in loose strap state.
Figure 8D:
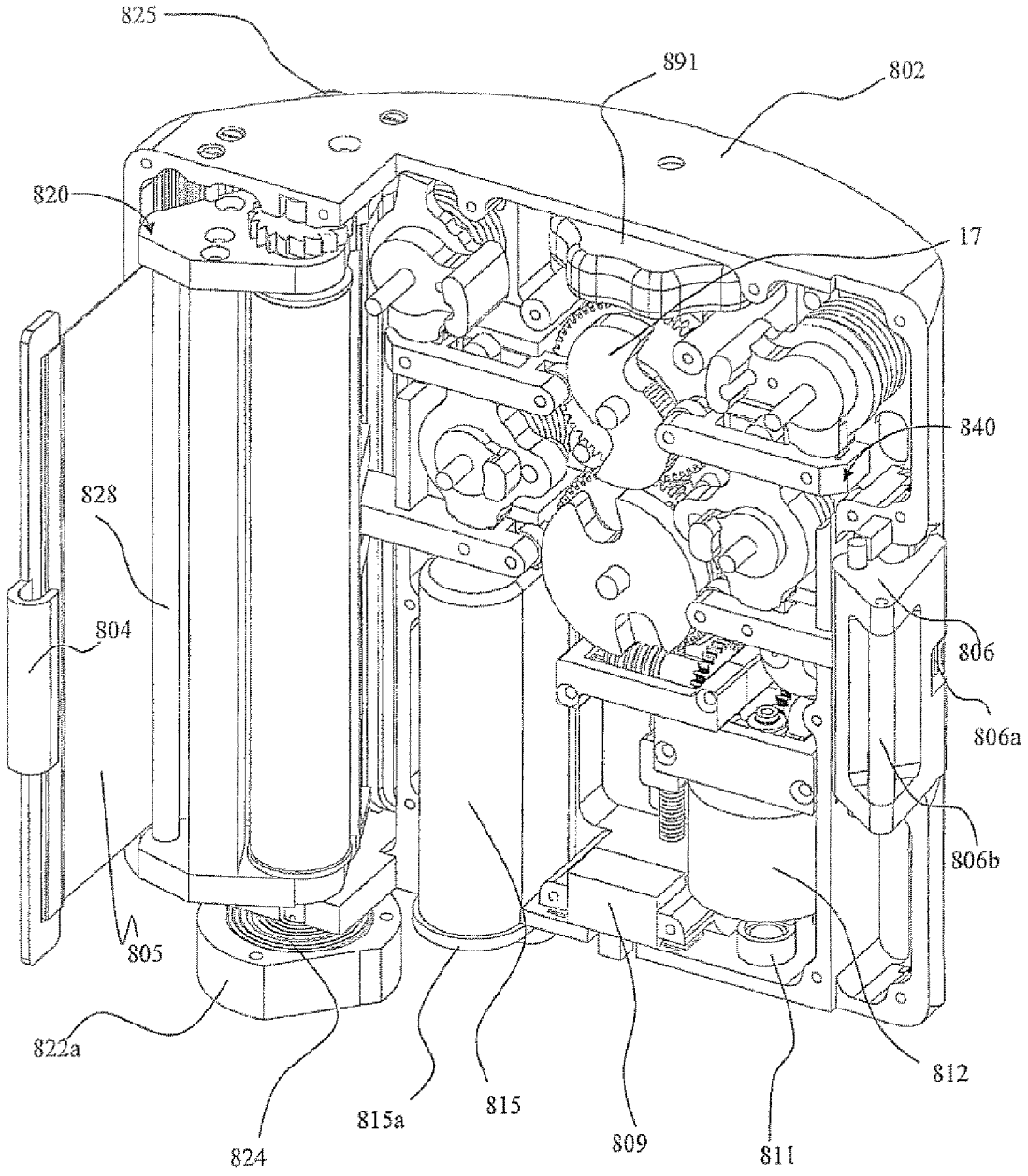
FIG. 8D is a rear perspective view of reverse propulsion embodiment as in FIG. 8C with both frontal and back covers removed, showing internal components in contracted state.
Figure 8E:
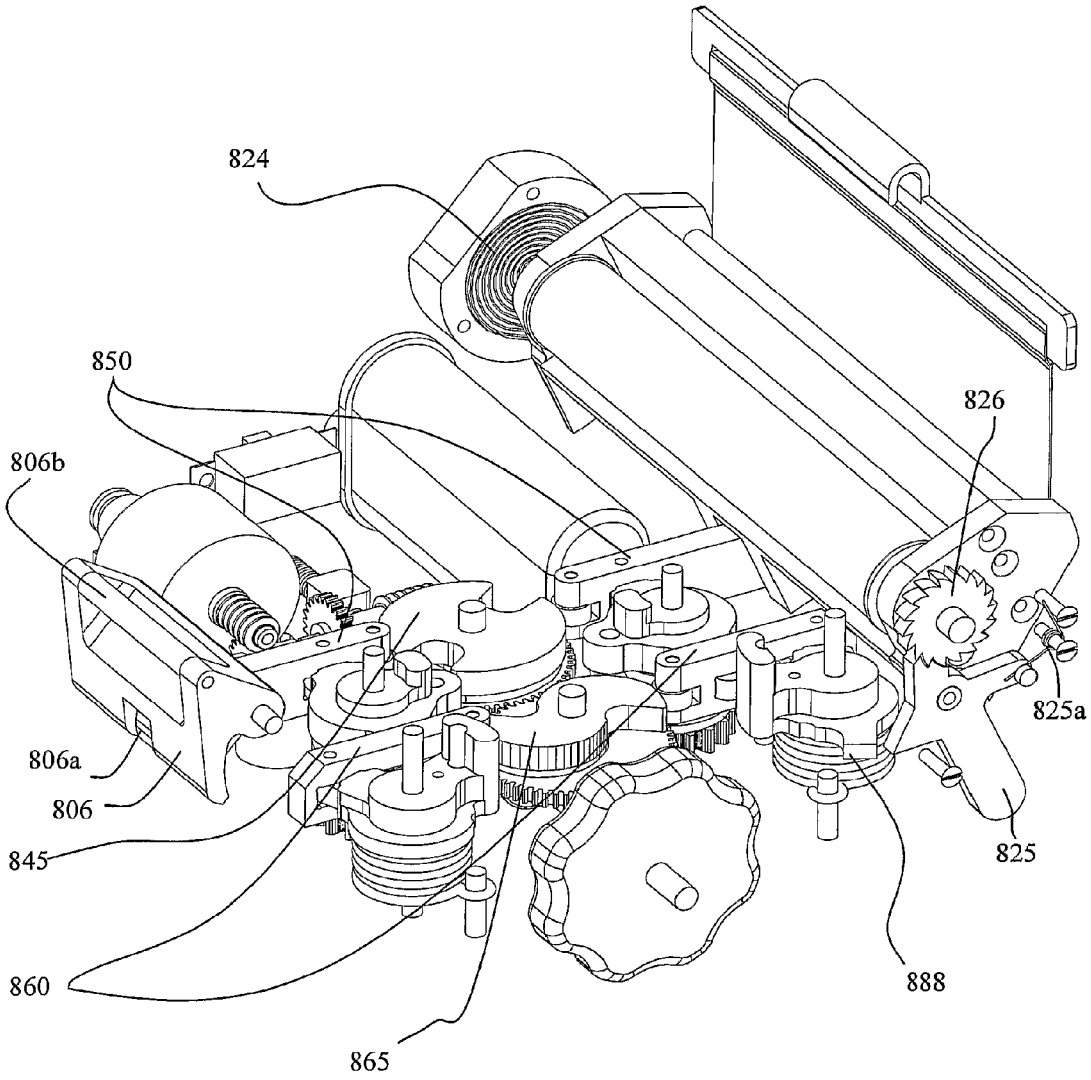
FIGS. 8E and 8F and are a rear and frontal perspective views, respectively, of the reverse propulsion embodiment in horizontal position with both covers removed.
Figure 8F:
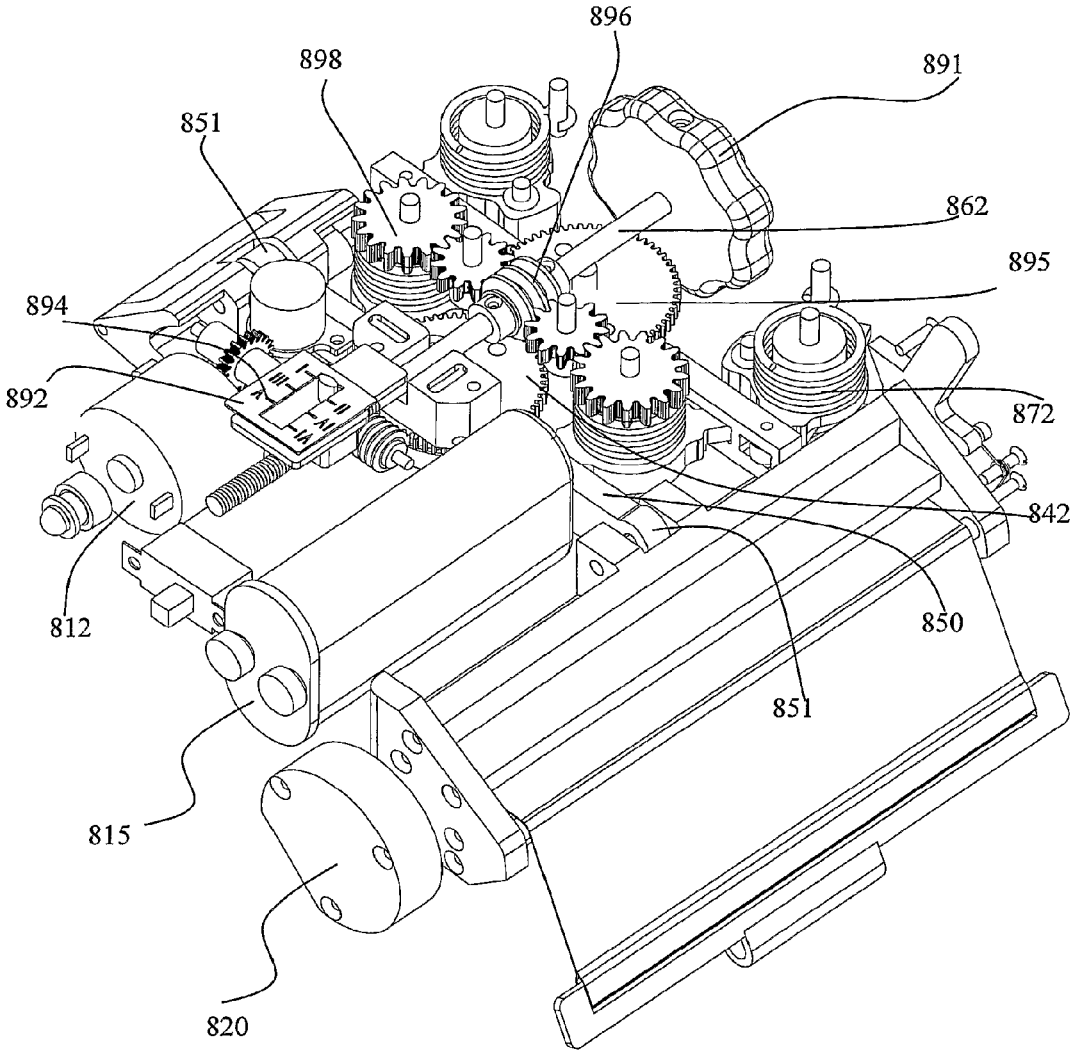

FIGS. 8A and 8B are perspective rear and frontal views, respectively, of the reverse propulsion device, generally designated 800. Device 800 is a flask-like casing box 801, similar in shape to casing 25 of FIG. 2A, comprising a frontal cover 802 and a back cover 803. Device 800 can be housed in various shape casings. A strap 805 retractably wound about strap roller 822 encased inside the box (as best seen in FIG. 8C) and terminating with a strap hook 804, is drawn through opening 807 to be engaged with rotating buckle 806, protruding from opening 808, for encircling the user limb (not shown). A strap roller unlock latch 825 extending from frontal cover 802 allows the user to pull the strap before use in order to put the device on the limb and to disconnect the device after use. During operation, roller strap 825 is locked automatically before transition from relaxed to contracted state and is unlocked automatically after transition from contracted to relaxed state, as will explained below. A spring force adjustor wheel 891, coupled to force adjusting mechanism 890 (shown in detail in FIG. 8F) allows for adjusting the force applied on the limb in accordance with the user needs prior to operation. The value of the force is indicated by a pointer 892 on force scale 894 through transparent window 810. Also shown on the top of casing 801 are strap roller cover 822*a*, battery cover 815*a*, an on/off switch 809 and a LED indicator 811 for indicating low battery power.

An overall view of the internal components of device 800 is given at different perspective views in FIG. 8C through 8F. Throughout FIGS. 8A to 8H like numerals refer to like elements.

Deice 800 is driven by motor 812 powered via on/off switch 809 by batteries accommodated in battery compartment 815. Preferably the motor 812 is a small light weight motor powered by one or more AA batteries of 1.2-1.5V. During operation motor 812 operates continuously. The rotational motion of motor worm shaft 813 is transferred via transmission gear comprising a first and second speed reducing gears 814 and 816 to gear 842 of the reverse propulsion assembly, generally designated 840, via worm 817 of gear 816 (best seen in FIG. 8E). The reverse repulsion mechanism 840 is responsible for the contraction-relaxation cycle of strap 805 by intermittently pulling linear arms 850 toward and away from each other, thereby rotating buckle 806 and strap roller arm 830 around axes 806*a* and 835 respectively, to increase the tension of strap 805 when arms 850 are pulled inwardly and to release the tension when the arms are pulled outwardly. The internal components of device 800 also include strap roller assembly 820 and force adjustment assembly 890. For clarity sake, the following description will be divided into separate descriptions of the roller strap assembly 820, the reverse propulsion mechanism assembly 840 and the force adjustment assembly 890. However, it should be understood that the division is artificial as the different assemblies are coupled to each other and share common elements. Roller assembly 820 includes a strap roller 822 mounted within strap roller arm 830 and a roller lock/unlock latch 825. Strap roll 822 is having a central axis 835 rotatably mounted between two horizontal plates 832*a* and 832*b* of roller arm 830 and extending there from. One end of axis 835 is connected to winding spiral spring 824 for providing a retracting force on strap 805. The retracting force on strap 805 can be chosen to provide a constant low pressure on the limb during the relaxation phase. This low pressure, referred to as 'pretension' is preferably in the range of 5-15 mmHg. The other end of axis 835 is provided with ratchet wheel 826 fixedly mounted thereon. Lock/unlock latch 825, biased by spring 825*a* toward ratchet wheel 826, is configured to engage with ratchet wheel 826 for preventing free rotation of axis 835 when engaged, as can be best seen in FIG. 8E, hence disabling spring 824 and preventing strap 805 from rolling/unrolling about roller 822. Thus, when as latch 825 and ratchet 826 are engaged, the total available length of strap 805 is maintained constant. Roller arm 830 further comprises a fixed rod 828, extending between the outward corners of plates 830*a* and

830*b*, around which strap 805 is passed. Roller arm 830 is rotatably mounted around axis 835 and is pivotally connected to linear arm 850 by hinge 851 provided at the distal end of arm 850 (best seen in FIG. 8F). It can be seen that when roller arm 830 is pulled inwardly by arm 850, arm 830 rotates clockwise (CW) around axis 835 to move rod 828 toward the front cover 802 and away from the limb. It can be also seen that rod 806*b* undergoes a similar movement (but in a mirror image fashion) when rotating buckle 806, rotatably mounted around axis 806*a* and pivotally connected by means of hinge 851 to corresponding arm 850, is pulled inwardly. Thus, pulling arms 850 inwardly, result in increasing tension in the strap. If at this time, latch 825 and 826 are engaged, to maintain the available length of the strap constant, the tension in the strap cannot be released and the effective length of the strap shortens. The positional shift of roller arm 830 and buckle 806 between loose to contracted strap states can be best understood by comparing FIG. 8C (loose state) and 8D (contracted state). Strap roller assembly 820 is coupled to reverse propulsion mechanism 840 not only by linear arm 950 but also by means of wing 888 which disengages latch 825 from ratchet wheel 826 during relaxation phase, as will be explained below, to allow continuous adjustment of strap 805 length to the user limb. The continuous adjustment of the strap allows for continuous operation of the device for prolong time period with no need to stop operation to readjust the strap.

Figure 8G:
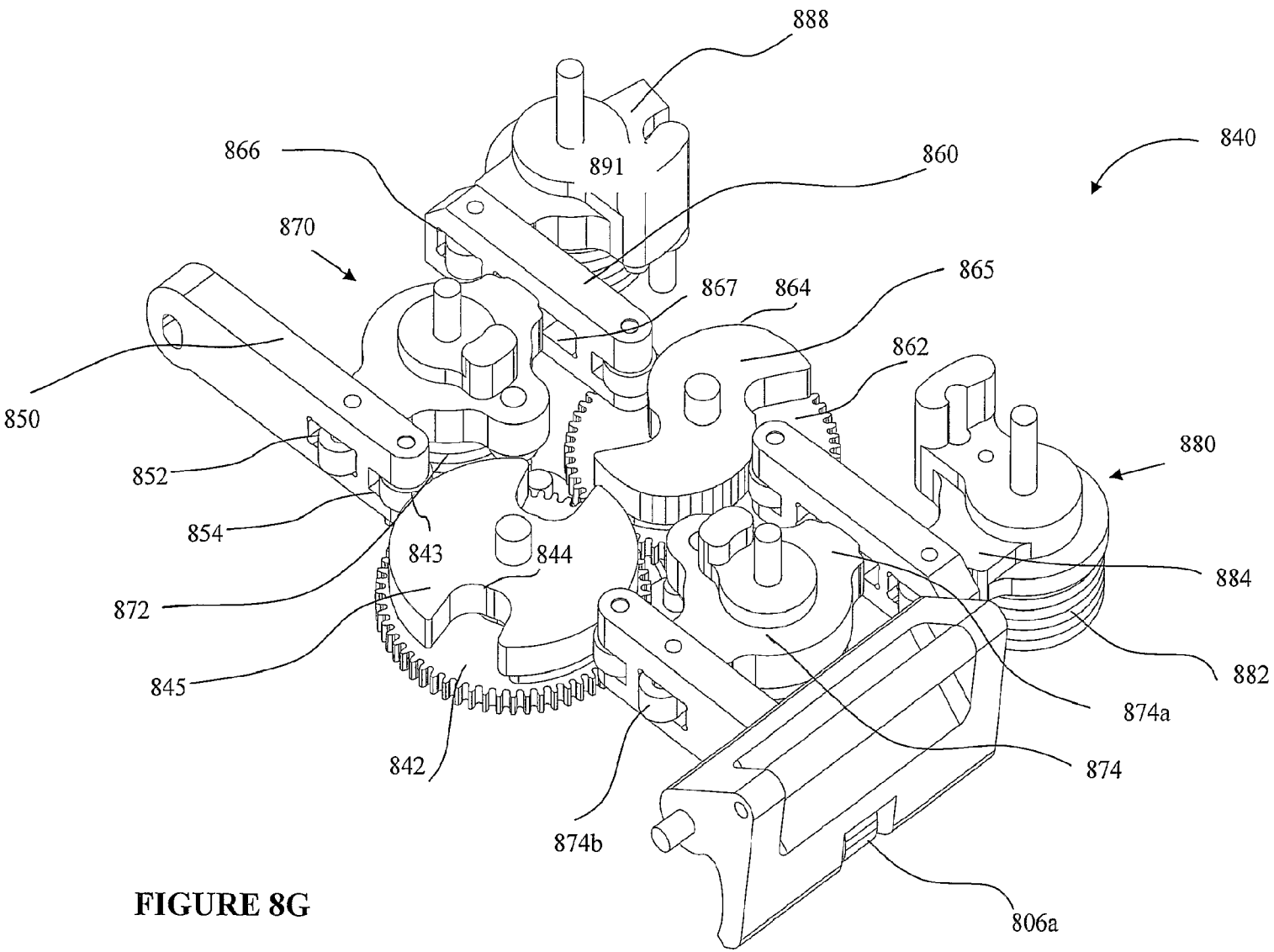
FIG. 8G is a perspective view of the main mechanism, referred to as a reverse propulsion mechanism, responsible for actuating transitions between relaxed and contracted states of the strap.
Figure 8H:
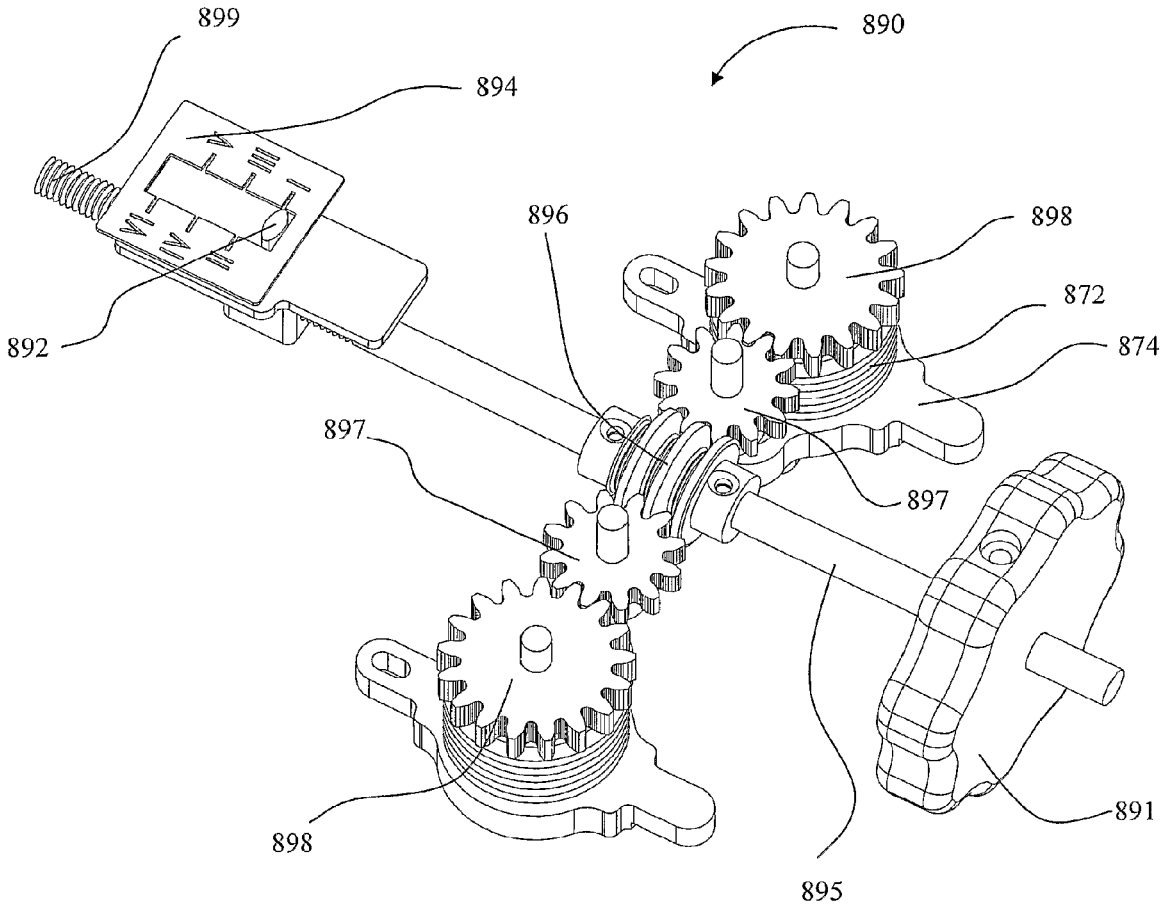
FIG. 8H is a perspective view of the force adjustment mechanism of the reverse propulsion embodiment.

Turning now to FIG. 8G, Reverse propulsion mechanism assembly 840 is continuously driven by motor 812 by means of gear 842, meshed with worm gear 817, as explained above. Assembly 840 includes a strap contraction timing disk 845 concentrically mounted on gear 842 interposed between two contracting arms 850 and a strap release S-shaped disk 865 fixedly mounted on gear 862 interposed between two releasing arms 860. Gears 842 and 846 are meshed with each other resulting in opposite rotation of disk 845 and 865. Disk 845 perimeter consists of two arcs 843 of constant radius interrupted by two opposite recesses 844 of smaller radius. S-shaped disk 865 is shaped to have two arcs 864 of increasing radius ending by a cusp where the radius abruptly changes from maximum to minimum. Assembly 840 further comprises two sets of spring assemblies, contraction spring assemblies 870 and release spring assemblies 880. Contraction spring assembly 870 includes a spring 872 and a rotating timing arm 874, having a distal end 874*a* and a proximal end 874*b*, mounted thereon. Release spring assembly 880 includes a spring 882 and a rotatable arm 964 mounted thereon. Spring assembly 880 proximal to roller assembly 820 is further provided with wing 888 for allowing pushing latch 825 away from ratchet wheel 826 during relaxation phase for unlocking axis 835. The springs and arms are configured such that clockwise rotation of the arms of the spring assemblies on the left side of FIG. 8G and counterclockwise rotation of the arms on the right side of FIG. 8G load the corresponding springs. Contracting arms 850 are each having an aperture 852 for receiving the proximal end 874*b* of timing arm 874 of contracting spring assembly 870 and are each provided with bearing 854 at the inner end for allowing the arms to slide along the perimeter of disk 845. It can be easily seen that as long as arms 850 are in contact with arcs 843 of disk 845 the strap is in relaxed position and that when the arms are moving into recesses 844, the strap is in the contracted position. Releasing arms 860 are each having a back aperture 866 for receiving rotating arm 884 of release spring assembly 880 and a middle wider aperture 867 for receiving the distal end 874*a* of timing arms 874 of contracting spring assembly 870, such that timing arms 874 couple between release arm 860 and contraction arms 850. The inner ends of arms 860 are provided with bearing 868 for allowing sliding along the perimeter of disk 865. Strap contraction springs 872 are biased to push arms 850 via arm 874 toward contraction timing disk 845. Release springs 882 are biased to push release arms 860 via arm 884 inwardly such that bearings 868 are constantly pressed against S-shaped disk 865 following the disk contour. Springs 872 and 882 are selected such that the torque of spring 882 is always higher that of spring 872 so that during all stages of operation, the force exerted on arm 850 by spring 882 (via arms 884 and 874) overcomes the opposite force exerted on the arm by spring 872. This force relation between the springs combined with the positional relation between disks 845 and 865 as they revolve around their centers allow for fast extraction of arms 850 from recesses 844, as will explained in more detail below.

Turning now to the action description of the present embodiment, it will be easily realized by the person skilled in the art that both sides of the present invention work in unity and thus should be viewed. It will be also understood that although the following description is given in a serial fashion, some of the actions described hereforth occur simultaneously and are described in a fractionated fashion for the sake of clarity only.

During operation, gear disk 845 and 865 are continuously rotating counterclockwise and clockwise, respectively, as indicated by the arrows. As disks 845 and 865 revolve each around its center, release arms 960 follow the perimeter of S-shaped disk 865 while contraction arms 850 follow the perimeter of disk 845. Disks 845 and 865 are configured such that as arms 860 follow increasing-radius arcs 884 of disk 865, arms 850 are in contact with constant-radius arcs 843 of disk 845. Thus, as long as recesses 844 are not directed toward arms 850, arms 850 slide against disk 845 and the strap is in the relaxed state while at the same time arms 860 are pushed outwardly by the increasing radius of disk 865 against springs 882 to load springs 882 and simultaneously to release the distal end 874*a* of arm 870 to freely move within aperture 867. Also during relaxation phase, wing 825 of left arm 880 pushes latch 825 away from ratchet wheel 826, enabling free rotation of roller 822. Thus the only strain in strap 805 during relaxation phase is due to the low force of retracting spring 824 and the available length of the strap may adjusts itself to changes in the limb circumference. However, as arms 860 are pushed outwardly, wing 888 of left arm 880 rotates inwardly away from ratchet 825 although still in contact therewith. Wing 888 is configured to lose contact with latch 810 shortly before recesses 884 arrived at a position opposite arms 850, thereby latch 825 engages ratchet wheel 826 to lock roller 822 and to maintain the available length of strap 805 constant. When recesses 844 reach a position opposite arms 850, the arms abruptly fall into the recesses due to the force exerted by spring 872 via arm 870, resulting in abrupt rotation of buckle 806 and roller arm 830 and consequently with fast contraction of the effective length of strap 805 to apply a sudden squeezing of the limb. At this point, disk 865 is positioned such that arms 860 are very close to but not yet reached the disk cusp and springs 882 are loaded close to maximum. As the disks continue to revolve around their centers, arms 860 slide beyond the cusp of disk 865 and fall inwardly due to the force exerted by spring 882. At the same time, arms 850 are abruptly extracted outwardly from recesses 844 by the sudden force exerted in the inward direction on distal end 874*a* of arm 870 which overcomes the opposite force exerted on proximal end 874*b* by spring 872, resulting in relaxation of the strap. Thus, timing arms 874 transmit the abrupt inward motion of releasing arms 860 to an abrupt outward motion of arms 850.

At this stage, as wing 888 is still turned away from latch 825, latch 825 is still engaged with wheel 826 to maintain the available length of strap 805 constant. As the disks further revolve, arms 860 are pushed outwardly by increasing-radius arcs 864 of disk 865 to release distal ends 974*a* of arms 874 such that the only force exerted on arms 850 is that of spring 872 and consequently contraction arms 850 are pushed inwardly to be brought again into contacts with arcs 843 of disk 845, wing 888 is brought into contact with latch 825 to unlock roller 822, and the cycle starts all over again.

It will be realized by persons skilled in the art that although mechanism 800 as illustrated in FIG. 8 is configured to provide fast contraction followed shortly by fast relaxation, the embodiment can be configured such as to allow time delay between relaxation and contraction. This can be achieved, for example, by enlarging recesses 844 and by coinciding the cusps of disks 865 to arrive opposite arms 860 shortly before arms 850 reach the recess ending. Alternatively or additionally, disk 845 can be mounted on gear 842 in a way which allows a limited relative rotation between disk and gear, for example by mounting disk 845 in arched grooves engraved in upper surface of gear 842. This will allow for disk 845 to remain locked by arms 850 while disk 842 keeps rotating, until by appropriate selection of disk 865, arms 850 are extracted from recesses 814 to allow further rotation of disk 812. A limited relative rotation between disk 845 and gear 843 also allows for recoil of disk 845 when arms 850 fall into recesses 844, facilitation smooth transition by avoiding mechanical stress.

From the above description it should be realized that the squeezing force applied to the limb is directly proportional to the potential energy of springs 872 right before arms 950 fall into recesses 844 which in turn is determined by the initial energy of the spring. Force adjusting assembly 890, shown in detail in FIG. 8F, allows for adjusting the force of springs 872 by winding the springs by means of tooth wheels 898 connected to the second end of spring 872 wherein the first end is connected to arm 970. Assembly 890 comprises an axis 895 provided at one end with wheel 891 protruding from frontal cover 802, having a concentrically worm gear 896 mounted thereon and ending with worm 999. Wheels 898 are coupled to worm gear 896 by means connecting tooth wheels 897 such that turning wheel 891 in one direction winds springs 872 to increase the spring force while turning the wheel in the opposite direction will decrease the spring force. The force of spring 972 is indicated by movable pointer 892 mounted on worm 899 to move along the worm upon turning of axis 895, through scale 894 fixedly mounted to axis 894. The adjustment of the force by wheel 891 is performed by the user prior to operation of the device. Typically, the force of spring 972 varies in the range of 2 to 10 Kg, for applying a pressure in the range of 30-90 mmHg. It will be realized that different users requires different force to obtain the same pressure since the pressure applies on the limb depends on the area of the strap encircling the limb which in turn is determined by the circumference of the limb at the locale where the device is applied. Thus, users having larger limb circumference will need the device to operate at higher force than those having smaller limbs. Furthermore, the optimal pressure is varied from one user to another. Accordingly, device 900 may be provided with a correlation table giving correlation ratios between the force read in scale 894 and the pressure obtained as function of the limb circumference.

For complete understanding of the operation of the present embodiment it must be clear to the viewer the two sets of spring assemblies, namely contraction spring assembly 870 and release spring assembly 880, provide forces that allow fast contraction as well as fast relaxation of strap 805. In this respect, it is important to note that in persons having certain medical conditions such as diabetes mellitus blood flow, enhanced flow is directly proportional to the relaxation time of the strap. The mechanism of the present embodiment provides for a fast relaxation of the strap, thus enhancing blood and lymph circulation in theses conditions considerably.

Turning now to FIG. 9, an alternative embodiment is described where rotational motion of coiling springs, gears and rollers results in intermittent fast transitions between relaxed and contracted states of a strap encircling a user limb. The embodiment described herein, generally designated 900, comprises an external case illustrated in FIG. 9A and internal machinery illustrated in detail in FIGS. 9B through 9F.

Figure 9A:
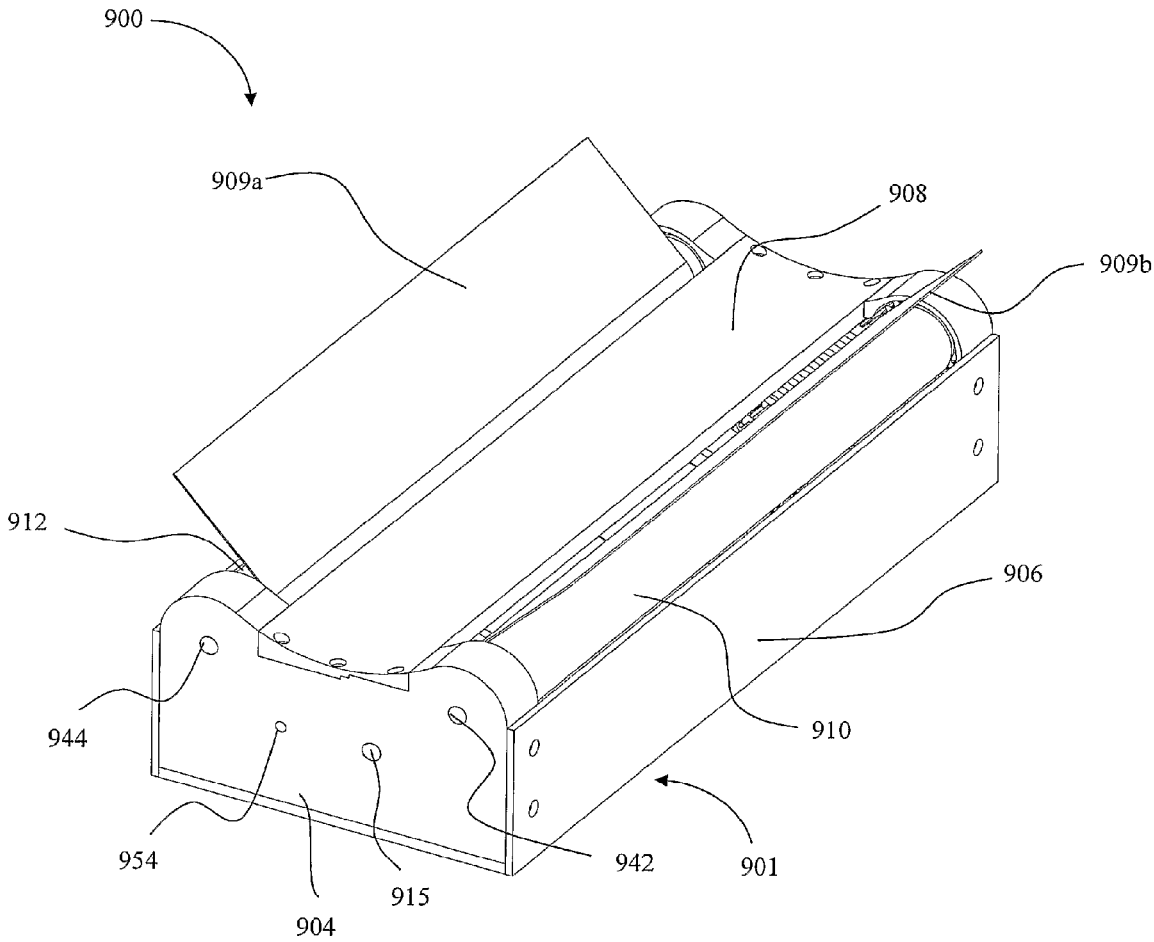
FIG. 9A is a top elevational perspective external view of the embodiment.

Referring to FIG. 9A, case 901 is a substantially elongated rectangular box made of light and strong material such as a composite metal, strong plastic and the like. Box 901 comprises a substantially rectangular flat base plate 902 on which the internal machinery is mounted and two pairs of side plates 904 and 906. Two elongated rollers, right roller 910 and left roller 912 are rotatably mounted around axes 942 and 944, respectively, extending the length of the box between opposite plates 904. Two straps 909*a* and 909*b* wrapped around rollers 910 and 912, respectively, are connected to each other to form a closed loop around the user limb such that when the rollers spin in opposite directions the effective length of the combined strap is shortened or lengthened depending on the rollers spin direction. Straps 909*a* and 909*b* may be fastened to each other by various fasteners known in the art such as Velcro strips, various buckles and the like. Alternatively, device 900 can be provided with relatively short free ends of straps 909*a* and 909*b* to be fastened to a tubular sock-like garment worn on the limb prior to application of the device. Preferably, at least one elastic element in incorporate into at least one of straps 909 for providing a limited elasticity to the strap. A plate 908, positioned between rollers 910 and 912, covers the middle section of case 901, leaving gaps between plate and rollers to allow revolutions of strap 909 around the rollers. Plate 908 is a curved plate designed to fit snugly over a limb. Plates 902, 904, 906 and 908 are affixed to each other by any means known in the art such as glue, bolts and the like. Embodiment 900 is attached to a person's limb (not shown) via strap 909 with plate 908 being in contact with the limb in a similar fashion as in anterior box embodiment of FIG. 1A.

Figure 9B:
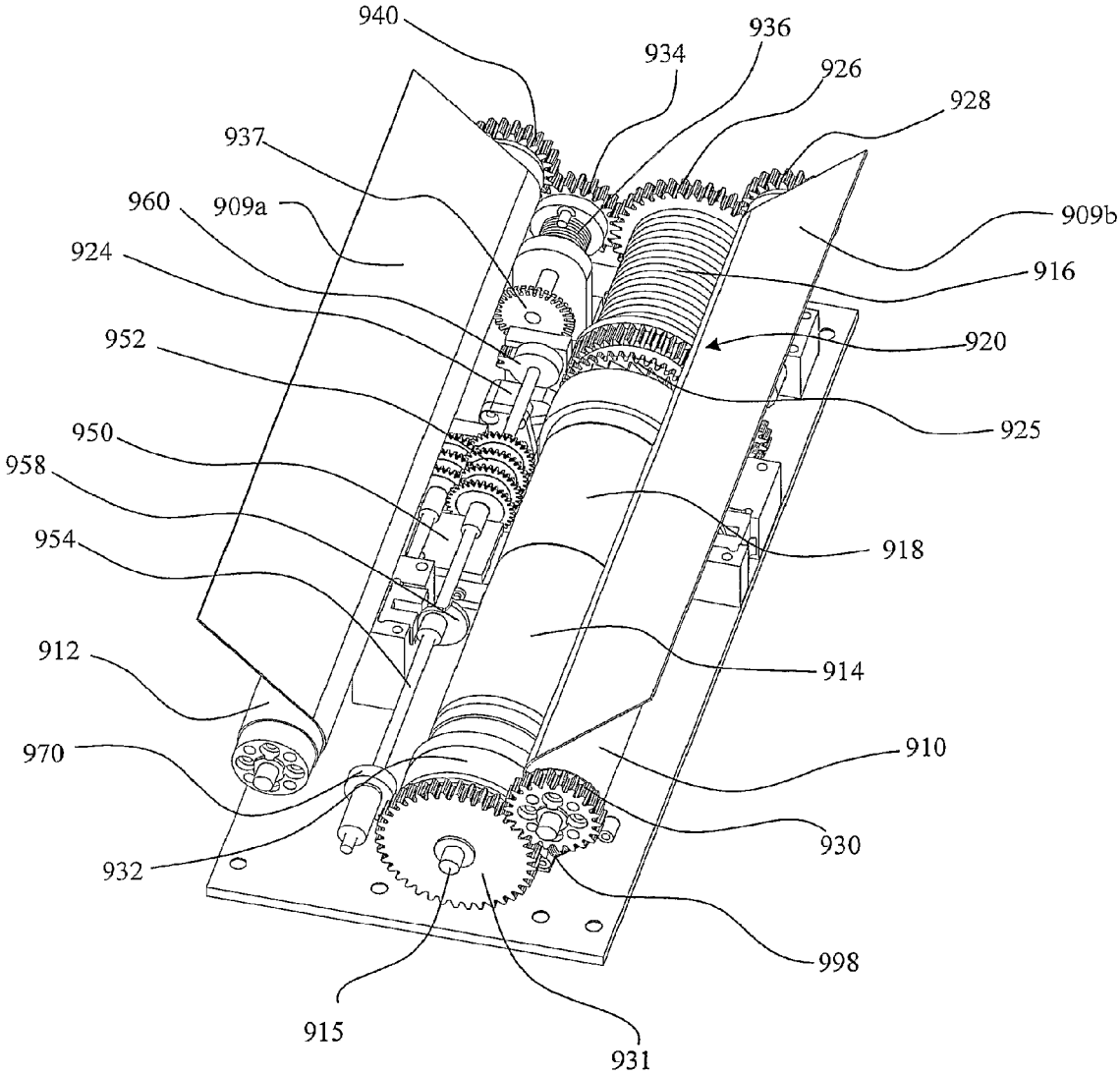
FIG. 9B is an elevational perspective view of the embodiment of FIG. 9A with top cover and side walls removed to show internal components.
Figure 9C:
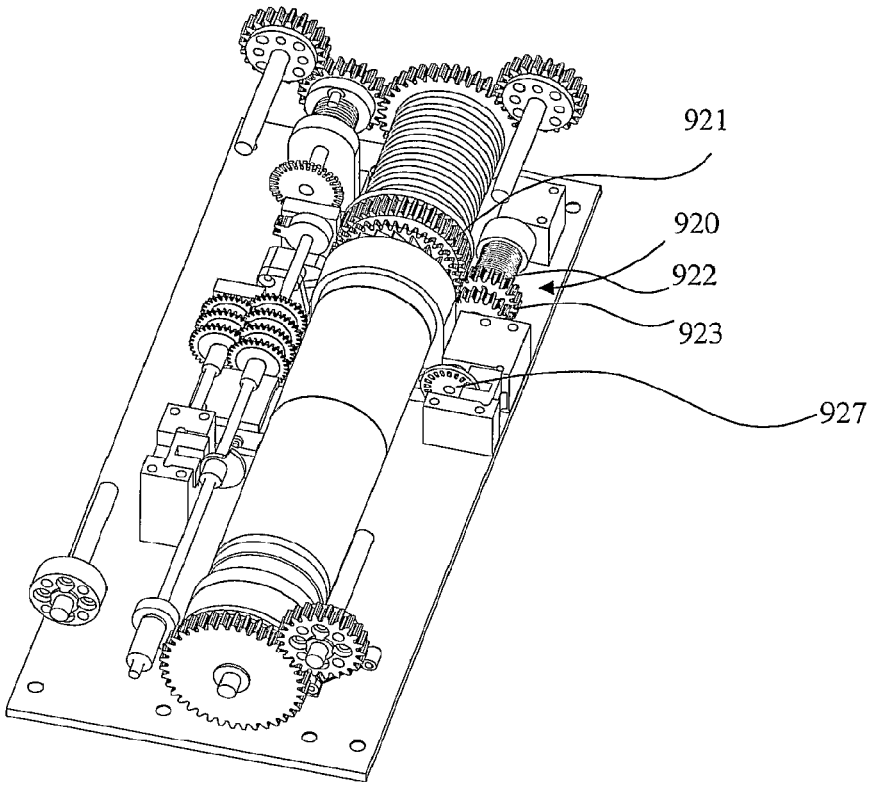
FIG. 9C is an elevational perspective view of the embodiment of FIG. 9A with top cover, side walls and rollers removed.
Figure 9F:
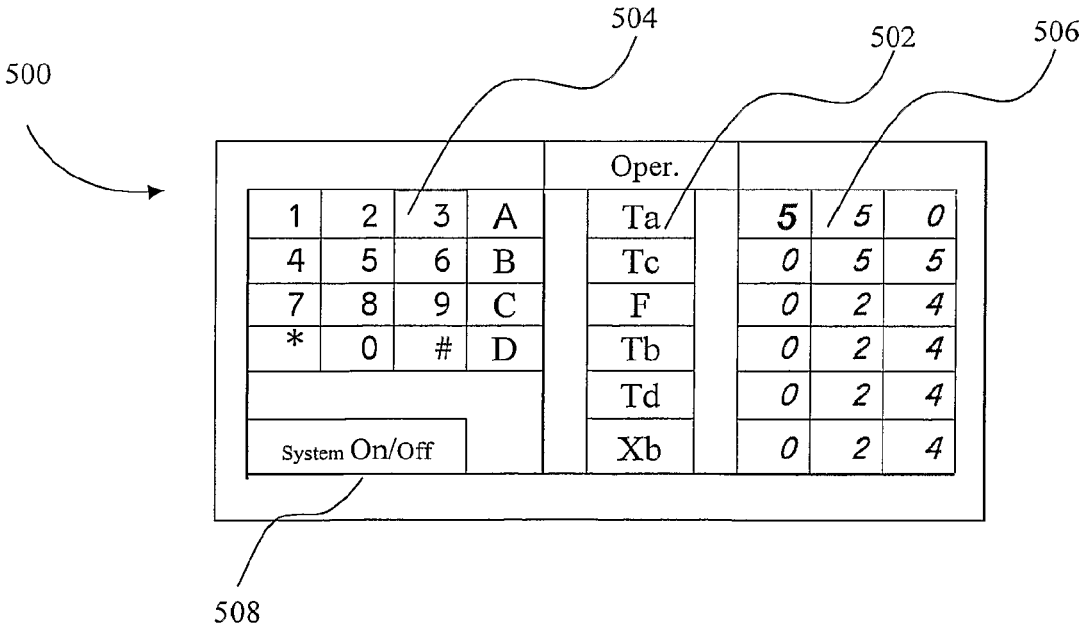
FIG. 9F is an illustration of a typical user interface of the embodiment illustrated in FIGS. 9A-9C.
Figure 9D:
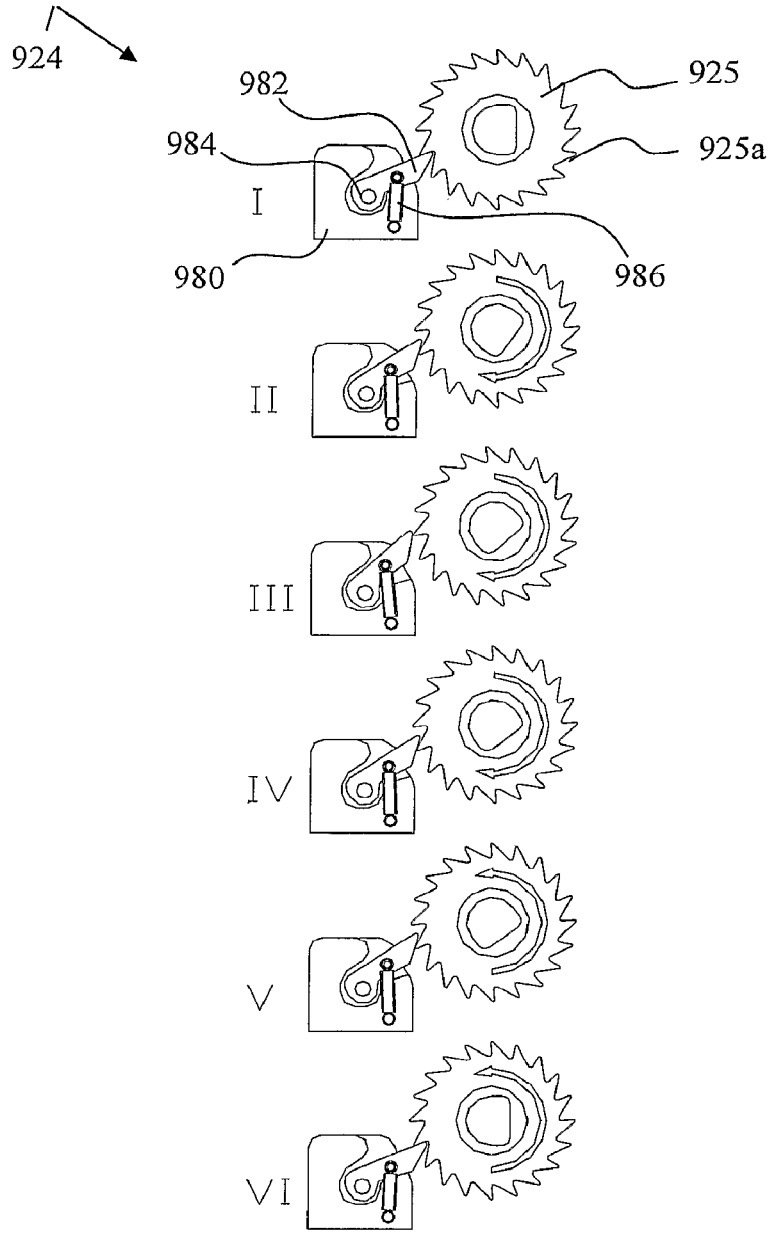
FIG. 9D is a sequence of side views of the ratchet mechanism of the embodiment illustrated in FIG. 9B, as function of time, demonstrating the operation of the ratchet mechanism.
Figure 9E:
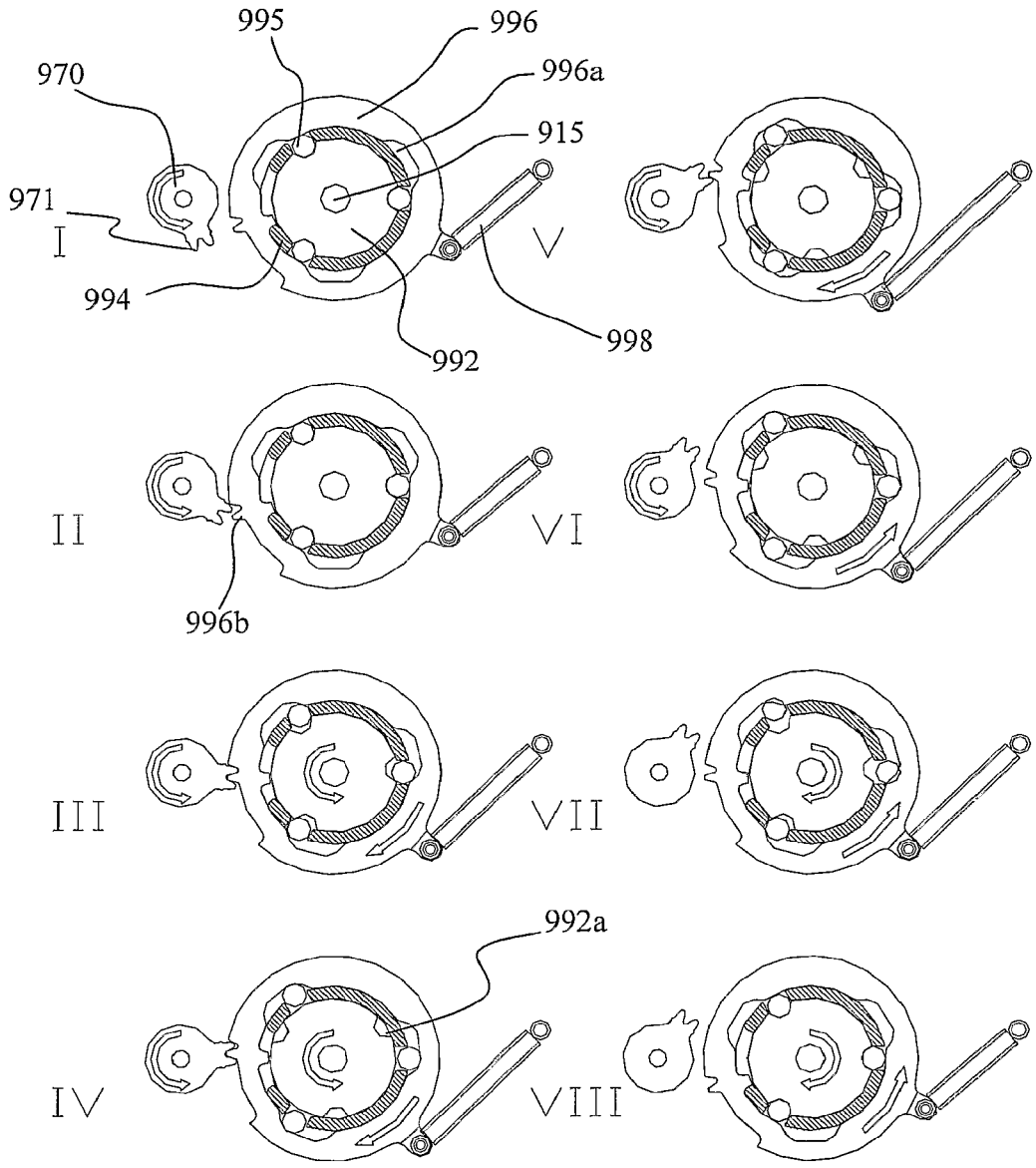
FIG. 9E is a time sequence of cross sectional views of the clutch of the embodiment of FIG. 9B at a plane perpendicular to the rotation axis, demonstrating the operation of the clutch.

Referring now to FIGS. 9B and 9D, the internal machinery includes a main motor 914, a planetary transmission 918 and a mainspring 916 coupled to planetary transmission 918 via mainspring clutch 920. Helical spring 916 is fixedly secured between top mainspring gear 926 and clutch gear 921 of clutch 920. Clutch 920 includes an external clutch spring 922 coupled to gear 921 via gearing 923 such that the torque of clutch spring 922 is proportional to the torque of mainspring 916. A ratchet mechanism 924, the details of which are shown in FIG. 9E, prevents via ratchet wheel 925 reverse rotation of gear 921 and consequently reloading of spring 916 as long as clutch 920 is locked. The top mainspring gear 926 is meshed on one side with right roller top gear 928 and on the other side with connect gear 934 which in turn is meshed with left roller top gear 940, coupling between the mainspring 916 and rollers 910 and 912 such that rotation of gear 926 results in simultaneous and opposite rotation of rollers 910 and 912. A strap return spring 936 of a lower spring constant than that of mainspring 916, is connected to gear 934. Helical spring 936 is configured to be loaded in the opposite direction to that of mainspring 916. Turning now to the bottom part of FIGS. 9B-9D, a strap contraction clutch 932 is coupled to right roller bottom gear 930 via strap contraction clutch gear 931. Clutch 932 locks/unlocks gear 931 and consequently locks/unlocks rollers 910 and 912 via gears 928, 926, 934 and 940. The machinery further comprises a timing assembly comprising a timing motor 950 coupled via transmission 952 to timing shaft 954. Two offset double-tooth cam release disks 960 and 970 are mounted on shaft 954 in alignment with main spring clutch 920 and strap stretching clutch 932, respectively, constructed to engage therewith for unlocking corresponding clutch. In accordance with the embodiment shown here, the mechanism further comprises a main spring encoder 927 mounted on the axis of spring 922 of clutch 920 for reading mainspring 916 torque, a timing shaft encoder 958 mounted on timing shaft 946 for reading the angular positioning of disks 960 and 970 and a strap length encoder 937 mounted on the axis of gear 934 for reading the strap effective length and velocity during transitions. The readings of encoders 927, 958 and 937 are fed into a microprocessor (not shown) which also controls motors 914 and 954.

The following description is divided into three phases of the internal mechanism action. The first phase is the loading phase during which mainspring 916 is loaded and the effective length of the strap remains constant in the relaxed state. The second phase is the strap shortening phase during which abrupt squeezing forces are applied to the encircled limb followed by a predetermined period of time during which the effective length of the strap remains in the contracted state until the third phase is actuated. The third phase is the relaxation phase where the strap effective length returns to its relaxation length by fast transition. The three phases follow each other in time, providing intermittent fast transitions from relaxed to contracted state and vice versa.

Loading phase. During loading phase, strap release clutch 920 and 932 are locked. Loading phase starts with the effective length of the strap being in the relaxed state, by activating motor 914. With clutches 920 and 932 locked, motor 914 via transmission 918 loads mainspring 916 by actuating rotational motion of the proximal end of the spring (proximal to motor 914. Main motor 914 may operate at constant power or alternatively motor 814 may operate with variable output such that as the torque of spring 916 increases so does motor 914 power for maintaining constant rate of spring loading rate. Planetary transmission 918, the internal construction of which is not shown, may be any known in the art planetary transmission for allowing angular speed reducing along a rotation axis. As already mentioned, during the loading phase strap contracting clutch 932 is locked, preventing rotational motion of any of gears 930, 928, 926, 934 and 940. Thus, although the torque built up in mainspring 916 is transferred via gear 826 to upper rollers gears 828 and 840, rollers 910 and 912 cannot rotate and consequently the effective length of the strap remains constant. The torque built up in mainspring 916 is monitored by encoder 927. When mainspring 916 reaches a predetermined value, motor 914 is turned off thereby halting further loading of the spring. At this stage, when no voltage is applied to motor 914, locking ratchet 924 prevents rotation of gear 921 in the reverse direction, hence prevents mainspring 916 from relaxing and maintains the mainspring torque.

Shortening phase. During shortening phase, clutch 920 remains locked. The transition from relaxed to contracted state is controlled by the timing mechanism via release disk 970 configured to unlock strap contracting clutch 932 upon engagement therewith. The shortening phase is effectuated by turning on motor 950 whereupon rotational motion is transferred via transmission 948 to timing shaft 954. Consequently, disk 970 rotates to a position where the disk teeth engage with corresponding teeth on external cylinder of clutch 932 to unlock the two parts of the clutch, as is illustrated in detail in FIG. 9E, and to allow disk 931 to freely rotate around its axis. Unlocking disk 931 unlocks disks 928, 926, 934 and 940 as well. Thus, unlocking clutch 932 while clutch 920 is still locked for preventing rotational motion of disk 921, immediately results in partial release of the system strain through clockwise rotational movement of mainspring gear 926 and consequently in counterclockwise rotation of right roller 910 and clockwise rotation of left roller 912. This results in abrupt shortening of the effective length of the strap and high power squeezing forces on the limb, until no further shortening is possible due to the limb resistance. At the same time that mainspring 916 is partly unloaded, return spring 936 is loaded by the rotational motion of connect gear 934. Thus, the release of clutch 932 brings to both strap 909 shortening and return spring 936 loading. The rotation of connecting gear 934, which is proportional to strap 909 shortening length interval, is read by encoder 937.

Relaxation phase. The relaxation phase is effectuated by reactivating motor 950 for a second short time period whereby allowing further rotation of shaft 946 this time for bringing release disk 960 to a position where the disk teeth engage with gear 921 to unlock mainspring 916 from ratchet mechanism 924, thereby allowing further relaxation of mainspring 916 by counterclockwise rotation of disk 921. As the torque exerted on disk 926 by mainspring 916 decreases, the force exerted by the limb muscles which acts to increase the strap effective length combined with the opposite torque of strap return spring 936, cause disk 926 to rotate counterclockwise for relieving excessive strain in the system. Thus, unlocking clutch 920 immediately results not only with relaxation of mainspring 916 to its initial position but also with immediate fast lengthening of strap 809 to the relaxation effective length, through rotation of gears 926, 928, 930, 934 and 940 to resume their pre-loading positions as well as to rotate rollers 910 and 912 to pre-loading position. The relaxation of all components to pre-loading state also brings clutches 920 and 932 to their initial position, i.e., to be locked again and the cycle loading-shortening-relaxing starts all over again.

FIG. 9D illustrates an example of a ratchet mechanism 924 in a time sequential fashion for demonstrating the ratchet mechanism operation. Ratchet mechanism 924 comprises ratchet body 980 affixed to base plate 904 of case 901, a pawl 982 pivotally mounted on axis 984 within a recess of body 980 allowing a limited rotation of pawl 982 within the recess, and a spring 986 biased to pull pawl 982 toward the base plate. The free end of pawl 982 is engaged with inclined teeth 925*a* of ratchet gear 925. As can be clearly seen in sequence steps I-VI, ratchet mechanism 924 allows only for clockwise rotation of wheel 925 by pushing up the free end of pawl 982 (Steps I-IV) while counterclockwise rotation (steps V-VI) is hindered as teeth 925*a* press pawl 982 against body 980 preventing further rotation.

FIG. 9E illustrates an example of a clutch 932 for locking/unlocking gear 931 to body plate 904. The same clutch with minor modifications can serve also as clutch 920 for coupling/decoupling mainspring 916 and ratchet wheel 925. Steps I-VII are shown as cross sections through clutch 932 in the plane perpendicular to the rotation axis. Clutch 932 comprises an inner cylindrical part 992 having three half-circle recesses 992*a* at its outer perimeter, an outer ring 996 having three elongated recesses 996*a* at its inner perimeter, and a segmented annular element 994 interposed in the space there between. Elements 992, 994 and 996 are arranged concentrically around axis 915. Three circular rods 995 are interposed between adjacent segments of annular element 994. Rods 995, not connected to any of the other parts, can be pushed in the radial direction to occupy either recesses 992*a* or 996*a* but are always confined by segments 994. Outer ring 996 is connected to one end 998*a* of spring 998, having its second end 998*b* fixedly connected to case 901 biasing ring 998 counterclockwise. The outer perimeter of ring 996 is provided with tooth 996*b* to be engaged with double-spike 971 of cam 970. Elements 994 and 992 are each being an integral part of one of the two parts to be coupled or decoupled. By way of example, element 994 is perpendicularly extending from frontal body wall 904 while cylindrical element 992 is perpendicularly extending from the center of gear 931. Thus, when clutch 932 couples between elements 992 and 994, gear 931 is locked to the body 901. Step I of FIG. 9E shows clutch 932 in the locked position. In this position, rods 995 are pressed by outer ring 996 into recesses 992*a*, preventing rotation of cylindrical part 992 in either direction. Double-spike 971 of cam 970 is directed away from clutch 932. In step II, double-spike 971 of cam 970 approach tooth 996*b* to engage the tooth 996*b* in steps III and IV and to rotate ring 996 clockwise. The rotation of ring 996 relative to fixed element 994 advances recesses 996*a* toward rods 995 such that cylindrical part 992 can rotate counterclockwise pushing rods 995 into recesses 996*a*, thus unlocking gear 931 to partly release the strain built up in the system during the loading phase. The rotation of gear 931 stops (step V) when further contraction of the strap is hindered by the limb resistance, preventing further rotation of gears 930 and consequently of gear 931 (see shortening phase description above). After double-spike 971 passes tooth 996*b*, ring 996 is again biased by spring 998 to rotate counterclockwise, as shown in step VI. However, rotation of ring 996 is prevented by rods 995 now partly positioned in recesses 996*a*. Thus, clutch 932 remains uncoupled allowing free rotation of cylindrical part 992. Referring to the relaxation phase description above, after clutch 920 is unlocked as well, all excessive strain in the system is released resulting in relaxation of the strap through counterclockwise rotation of gear 930 and consequently clockwise rotation of gear 931 and of element 992 as shown in step VII. The rotation of element 992 causes rods 995 to be pushed back into recesses 992*a* by outer ring 996 now free to rotate, as shown in step VIII, and clutch 932 returns to the locked position of step I.

It will be realized by persons skilled in the art that the specific construction of the ratchet and clutch mechanisms shown in FIGS. 9E and 9F are given by way of example only and that other equivalent mechanical elements having the same mechanical function can be used without departing from the scope of the invention.

As mentioned above, embodiment 900 is controlled by a microprocessor. The microprocessor controls motors 914 and 954 for timing the transitions between relaxed and contracted states in accordance with input parameters given by the user and the readings received from encoders 927, 958 and 937. A typical user interface is shown in FIG. 9F. User interface 500 includes a parameters keyboard 502, an alphanumeric keyboard 504 for entering desired values, a display panel 506 and an on/off switch 508. In parameters keyboard 502, Ta stands for the duration of relaxed phase; Tc for duration of contracted phase; F is the Force of mainspring 916; Tb is the transition time from relaxed to contracted state; Td is the transition time from contracted to relaxed state; and Xb is the change of the effective length of the strap between relaxed and trained states. Prior to operation, the user enters the values of Ta, Tc and F. The values of Tb, Td and Xb cannot be determined by the user and can be only measured by the encoders. During operation the actual values of these parameters as well as Tb, Td and Xb as measured by the encoders are displayed in display panel 906, each value next to corresponding parameter.

The embodiment illustrated through FIG. 9 provides for enhanced flexibility by allowing choosing independently different parameters of the strap contracting-relaxing cycle. As such, embodiment 800 is particularly suitable as an experimental prototype device for deriving optimized parameters for different conditions and/or users. Embodiment 900 may also be used as a multi-user device by medical personnel for adjusting optimal parameters to each user.

A modified lower cost mechanically-controlled version of embodiment 900, which is having substantially the same main contraction-relaxation mechanism as of embodiment 900, but is driven by only one continuously operating motor, is depicted in FIGS. 10-16. Other modifications and differences between embodiments 900 and 1000 will be apparent from the following description.

Figure 10A:
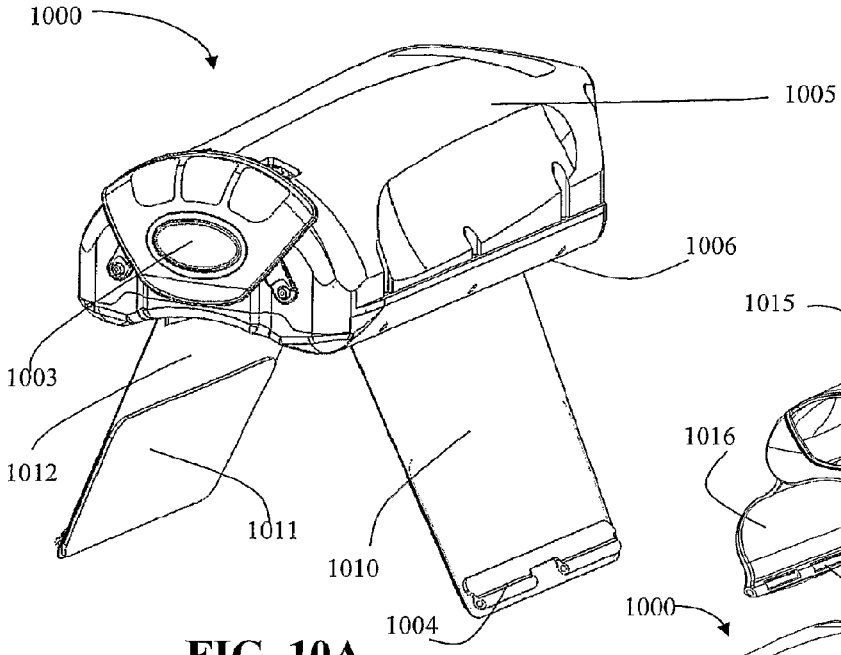
FIG. 10A illustrates the device without the protecting cover.
Figure 10B:
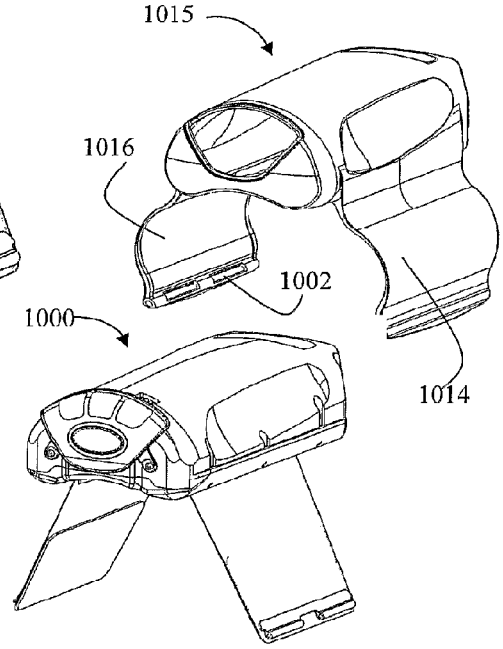
FIG. 10B shows the device and the protecting cover separately.
Figure 10C:
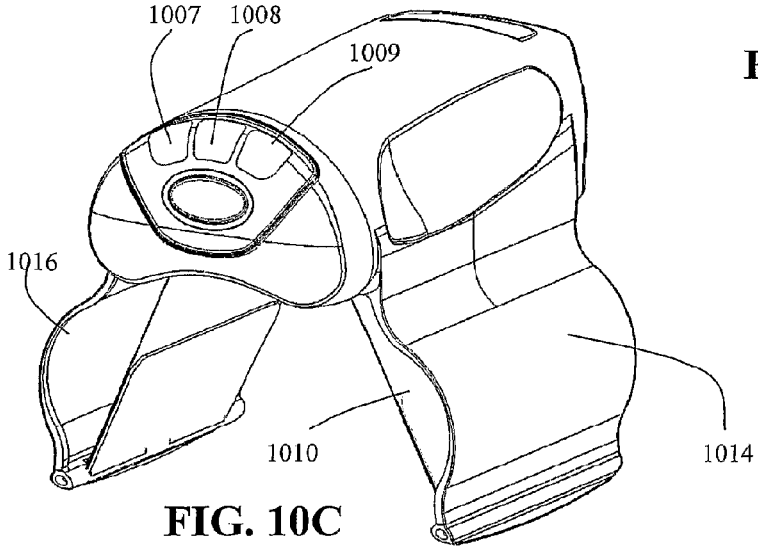
Figure 11A:
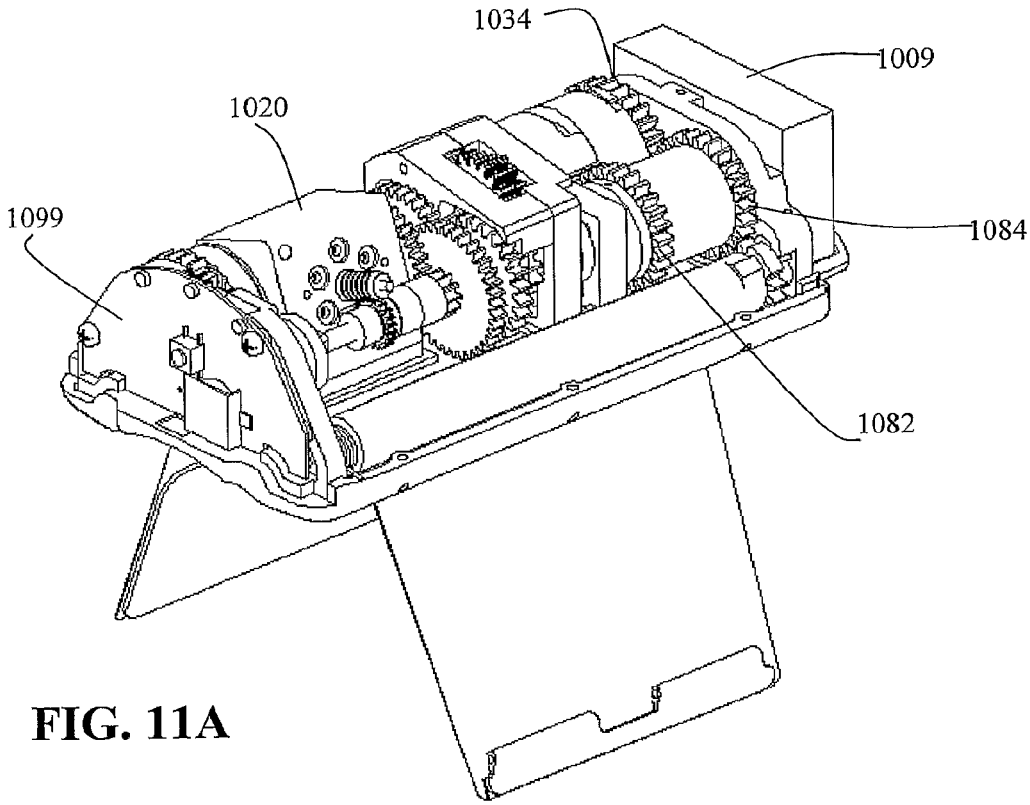
FIGS. 11A and 11B are two isometric views of the embodiment of FIG. 10 with top cover removed to show internal components.
Figure 11C:
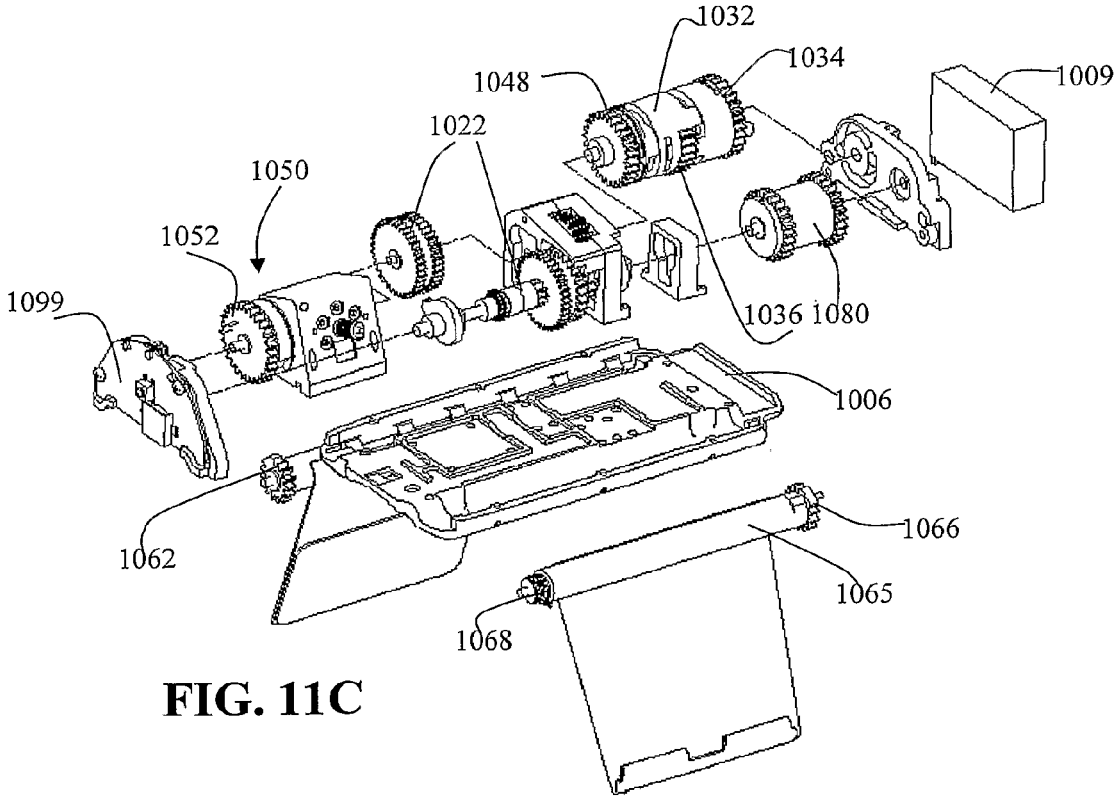
FIG. 11C is an exploded view of FIG. 11A.
Figure 11B:
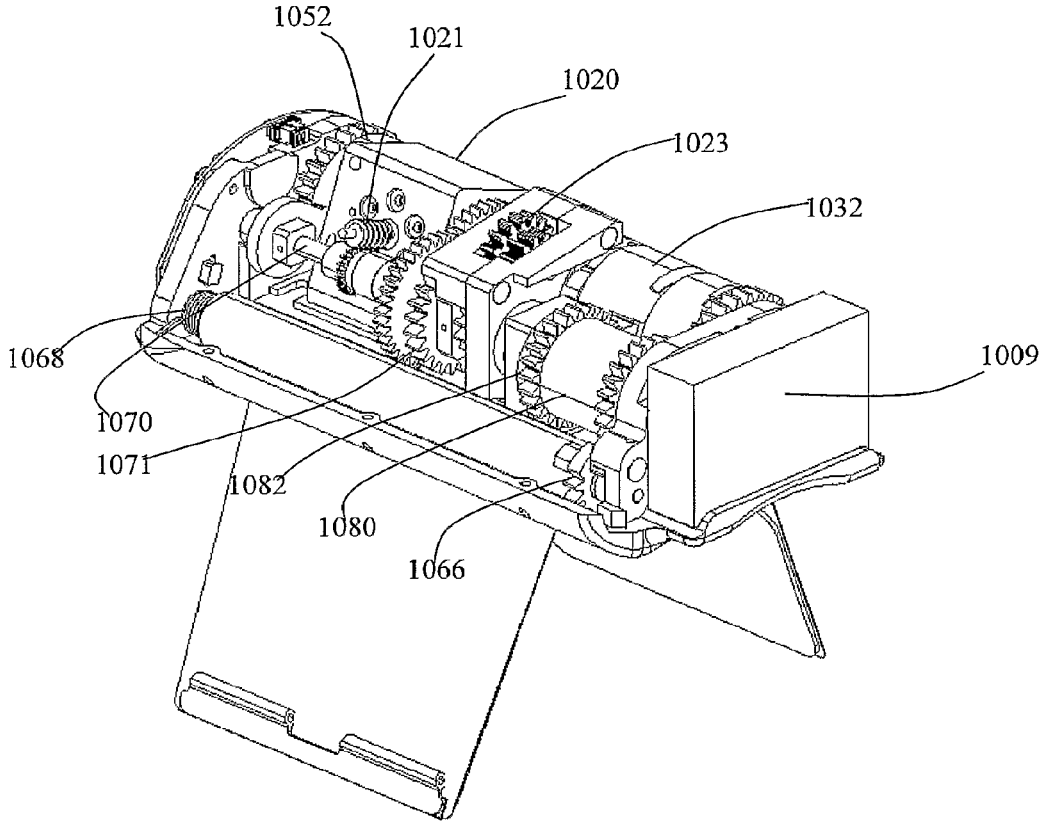
Figure 11D:
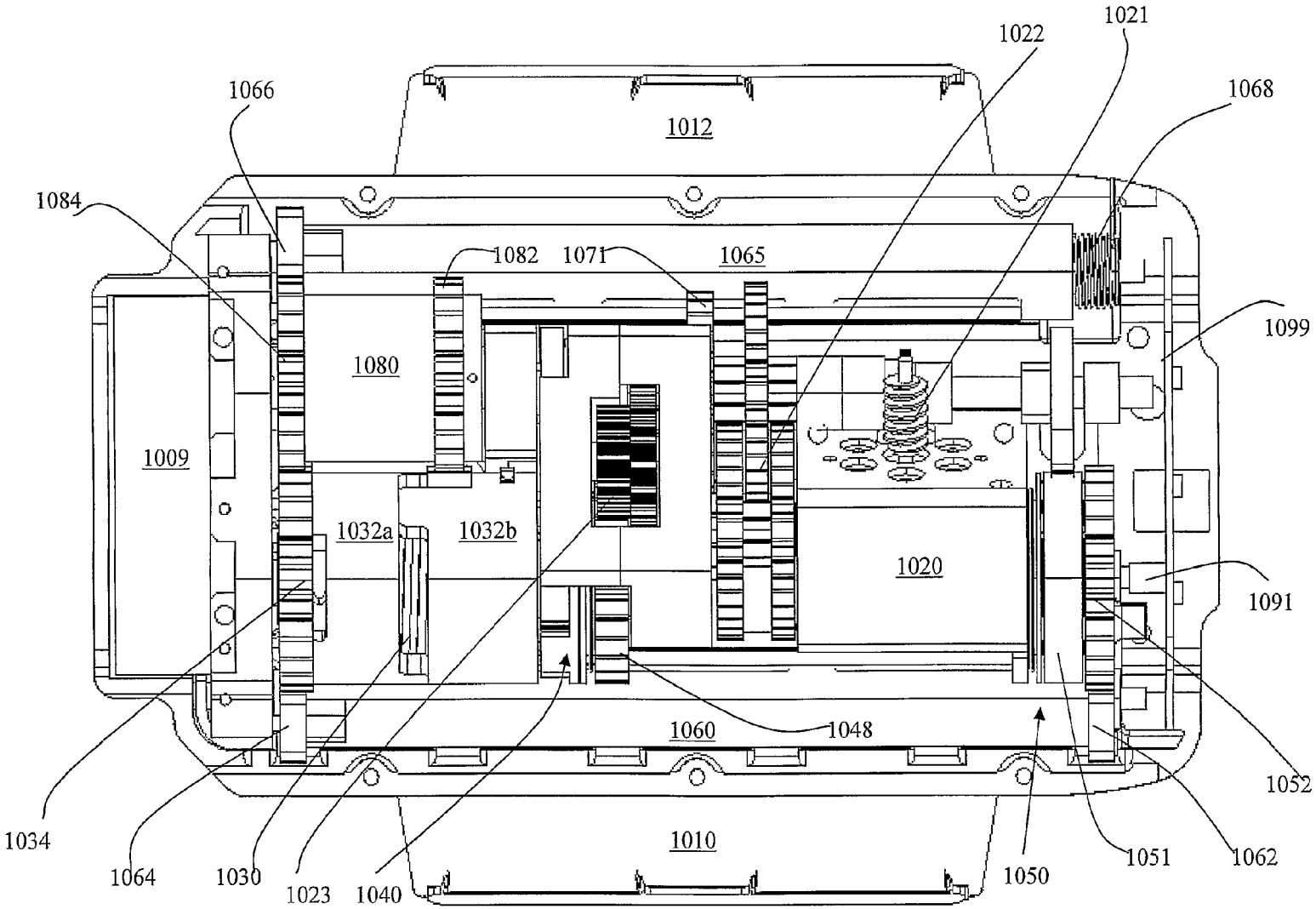
FIG. 11D is a top plane view of the device with top cover removed.

The device, generally designated 1000, can be designed to have a cycle of a predetermined pressure profile by selecting the force/torque components of the device and by selecting the mechanical components responsible for timing the transitions between low and high pressure An external view of embodiment 1000 is illustrated in FIG. 10A. Device 1000 comprises a flask-like casing 1005 having a back surface 1006 curved to fit the curvature of a limb. Preferably casing 1005 is placed against the bone. However, the device may be operated effectively by placing casing 1005 against the muscle or against any other part of the limb circumference. Two strap portions 1010 and 1012 are extending from opposite lateral sides of casing 1005. Strap portions 1010 and 1012 may be provided at their free ends with connecting means (not shown), such as a buckle, for allowing the two portions to connect to each other directly or by means of an additional strap portion for encircling the limb. Alternatively, as shown in FIG. 10, the free ends of the straps may be provided with attaching means such as hook or loop patches 1011 attachable to a separate band or sleeve (not shown) having a complementary attachable surface. According to this alternative, the sleeve is first wrapped about the limb, then the device is attached to the sleeve. In this case device 1000 acts as a tensioning device that intermittently tighten and relax the sleeve for applying intermittent squeezing forces on the limb. The separate strap or sleeve may be designed for multiuse or may be a disposable part for a short-time or one-time use. A detailed description of various embodiments of the sleeve is disclosed in co-pending international patent application titled SLEEVES FOR ACCOMMODATING A CIRCULATION ENHANCEMENT DEVICE assigned to the assignee of the present application and filed concurrently with the present application, the full content of which is incorporated herein by reference.

The top face of casing 1005 is provided with an on/off push button switch 1003 and with three indicator LEDs 1007, 1008 and 1009 for indicating the status of the device. The indicators may include an indicator for low-battery/charging condition, for malfunction status and for loose strap condition. A malfunction is defined whenever the device does not operate according to the designed cycle, a loose strap condition is detected when no sufficient tension is applied to the straps. A loose strap condition may occur when the device is turned on with the straps unattached, i.e., when there is no tension in the straps, or when the sleeve or strap encircling the limb is not tightened sufficiently. In the later case, since no sufficient tension is built during the compressed phase, the application of the device is not effective and the user is alarmed. It will be realized that an opposite, over-tight strap condition may also occur, when the strap or sleeve are fastened to the limb too tightly. Accordingly, the device may be provided with an over-tight strap indicator for indicating over-tight condition. The device may be further provided with a buzzer for alarming the user when the device is not operating properly and/or effectively and with a control means to stop operation automatically upon the detection of improper condition.

In accordance with the embodiment shown here, both casing 1005 and strap portions 1010, 1012 are covered by an external cover 1015, preferably made of elastomer material for protecting the device. The elastomeric cover is provided with two flexible flaps 1014 and 1016 connectable to strap portions 1010 and 1012. Flaps 1014, 1016 are having a foldable shape and are longer than corresponding portions 1010, 1012 so as not to cause any resistance to the movement of strap portions 1010 and 1012 during operation. In the embodiment shown here, the flaps are connected to the straps by means of elongated recesses 1002 provided on the inner side of the flaps adapted to snap-fit onto corresponding elongated projections 1004 provided on the outer side of strap portions 1010, 1012. However it will be realized that many other connection means for connecting flaps and straps are possible.

The principles underlying embodiment 1000 mechanism are similar to those of embodiment 900, namely rotational motion of a motor is used to charge a mainspring when the straps are locked in the relaxed position. At the end of the relaxed phase a first portion of the potential energy stored in the mainspring is abruptly released by clutch decoupling and the strap roller roll the straps inwardly, actuating a transition from relaxed to contracted phase and simultaneously charging a strap release spring. At the end of the contracted phase, the rest of the potential energy stored the mainspring, as well as the energy stored in the strap release spring are discharged by decoupling between motor and spring to unroll the straps back to their initial non-contracted position, actuating a transition back to the relaxed position. However, unlike embodiment 900, in embodiment 1000, the mainspring is loaded by a relatively low-power motor that operates continuously to charge the spring. This allows for the ability to use small and low power motors and batteries to charge the spring over a long period while enable a fast release of energy almost regardless of the motor capability to produce an abrupt motion.

In accordance with embodiment 1000, the internal components are mounted on back surface 1006 of casing 1005. An overall view of the internal structure of device 1100 is given in FIG. 11. Roughly, the mechanical components of embodiment 1000 may be grouped into the following sub-systems: a driving system including a motor 1020 having a worm shaft 1021 in mesh with a speed reducing gear train 1022; a strap system that includes two rollers 1060 and 1065 and a strap returning spring 1068; a main spring system that includes a coil spring 1030 (best seen in FIG. 12A) housed in main spring housing 1032 disposed between clutch 1040 that couples one half of housing 1032 to motor 1020 via gear trains 1022 and 1023, and gear 1034 that couples the second half of housing 1032 to strap rollers 1060 and 1065 via gears 1062, 1064, 1084 and 1066; a main clutch system that includes a main clutch 1050 for locking/unlocking gear 1052 to the motor housing, gear 1052 being coupled to strap roller assemblies 1060 and 1065 via gear 1062; a clutch release system (best seen in FIG. 13) that includes a clutch release camshaft 1070 provided with two cams 1072 and 1074 in alignment with clutches 1050 and 1040, respectively; and a decelerating system 1080 disposed between gear 1082 meshed with gear 1036 of main spring housing 1032 and gear 1084 meshed with gear 1034; The components further comprise a battery pack 1009 and a Printed Circuit Board 1099 (PCB) including a microprocessor. A detailed description of the electronic system is disclosed in co-pending international patent application titled A COMPUTERIZED PORTABLE DEVICE FOR THE ENHANCEMENT OF CIRCULATION assigned to the assignee of the present invention and filed concurrently with the present application, the full content of which is incorporated herein by reference. Mounted on PCB 1099, opposite gear 1052, is an opto-coupler sensor 1091 for monitoring the device activity as explained below in association with FIG. 15. The batteries 1009 for energizing the device are preferably rechargeable batteries such as Lithium Ion batteries. Device 1000 is preferably provided with electronic means for monitoring activity of the device and indicating its status. However, it will be realized that the electronic means are not a necessarily component of device 1000 and that device 1000, being mechanically controlled, can function without such means.

As mentioned above, embodiment 1000 includes only one continuously operating motor 1020 that drives both the spring assembly to wind spring 1030 and the clutch release camshaft 1070 responsible for timing the transitions between relaxed and contracted states. Preferably, motor 1020 is a low-cost DC motor of operational voltage in the range of 7-10 V and 4000-6000 rpm, such as for example brush motor model 320CH-10470 distributed by QX Motor Co. The rotational motion is transferred from motor shaft 1021 to cam shaft 1070 via speed reducing gear train 1022 terminating with final gear 1071 (best seen in FIG. 13) and from camshaft 1070 via a second gear train 1023 to gear 1048 of clutch 1040 coupled to spring housing 1032. It should be realized that the rotational velocity of camshaft 1070 is selected according to the desired frequency of the pressure cycle. In accordance with the embodiment shown here one cycle of camshaft 1070 corresponds to one pressure cycle. Preferably, the frequency of the pressure cycle is in the range of 0.5 to 5 cycles/minutes, more preferably in the range of 1-3 cycles/minutes. It should be also realized that the rotational velocity of gear 1048 is selected in accordance with the radius of the strap rollers and the desired maximum length interval between relaxed and contracted strap position on the one hand and with the spring parameters and the force to be applied on the limb on the other hand. Thus, the ratio between the velocities of camshaft 1070 and spring axis 1031 is selected accordingly. Finally, it will be realized that the number of variables in the system allows for unlimited flexibility in planning the device to perform any desired cycle.

Figure 12A:
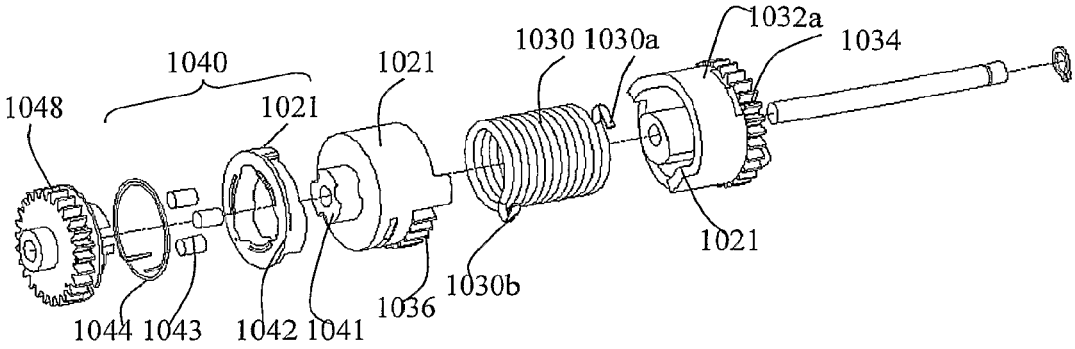
FIGS. 12 and 12A are an isometric view and an exploded view, respectively, of the spring and clutch assembly of the embodiment of FIG. 11.
Figure 12:
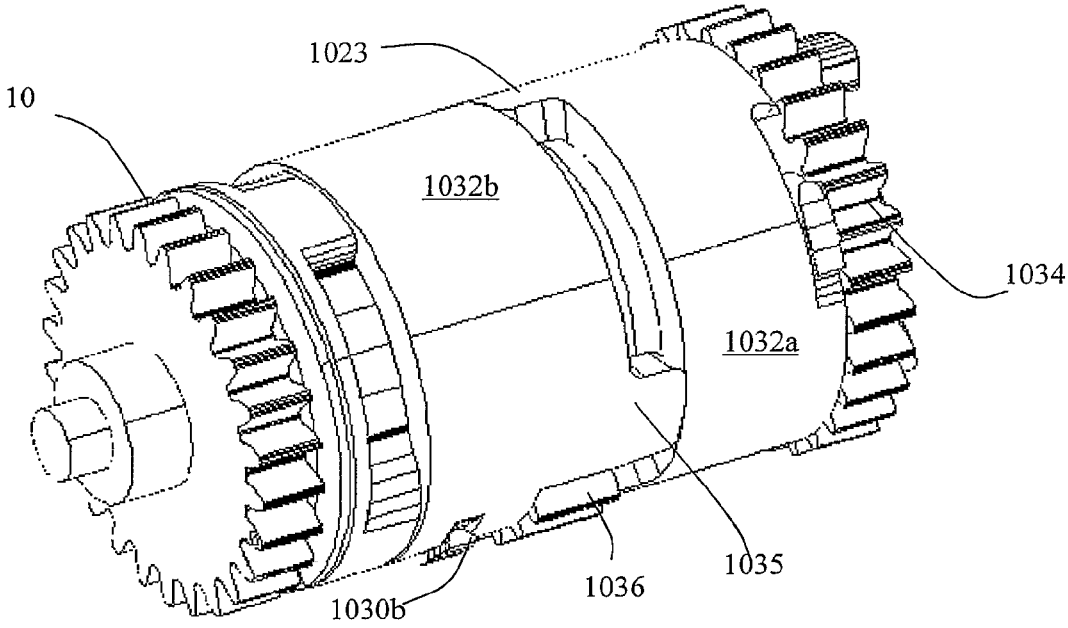
Figure 14C:
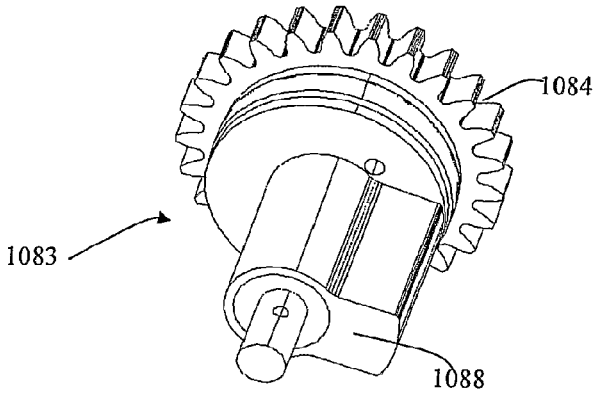
FIGS. 14A and 14B are isometric view and a cross sectional view of the decelerating system, respectively.
FIGS. 14 C and 14D are isometric views of the rotor and the stator, respectively.
Figure 14A:
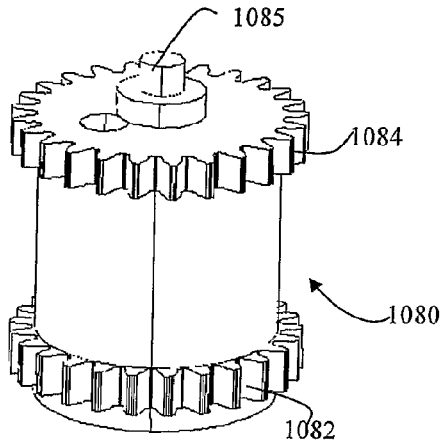
Figure 14D:
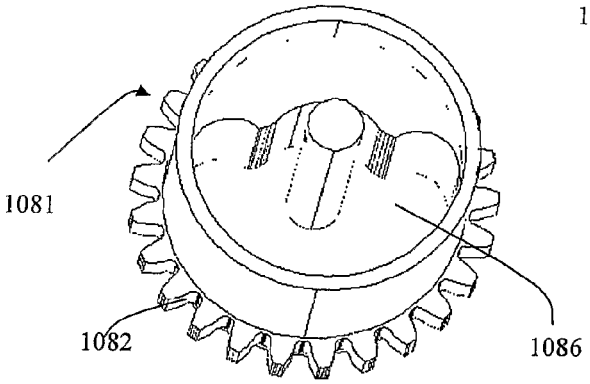
Figure 14B:
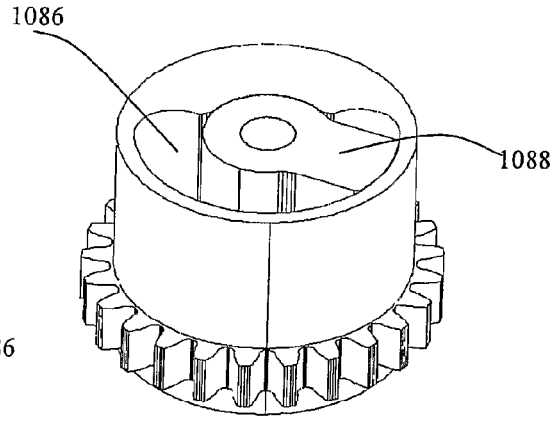
Figure 13A:
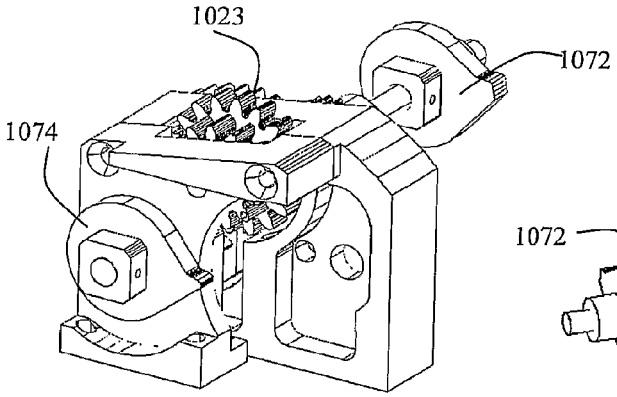
FIGS. 13A and 13B are two isometric views of the clutch releasing assembly of the embodiment of FIG. 11
Figure 13B:
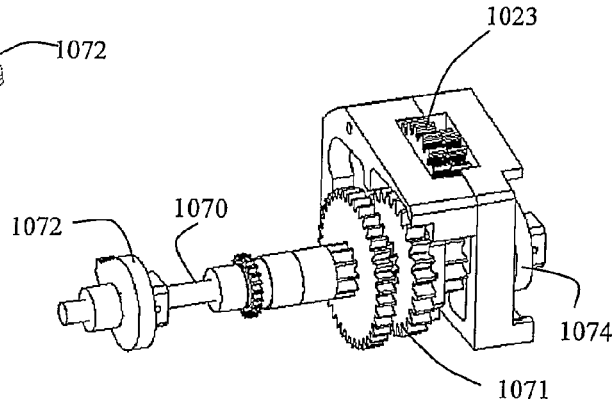

Referring now to FIG. 12, there is shown the main spring assembly comprising main spring 1030, spring housing 1032 and clutch 1040, all mounted on central axis 1031. As best seen in FIG. 12A, housing 1032 comprises two parts 1032*a* and 1032*b* constructed to rotate with respect to each other. Spring 1030 is inserted into housing 1032 with one of its ends, referred to as 1030*a*, connected to part 1032*a* and the other end 1032*b* connected to part 1032*b*. Part 1032*a* is coupled by means of gear 1034, via gears 1064, 1062 of roller 1060 to gear 1052 which in its turn is coupled to main clutch 1050. Thus, when gear 1052 is locked by clutch 1050, part 1032*a*, hence end 1030*a* of spring 1030, are locked as well. Part 1032*b* of the spring housing is coupled to motor 1020 via gear trains 1023 and 1022 by means of gear 1048 of clutch 1040. Thus, when both clutches 1040 and 1050 are locked, rotational movement of the motor is transferred to part 1032*b*, hence to end 1030*b* of spring 1030 to wind the spring. Clutch 1040 provided at the bottom of part 1032*b* is having a similar structure to the structure of clutch 932 of embodiment 900. As best seen in FIG. 12A, clutch 1040 comprises an inner "three-petal-flower"-like part 1041 provided at the bottom of housing part 1032*b*, an outer three-recessed ring 1042 and three circular rods 1043 interposed therebetween. In accordance with the clutch embodiment shown here, clutch spring 1044 for biasing the clutch into the locked position, is an inner spring. Projection 1045 on ring 1042 allows for the engagement of cam 1074 with the ring to decouple spring housing 1032 from gear 1048. A detailed description of the clutch operation is given above in association with FIG. 9E above.

In accordance with the embodiment shown here, main spring 1030 is already loaded to about 80% of the maximal energy that can be reached during operation when the device is assembled. Thus, during operation the energy stored in the spring fluctuates only between 80-100% of its maximal value. Two pairs of legs 1033 and 1035 extending from parts 1032*a* and 1032*b*, respectively, prevent the spring from unwinding to its equilibrium state. This arrangement allows for reducing the variability in the power and force exerted by the spring during transitions which depend to some degree on the structure of the limb the device is applied to, and the initial tension in the straps.

The decelerating assembly 1080 whose role is to dampen the force exerted by spring 1030 during abrupt transitions is depicted in FIG. 14. The assembly comprises a cylindrical stator 1081 open at one end thereof and a complementary rotor 1083 fitted to be inserted into and seal the stator. It will be realized that the use of words stator and rotor does not imply necessarily that one part is moving while the other is stationary but only that the two parts can rotate with respect to each other. Parts 1081 and 1083 are having a common axis 1085 and are disposed between gear 1082 in mesh with gear 1036 of part 1032*b* of spring housing 1032, and gear 1084 in mesh with gear 1034 of part 1032*a* of housing 1032 and with gear 1066 of roller 1065. Stator 1081 is partly hollow, having a substantially semi-circular well-like space 1086 filled with highly viscous oil such as for example silicone damping fluids of 12500 CST distributed by Dow Corning. Rotor 1083 is having an oar-like radial extension 1088 mounted on its axis having dimensions (radius and height) substantially the same as the dimensions of well 1086, leaving only very narrow space between the oar and the inner walls of stator 1081. Thus, when oar 1088 rotates inside well 1086, the oil in the well has only very narrow passes to flow from one side of the well to the other. In accordance with viscous damping principles, as long as the rotational velocity of the oar is relatively low, the flow of the oil follows the oar rotation and substantially does not slow it down, however at high velocities the oil flow slows down the oar.

In order to operate the device, casing 1005 is placed on the limb of the subject either by connecting strap portions 1010, 1012 to form a closure around the limb or preferably, by attaching the device to a sleeve encircling the limb. Operation of device 1000 starts with clutches 1040 and 1050 locked and with straps 1010, 1012 at their relaxed position. It will be realized that camshaft 1070, driven by gear 1022, and gear 1048, driven by gear 1023, are continuously revolving each around its axis as long as motor 1020 is turned on. However, other components, including the components of the spring assembly, the strap roller assembly and the deceleration assembly rotate to only limited degree first in one direction then back in the opposite direction such that at the end of the cycle the system returns to its initial position. As long as clutches 1050 and 1040 are locked, part 1032*b* of spring house 1032 follows the rotation gear 1048 while part 1032*a* is kept locked by means of clutch 1050, thus spring 1030 is being charged. During this phase, the strap roller assemblies 1060 and 1065 are kept locked as well. As mentioned above, camshaft 1070 is continuously revolving around its axis along with cam disks 1072 and 1074. When cam 1072 engages ring 1051 of clutch 1050, gear 1052 is unlocked and the energy stored in spring 1030 is abruptly released to rotate strap rollers 1060 and 1065 inwardly, thus pulling the straps until the limb resistance equals the tension applied by the straps. The inward rotation of roller 1065 winds strap return spring 1068 so that part of the energy released from spring 1030 is converted to potential energy of strap return spring 1068. As long as clutch 1040 remains locked, the straps retain their contracted position while spring 1030 is kept being charged. The contraction phase terminates when cam 1074 engages with ring 1042 to unlock clutch 1040, thereby decoupling housing 1032 from the motor allowing spring 1030 to relax by rotating part 1032*b* in an opposite direction to gear 1048. As mention above is association with FIG. 12, full relaxation of spring 1030 is prevented by the structure of parts 1032*a*, 1032*b*, namely legs 1033 and 1035, which limit the rotation between the two parts. As the torque exerted by spring 1030 decreases, the torque exerted on roller 1065 by strap return spring 1068 and by the limb muscles cause rollers 1060 and 1065 to rotate outwardly to unwind strap portions 1010 and 1012, respectively. Thus, unlocking clutch 1040 immediately results not only with relaxation of mainspring 1030 to its initial position but also with an abrupt transition of the straps to their non-contracted relaxed state. With no further external forces acting on the system, the system returns to its initial relaxed state, including the return of clutches 1040 and 1050 to their locked position and the cycle starts all over again.

Figure 15:
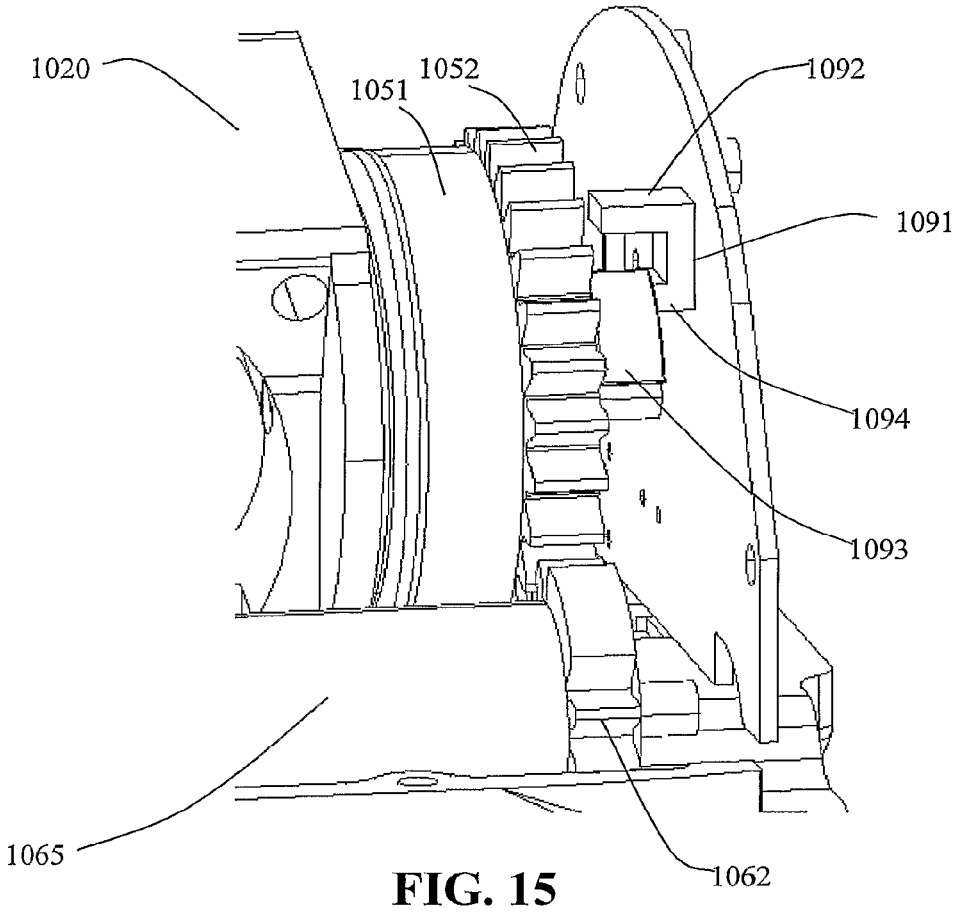
FIG. 15 is a partial detailed view of the embodiment of FIG. 10 showing the opto-coupler system.
Figure 16A:
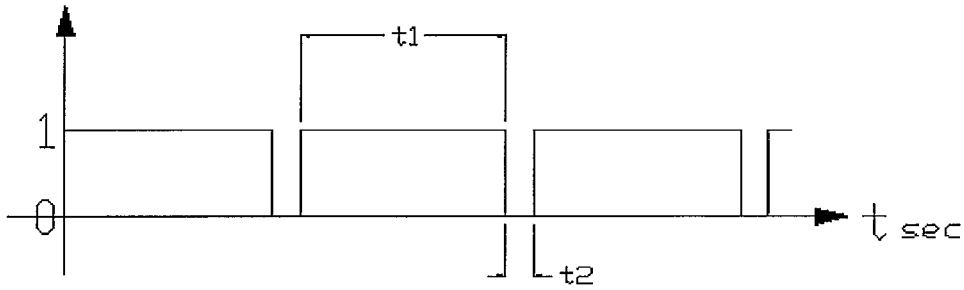
FIGS. 16A and 16B are graphs of signal received by the opto-coupler during normal operation and under loose strap condition, respectively.
Figure 16B:
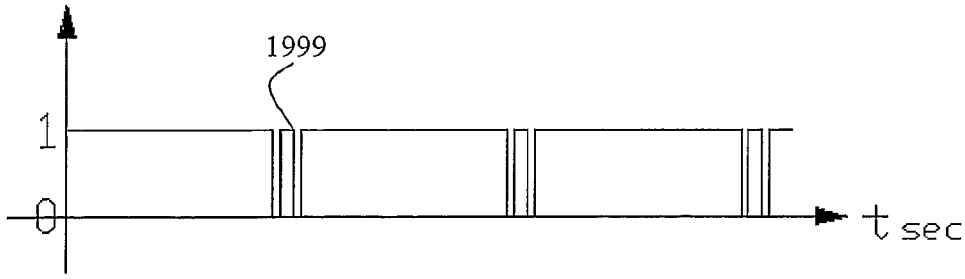

The opto coupler system for monitoring activity of the device is depicted in FIG. 15. The system includes an opto-coupler sensor 1091 mounted on the inner surface of PCB 1099 opposite gear 1052. Opto-coupler 1091 comprises a transmitter and a receiver mounted opposite each other on parallel plates 1092 and 1094. A tag 1093, protruding from gear 1052 toward opto-coupler 1091, is located at a radius midway between the transmitter and receiver 1092 and 1094 of opto-coupler 1091 such that when gear 1052 rotates, tag 1093 blocks the ray of light passing between receiver and transmitter. It should be noted that during normal operation of device 1000, gear 1052, coupled to clutch 1050, performs only limited rotation, back and forth between its positions in the relaxed and contracted states. It should also be noted that gear 1052, being coupled to strap roller gears 1062, 1064 and 1066, reflects the operation of the device. Thus, by monitoring the periodical behavior of gear 1052 it is possible to monitor the activity of the device and to detect abnormal operation. The angular position of tag 1093 with respect to opto-coupler 1091 when the system is in the relaxed state is designed so that the angular shift of gear 1052 expected during normal operation will bring tag 1093 to a position between plates 1092 and 1094 to block the light. Thus during normal operation, the signal received by the opto coupler mimics the periodicity of the contraction-relaxation cycle as depicted in FIG. 16A where t1 is the duration of the relaxation phase and t2 is the duration of the contracted phase. If opto-coupler 1091 detects deviations from the normal periodicity that are bigger than a predetermined tolerance $\Delta t$, a malfunction signal is activated, the user is alarmed that the device does not function properly and the device is turned off. Another condition detected by the opto-coupler sensor is a loose strap condition when the straps are pulled all the way in. During normal operation, the subject's limb prevents the straps from being pulled all the way into the device. However, if the straps are not sufficiently tighten they can be pulled by more than a predetermined length interval and consequently gear 1052 rotates to a greater extent such that during the contraction phase, tag 1093 does not stop between plates 1092 and 1094 but crosses to the other side thereof. Thus, under such conditions an additional light signal 1999 is detected during the contraction phase as depicted in FIG. 16B.

It will be realized that other sensors arrangement for monitoring the device activity may be used, besides the opto-coupler assembly described above. For example, the device may be provided with an encoder comprising an optical reader positioned opposite gear 1052, or any other rotating component of the device which reflects the device activity while the rotating component may be provided with at least one marker to be detected by the reader. The marker may be, for example, a radial line or preferably a series of radial lines marked on the surface facing the optical reader. Such an arrangement allows for monitoring the velocity, direction and range of the rotational motion of the rotating component as function of time, from which the cyclic pattern of the closure encircling the limb can be derived. Thus, analyzing the pattern read by the optical reader as function of time gives information about the status of the device, e.g., run/stop/malfunction etc., as well as of the closure encircling the limb, e.g., loose strap/over-tight strap, etc, and accordingly indicators 1007-1009 can indicate the device status. Preferably PCB 1099 includes a memory component for storing the data collected by opto-coupler 1091 (or by any other activity monitoring sensor) and an output device, such as an USB port, for allowing downloading the data to an external computer device. The data may include records of any event regarding the device activity, including the start time and stop time of any run period and the device status during that period. Additionally, the device may be provided with one or more sensors for monitoring various physiological parameters of the user, such as body temperature, blood pressure, etc., and the data collected by these sensors may be stored in the memory along with the data relating to the device activity.

A further embodiment of the device, especially designed to be of small dimensions, low-weight and low-cost is depicted FIGS. 17-25. The small dimensions and low weight enhance the portability of the device, allowing the device to be carried in a handbag or a wallet as well as allowing wearing the device under garments. The embodiment, generally designated 1100, is particularly suitable, but not limited to, non-medical applications. For example, device 1100 can be used by people who are not known to suffer from any medical problem for reducing discomfort, limb swelling, fatigue and aching during long hours of immobilization. Thus, embodiment 1100 is particularly suitable to be used by long flights passengers, by people who spent long hours working in a sitting position (for example patent attorneys under time pressure), etc.

Figure 17:
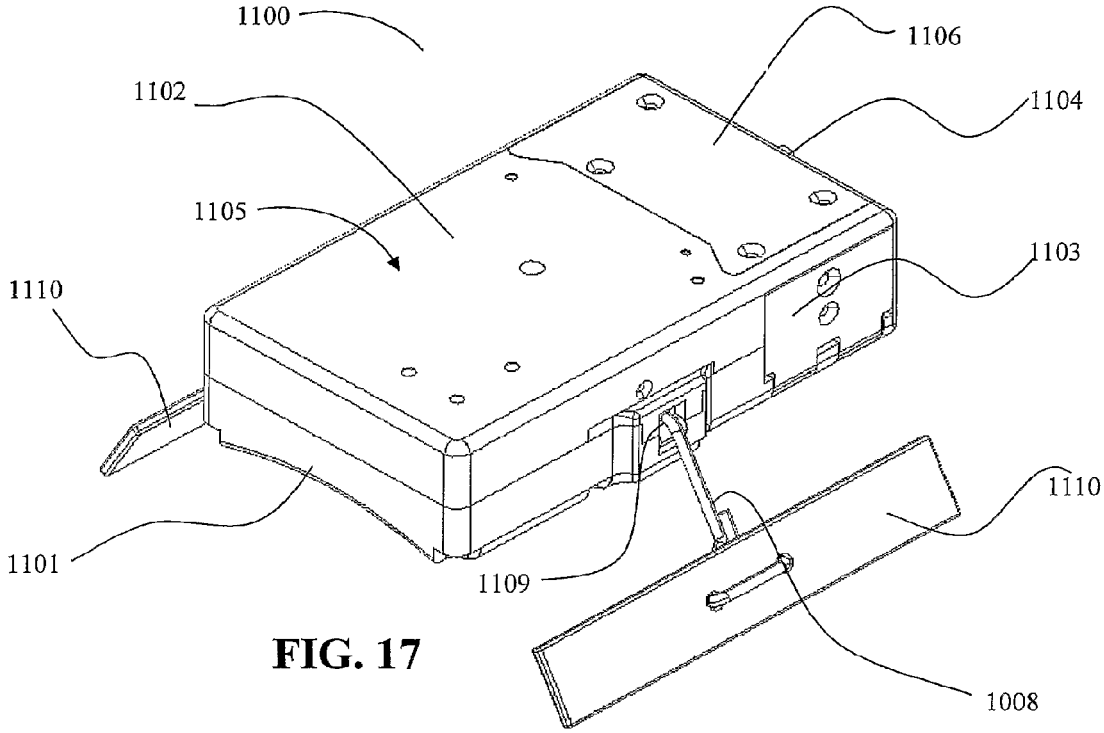
FIG. 17 illustrates a ninth, compactly packed embodiment of the present invention.

Turning now to the drawings, FIG. 17 is an external view of device 1100 showing a casing 1105 having the size of about a typical cigarette packet and weight of about 250 grams. Casing 1105 accommodates all the internal mechanical components required for operation and the batteries for powering the device. Casing 1105 comprises a base 1101, a cover 1102 for covering the mechanical components accommodated in the main compartment and a battery cover 1103 for closing the battery compartment. Also seen is cover 1106 that covers the electronic board of the device and an on/off switch 1104. In accordance with embodiment 1100 strap portions 1110 are coupled to the main contraction-relaxation mechanism by means of two strong and endurable cables 1108 protruding out of two lateral openings 1109 of casing 1105.

Figure 18:
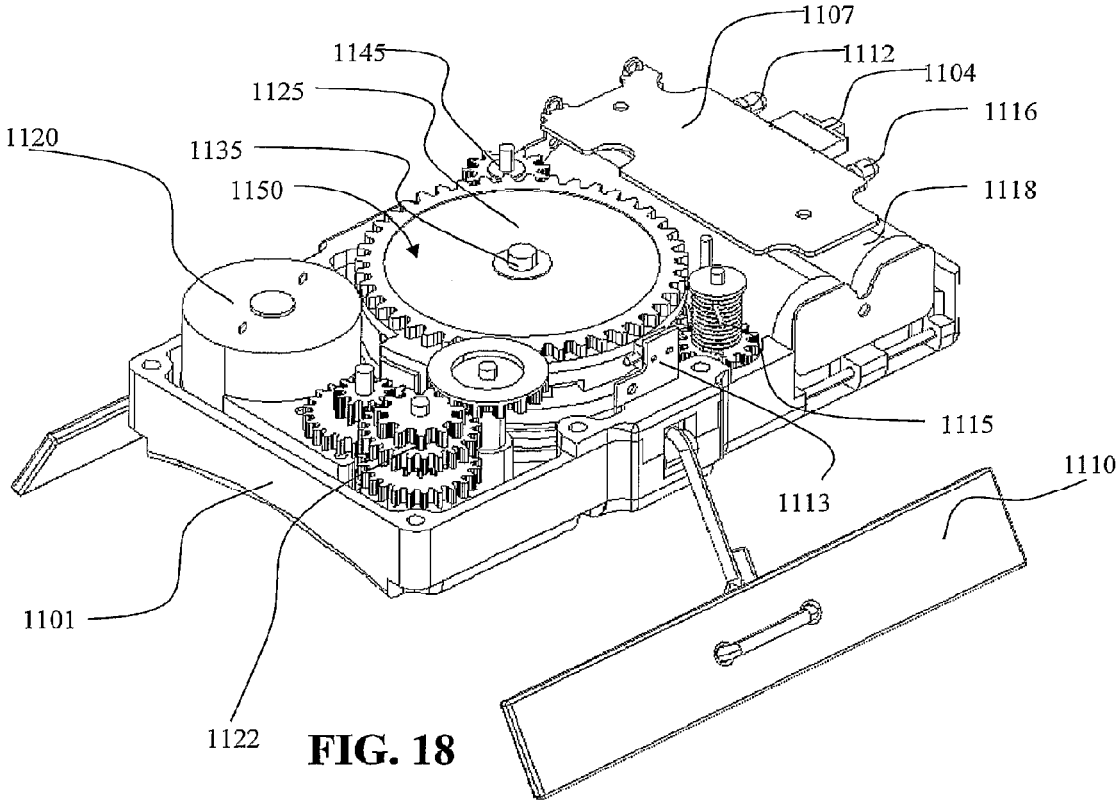
FIG. 18 is an isometric view of the ninth embodiment of FIG. 17 with top cover removed to show internal structure.
Figure 19:
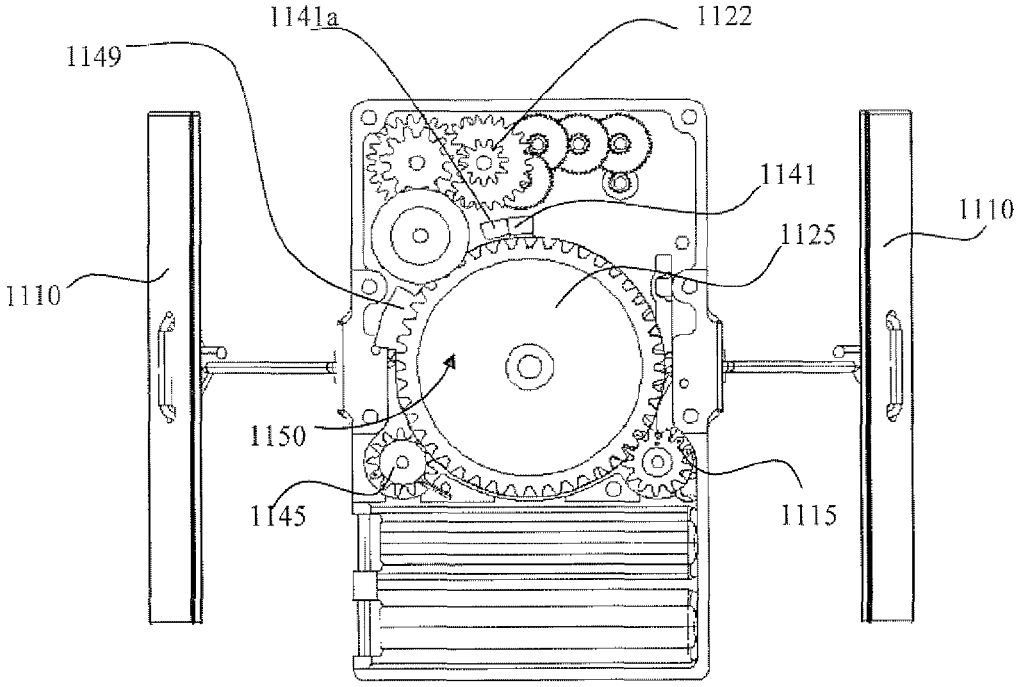
FIG. 19 is a top view of the ninth embodiment of FIG. 17 with top cover removed.
Figure 20:
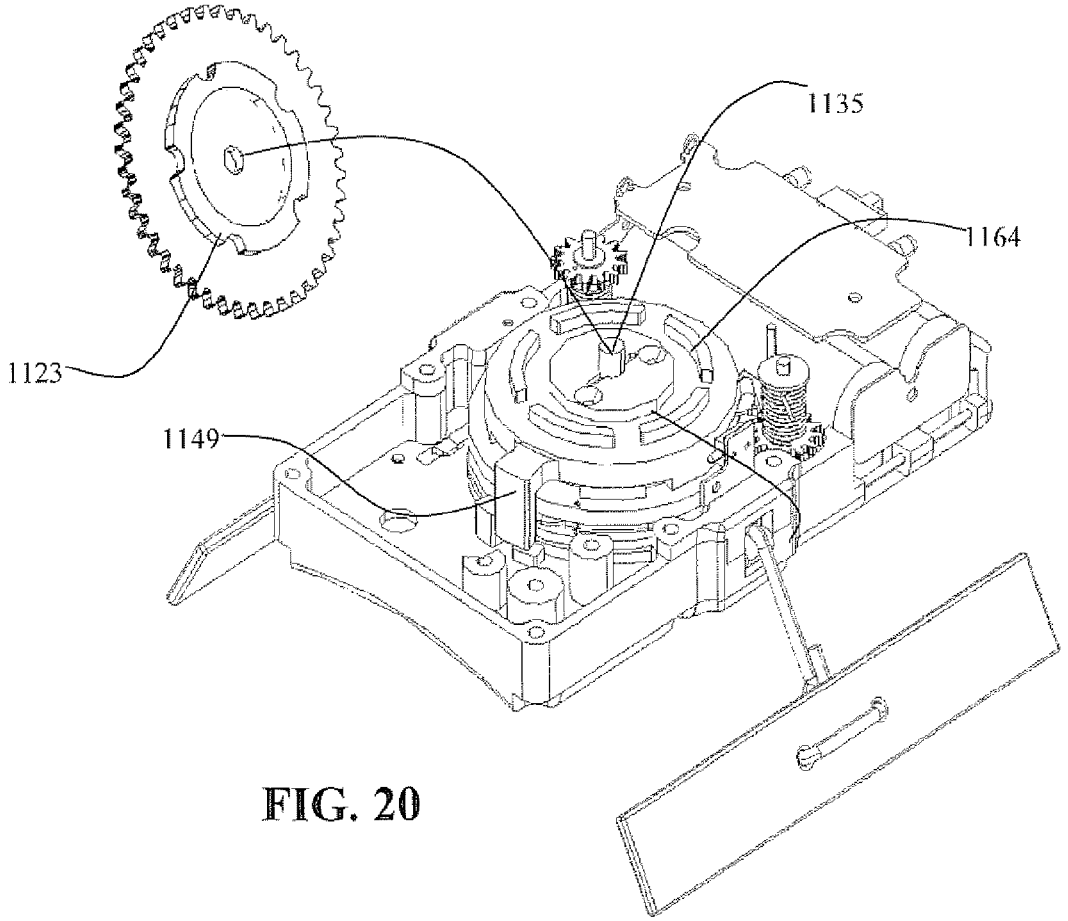
FIG. 20 is an isometric view of the embodiment of FIG. 17 with top cover and driving system removed to better show the main mechanism assembly.

FIGS. 18 and 19 give an overall view of the internal structure of device 1100. The compact packaging of the internal components is achieved by a special design of the main contraction-relaxation mechanism according to which most of the components, including the release clutch system and the deceleration system, are arranged in a "hamburger-like" manner around a single rotational axis 1135 and by coupling straps 1110 to the main mechanism by means of cables 1108 that wind/unwind about the same axis as well. Thus, although the mechanism principles of embodiment 1100 are similar to those of embodiment 1000, the very different arrangement of the sub-systems allows for the small dimensions and compact design.

Embodiment 1100 is driven by a single, continuously operating, motor 1120 powered by batteries 1008. According to the embodiment shown here, batteries 1118 are preferably two AA type batteries of 1.5 V. However it will be realized that other batteries might be used as well. Preferably the batteries allow operation of about 25 hours with no need to replace or recharge the batteries. Motor 1120 is preferably a low-cost DC motor operating in the range of 2-4 V at about 2000-4000 rpm, such as for example a DC brush motor model RF-356CA-10250 of Mabuchi Motor Co. The rotational motion of motor 1120 is transferred to main spring assembly 1150 (see FIG. 19) via a speed reducing gear train 1122 terminating with final gear 1125 that is mounted on top of mainspring assembly 1150. Coupled to mainspring assembly 1150 are cable return spring assembly 1115 and clutch spring assembly 1145 serving to bias the two clutches of the system into the locking position. Also seen in FIG. 18 are electronic board 1107, an on/off switch 1104, a LED On indicator 1112, a low battery LED indicator 1116 and an angular position micro switch 1113. The role of micro switch 1113 is to ensure that the device is turned off always in the relaxed position. Thus when device 1100 is turned off by the user, operation does not stop immediately but only after a full cycle is completed and the system returns to the relaxed state, namely a immediately or a predetermined time after a transition from contracted to relaxed state is detected by micro switch 1113.

In accordance with embodiment 1100, straps 1110 are coupled to the mainspring assembly 1150 by means of two cables 1108 that roll in and out casing 1105. This allows for further reducing the size of the device. Referring to FIG. 22, each of cables 18 is fixedly connected at one end to a groove provided at the circumference of lower spring holder housing 1132*a* and is guided by means of vertical roller 1117*a* and horizontal roller 1117*b*, located adjacent to openings 1109, out of casing 1005. Upon clockwise rotation of part 1132*a*, cables 1108 wind around the part 1132*a* thus pulling strap 1100 toward casing 1105, shortening the effective length of the strap. Upon counterclockwise rotation of 1132*a*, cables 1108 unwind out of casing 1110 to lengthen the effective length of the strap. Rollers 1117*a* and 1117*b* allow for a smooth winding of cables 1108 in and out openings 1009. Strap return spring assembly 1115 (best seen in FIG. 21), comprising spring 1126, is coupled to the mainspring assembly via gear 1127 meshed with partial gear 1127*a* of part 1132*a*. Spring 1126 having on end fixedly connected to shaft 1129 is biased to rotate gear 1127*a* counterclockwise so as to unwind cables 1108. It will be realized that when part 1132*a* rotates clockwise, spring 1127 is being further loaded.

Figure 21:
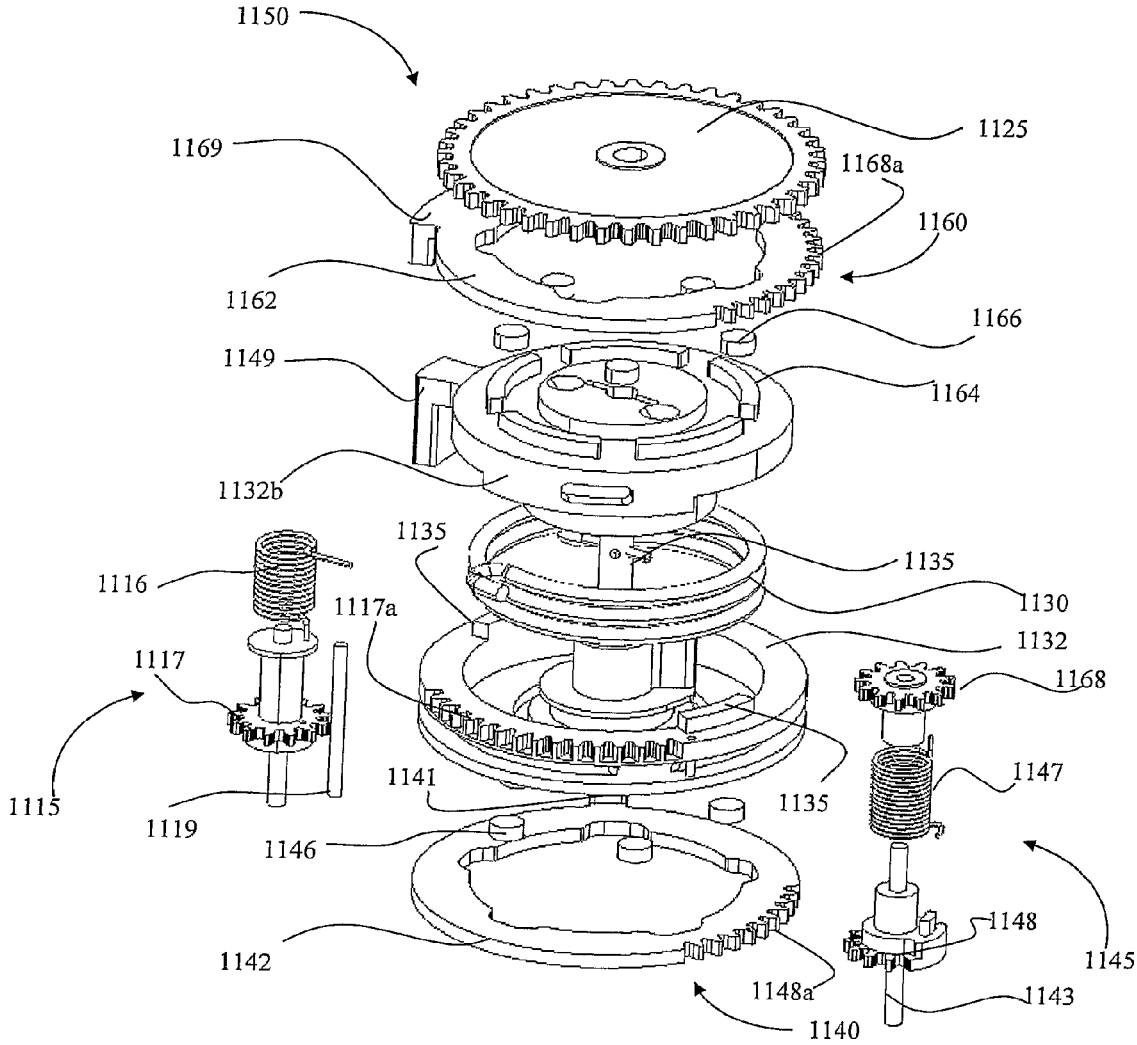
FIG. 21 is an exploded view of the spring holder assembly.
Figure 21:
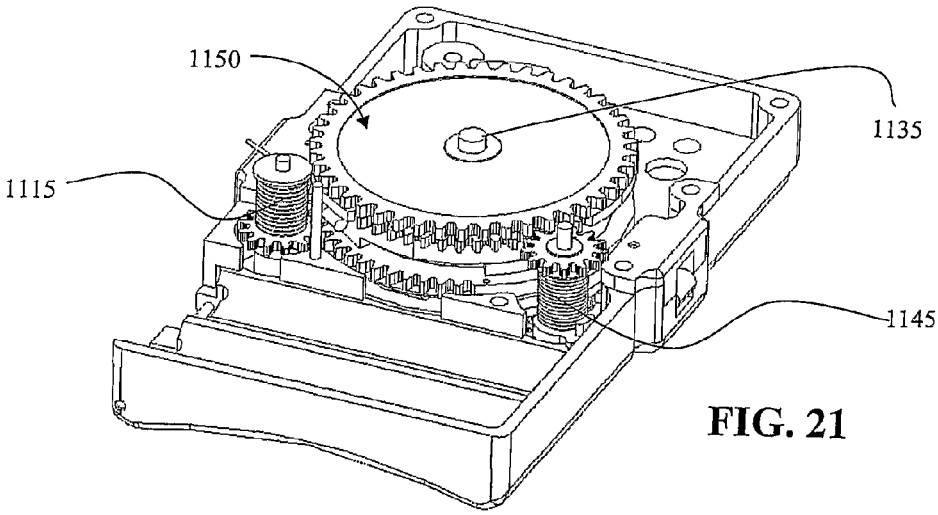
Figure 22:
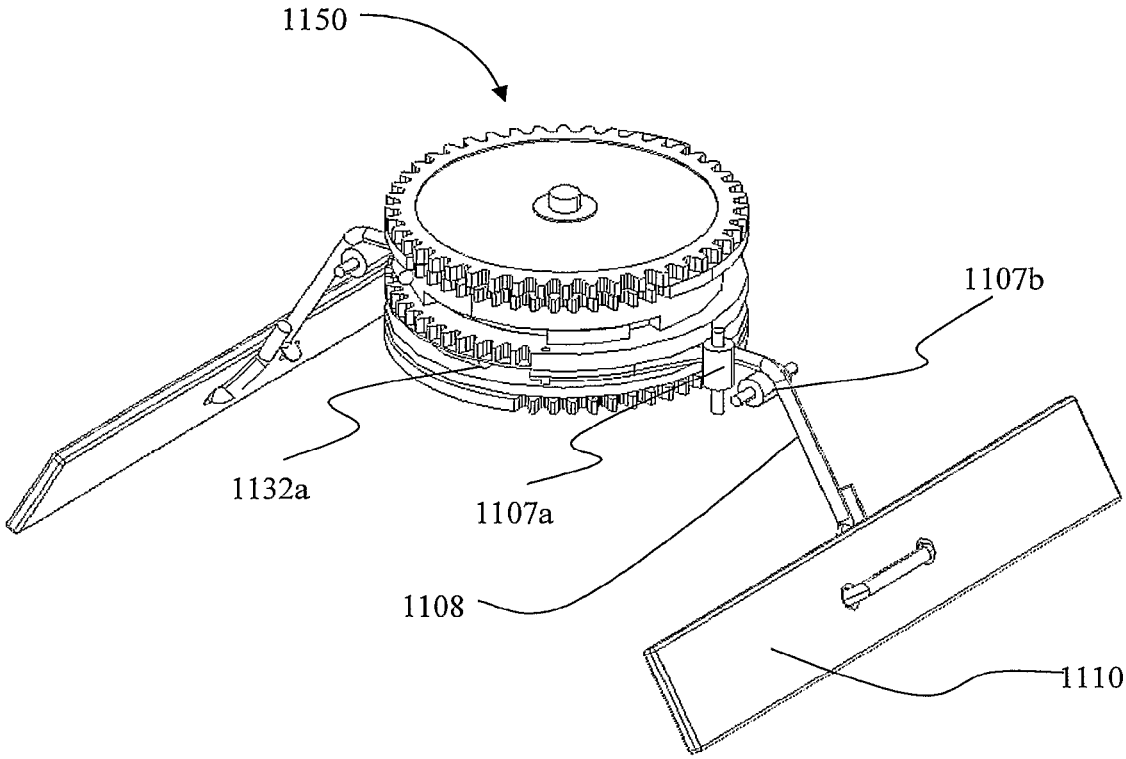
FIG. 22 is an illustration of the strap assembly.
Figure 23A:
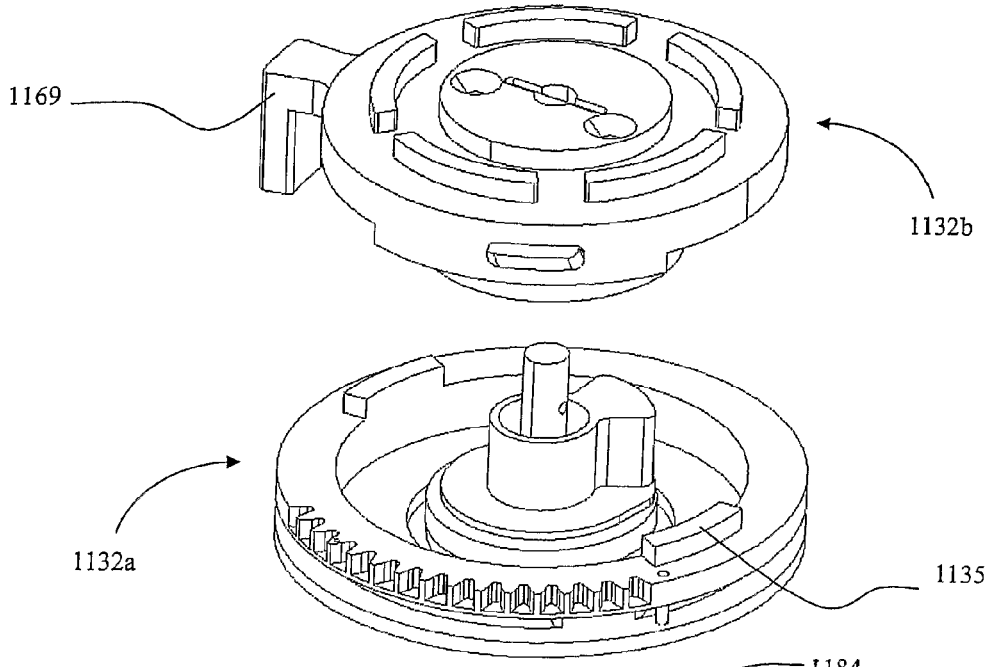
FIGS. 23A and 23B are two exploded views of the decelerating assembly
Figure 23B:
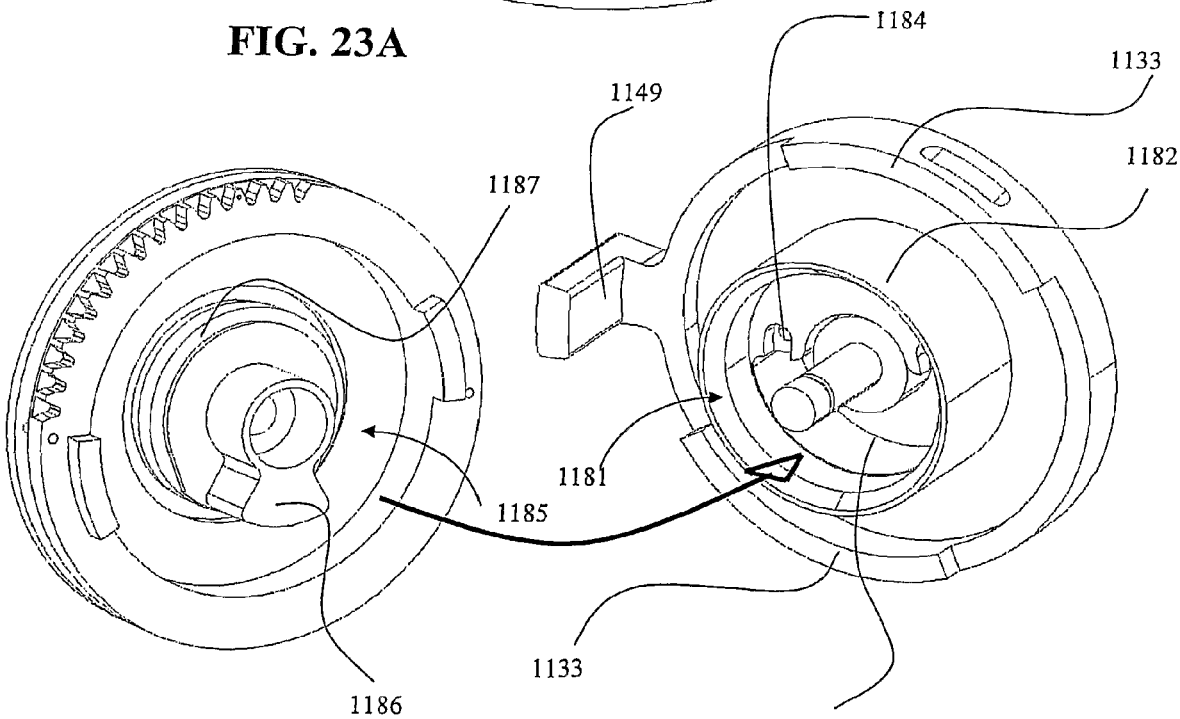

A detailed exploded view of the "hamburger-like" structure of mainspring assembly 1150 is given in FIG. 21. Starting from the middle layer, a mainspring 1130 is held within a two-part mainspring holder comprising a bottom part 1132*a* and an upper part 1132*b*, which in their turn are coupled to the base 1101 of casing 1105 by means of clutch 1140 and to gear 1125 by means of clutch 1160, respectively. During operation, part 1132*a* is either angularly coupled or released from base 1101 by means of clutch 1140 and part 1132*b* is either angularly coupled to or released from gear 1125 by means of clutch 1160. Also accommodated within parts 1132*a* and 1132*b* is a deceleration system comprising a stator 1181 and a rotor 1185, the detailed structure of which is illustrated in FIG. 23. Stator 1181 and rotor 1185 form an inner sealed structure around central axis 1135. Spring 1130, having one end fixedly connected to part 1132*a* and the second end fixedly connected to part 1132*b* is accommodated between wall 1182 of stator 1181 and the outer wall of part 1132*a* and 1132*b*. Spring 1130 is a helical spring of a few loops preferably made of steel. When device 1100 is assembled, spring 1130 is connected to parts 1132*a* and 1132*b* not at its equilibrium state but already partially coiled, preferably to about 80% of the maximal torque it can reach during operation, similarly to the way described above in association with spring 1030 of embodiment 1000. Arcs 1133 and 1137 provided at the circumference of parts 1132*b* and 1132*a*, respectively (best seen in FIG. 23B), limit the rotation between the two parts, preventing spring 1130 from unwinding to its equilibrium state.

Clutches 1160 and 1140 are of similar structure to the structure of clutch 932 of embodiment 900 and clutches 1040 and 1050 of embodiment 1000, but of a 5-fold symmetry. A detailed description of the clutch operation is given above in association with FIG. 9E. Clutch 1160 comprises an inner circular part 1123 with five half-circle recesses provided at the bottom of gear 1125 (see FIG. 20), a 5-segment annular wall 1164 protruding upwardly from the upper face of mainspring holder upper part 1132*b*, a clutch ring 1162 with five elongated recesses at the inner circumference thereof and five rollers 1166 interposed between segments 1164. Parts 1123, 1164 and 1162 are concentrically arranged around axis 1135. An arm 1169 extending from clutch ring 1162 allows unlocking clutch 1160. Clutch 1140 that locks/unlocks lower spring holder 1132*a* to base 1101, having a similar structure, comprises an inner circular part provided at the bottom of part 1132*a* (not seen), a 5-segment annular wall protruding upwardly from base 1101 (not seen), a clutch ring 1142 provided with ring arm 1141 and five rollers 1146. Ring arm 1141 allows for the opening of clutch 1140. Adjacent to arm 1141 protruding upwardly from base 1101 is a clutch ring stopper 1141*a* (see FIGS. 19 and 24) whose role is to prevent further rotation of ring 114 in counterclockwise direction. In accordance to the embodiment shown here, a single external spring 1147 of clutch spring assembly 1145 is responsible to bias both clutch rings 1142 and 1162 of clutches 1140 and 1160 to their locked position. Clutch spring assembly 1145 is coupled to clutch 1140 via lower gear 1148 meshed with partial gear 1148*a* of clutch ring 1142 and with clutch 1160 via upper gear 1168 meshed with partial gear 1168*a* of ring 1162. Gears 1148 and 1168 are arranged around common shaft 1143 mounted on base 1101. It will be realized that the structure of clutches 1140 and 1160 is not limited to the specific structure shown here. In particular it will be realized that the structure is not limited to a 5-fold symmetry, nor to an external spring.

Figure 24A:
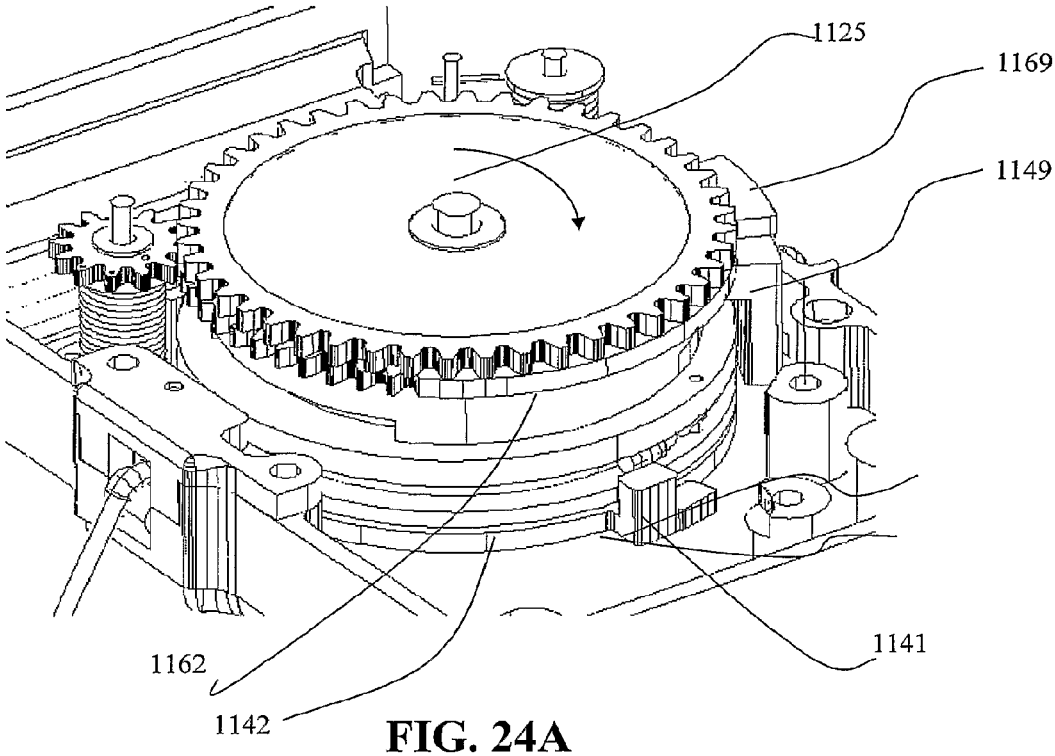
FIG. 24A and FIG. 24B are two partial isometric views of the mainspring holder assembly demonstrating the operation of the device.
Figure 24B:
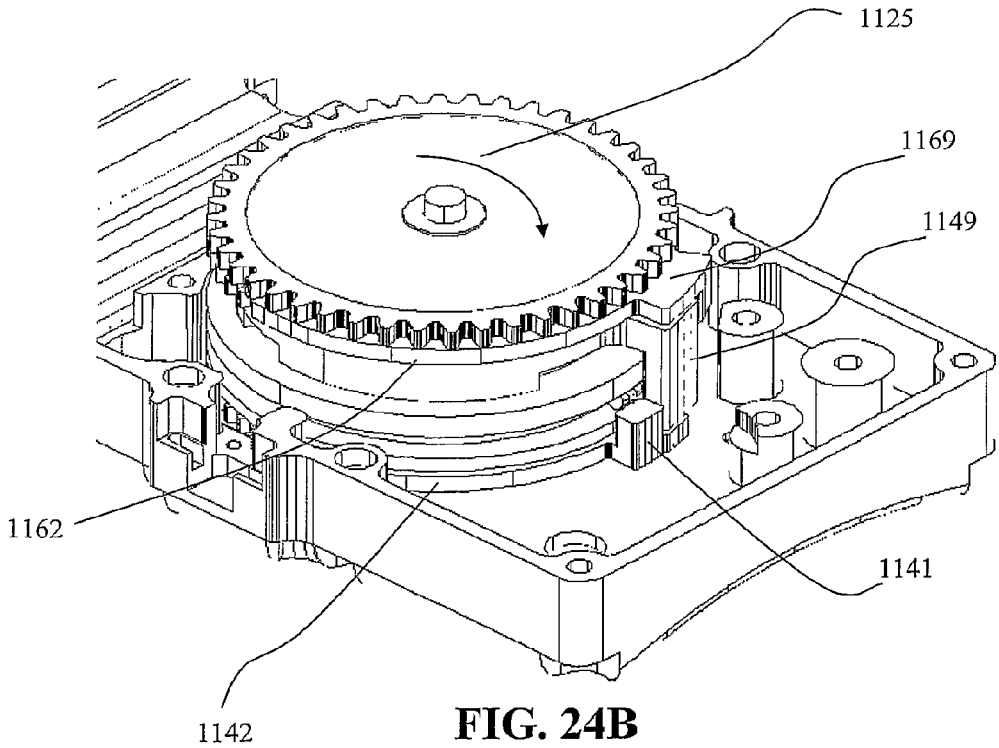
Figure 25:
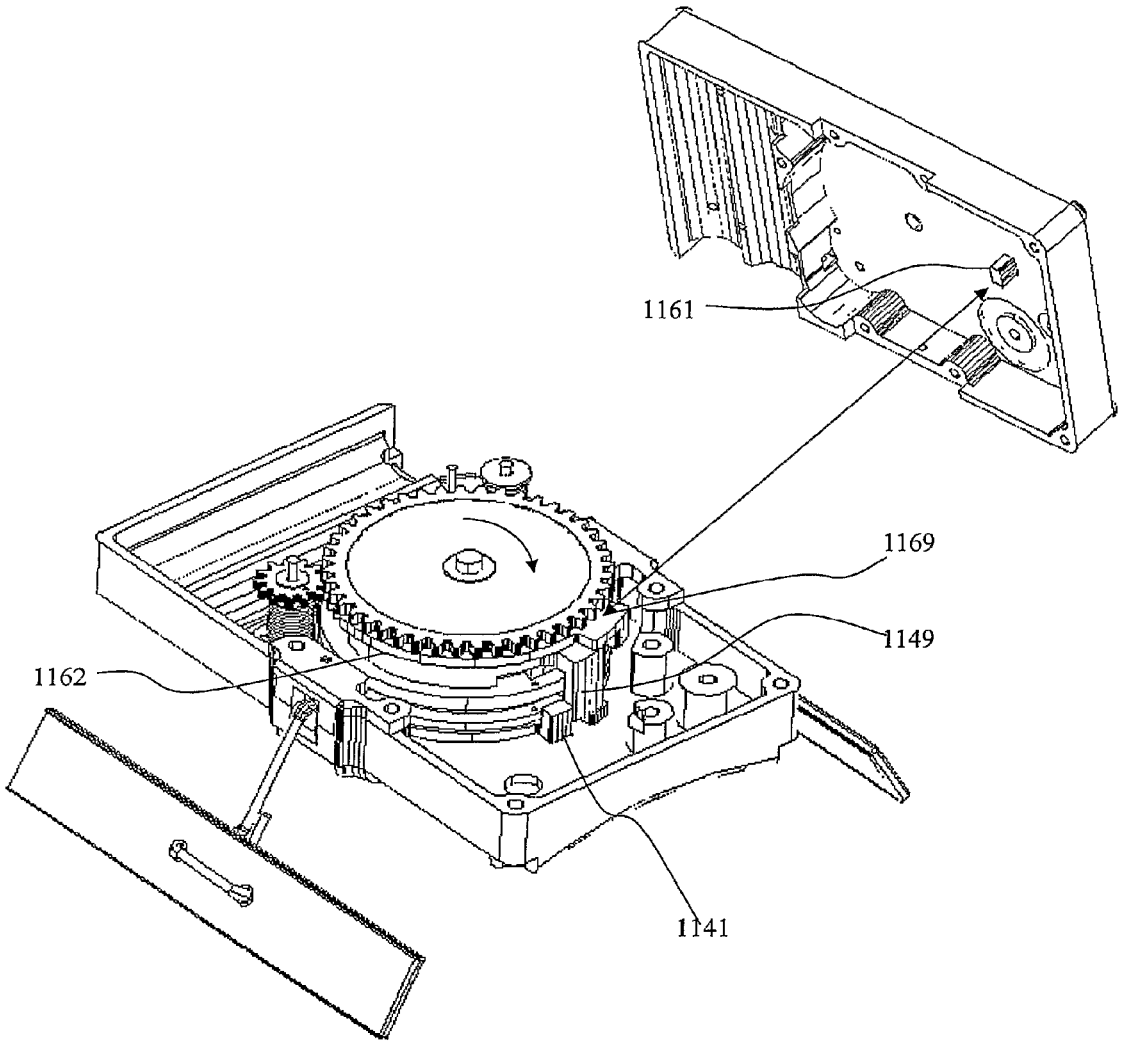
FIG. 25 is an isometric view of the top cover and of the main mechanism mounted on the base to demonstrate decoupling between mainspring and motor.

The principles underlying the operation of embodiment 1100 are similar to those of embodiment 1000 above where clutch 1140 is having a similar role to the role of clutch 1050 of embodiment 1000, namely preventing/allowing rotational movement of one end of the mainspring while clutch 1160 is having a similar role as of that of clutch 1040, namely coupling/decoupling between the second end of the mainspring to the motor. Operation of the device starts with cables 1108 at their outmost position and with clutches 1140 and 1160 locked. Referring back to FIG. 18, gear 1125 driven by motor 1120 via gear train 1122 is continuously revolving around the main assembly axis 1135. Thus, as long as clutch 1160 is locked, part 1132*b* follows the rotation of gear 1125. If clutch 1140 is locked at the same time, part 1132*a* is locked to base 1101, thus mainspring 1130 is being charged while cables 1108 retain their relaxed position. At this stage, arm 1149 extending from part 1132*b* and arm 1169 extending from ring 1162 of clutch 1160 are still away from arm 1141 of clutch 1140, as illustrated in FIG. 24A. As part 1132*b* further revolves in the clockwise direction, arms 1149 and 1169 approach arm 1141 until arm 1149 engages with arm 1141 to release clutch 1140, thereby the torque built in mainspring 1130 rotates part 1132*a* clockwise to wind cables 1108 and pulling straps 1110 inwardly to tighten about the limb. At the same time, strap release spring 1126, coupled to part 1132*a* via gears 1127 and 1127*a*, is being further charged. The position of arms 1149 and 1169 at this stage can be seen in FIG. 24B. Turning to FIG. 25, as part 1132*b* keeps revolving, mainspring 1130 is being further charged against the limb until arm 1169 engages with protrusion 1161 extending from cover 1102 to release clutch 1160, thereby actuating a fast transition back to the relaxed phase and the cycle can starts all over again. As clutch 1160 is being released, switch 1113, described above in association with FIG. 18, is pressed, thus detecting the transition back to the relaxed phase.

It should be noted that the fast transitions between relaxed and contracted phases are slowed to some extent by the deceleration assembly mounted around main axis 1135. A detailed view of the deceleration system is given in FIG. 23. The internal structure, role and principles of operation of the system are similar to those of the deceleration assembly 1080 of embodiment 1000. However, unlike embodiment 1000, the deceleration system of embodiment 1100 is not a separate component but an integral inner component of the spring holder 1132 for enhancing the compactness of the device. As can be seen, stator part 1181 comprises a partially hollow cylinder 1182 having a well 1183 filled with high viscosity oil. The complementary rotor part 1185 is having an oar 1186 free to move between walls 1184 of well 1182. A U-ring 1187 seals between stator and rotor. The dimensions of oar 1186 are configured so as to allow only a very narrow passage of oil between oar and well. Thus, at high velocities, the movement of oar 1186 within well 11 slows down rotational movement of parts 1132*a* and 1132*b* with respect to each other.

It should be emphasized that various embodiments of the present device are especially designed to be of high energetic efficiency by utilizing a mechanical energy storage element that acts as a "mechanical energy capacitor". The energy storage element can be charged over a long time or substantially even continuously as demonstrated by embodiments 1000 and 1100 above Thus, a relatively low-power small motor can be used to effectuate an abrupt high power transition.

It will be realized that the various embodiments of the invention can be designed to allow various cycle patterns adapted for the increasing of arterial flow from the heart to the limb or of venous flow from limb to heart. It will be also realized that one or more elements from one embodiment can be incorporated into another embodiment. For example, the decelerating mechanisms disclosed in association with embodiments 1000 and 1100 can be coupled to the mechanism of embodiments 800 and 900 for controlling the transition time of at least one of the transitions. Such a slowing mechanism can be for example an impeller type mechanism. The decelerating mechanism allows for precise control of the pressure gradient profile during the transition. For example, the pressure can be controlled to reach the target value in a smooth monotonous way or to transiently overshoot the target value. Thus, a device in accordance with the invention may have fast pressure build up and slow pressure release, suitable for example for reducing the risk of DVT, or slow build up and fast release for enhancing arterial flow by inducing a venous suction effect. The effect, referred to as 'suction effect', is produced by the rapid fall in pressure at the end of each pressure cycle which causes the pressure at the veins to drop below normal and thus facilitates fast perfusion through distal tissues. This effect, referred to as 'suction effect', enables better distal tissue perfusion with or without high arterial pressure as is demonstrated below. Thus, in order to increase the flow to the peripheries, the device is tuned to build up pressure on the limb in order to compress the veins, and to rapidly release that pressure. Preferably the transition time from high to low pressure is of less than one 1 sec, more preferably of less than 300 msec, 100 msc, 30 msec, or 10 msec.

Typical operational parameters for inducing suction effect and enhancing arterial flow are: pressure at compressed state higher than 15 mmHg, preferably in the range of 15-180 mmHg, more preferably in the range of 30-120 and most preferably in the range of 60-100 mmHg; full cycle in the range of 0.5-300 sec, preferably in the range of 2-120 sec, more preferably in the range of 5-75 sec, most preferably in the range of 10-30 sec; duration of compressed phase less than 15 sec, preferably less than 8 sec, more preferably less than 1.5 sec or less than 300 msec; transition time from compressed to relaxed state less than 3 sec, preferably less than 1 sec, more preferably less than 200 msec and most preferably less than 100 or 30 msec; and transition time from relaxed to compressed state in the range of 100 msec-3 sec.

Figure 26A:
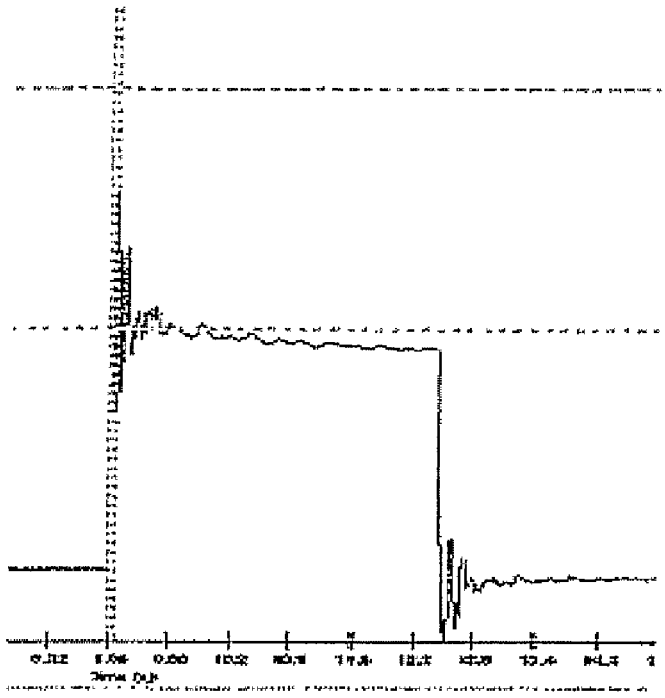
FIGS. 26A and 26B are typical pressure profiles obtained by a device of the present invention and a commercially available IPC device, respectively.
Figure 26B:
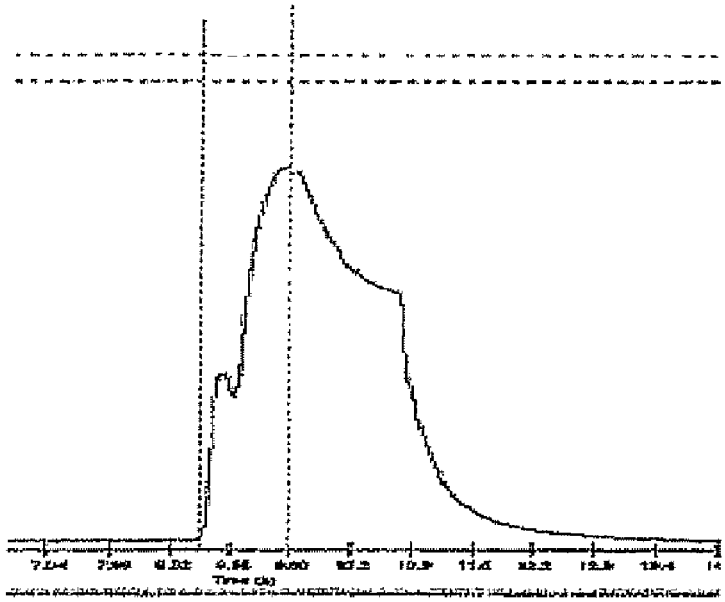

Typical operational parameters for enhancing venous flow for reducing the risk of DVT are: pressure at compressed state higher than 15 mmHg, preferably in the range of 15-120 mmHg, more preferably in the range of 25-60 and most preferably in the range of 30-50 mmHg; total cycle more than 5 sec, preferably in the range of 15-300 sec, more preferably in the range of 30-150 sec, most preferably in the range of 40-80; duration of compressed phase of less than 15 sec, preferably less than 8 sec, more preferably less than 3, most preferably less than 1.5 msec; transition time from relaxed to compressed state less than 10 sec, preferably less than 3 sec, more preferably less than 1 and most preferably less than 200, 100 or 30 msec;

FIG. 26A is a typical pressure profile obtained by applying an instrument in accordance with embodiment 900 of the present invention showing the rise and fall of the pressure as function of time. For comparison sake, FIG. 26B shows a pressure profile, on the same time scale as of FIG. 26A, obtained by a typical commercially available IPC (intermittent pneumatic compression) instrument (Aircast VenaFlow). Both instruments were adjusted to converge to a similar pressure. As can be clearly seen, the pressure rise and fall times obtained by the present invention are much shorter than those obtained by the conventional pneumatic device. It can be also seen that the pressure profiles of the two instruments differ significantly. In accordance with the measurements shown in FIGS. 26A and 26B, it takes only about 0.06 seconds for the present apparatus to reach the maximum pressure value and about 0.08 seconds for the pressure to drop to its baseline value, while for the IPC device it takes about 0.96 seconds to reach the maximum pressure, about 0.68 seconds to drop to 75% of the maximum value and about 4.6 seconds to reach its baseline value. It will be realized that the pressure profile given in FIG. 10A is an example only and that the rise and fall times, as well as the transient gradient during pressure build up and pressure drop, can be easily varied by varying mechanical parameters of the device.

Experimental Results.

Figure 27:
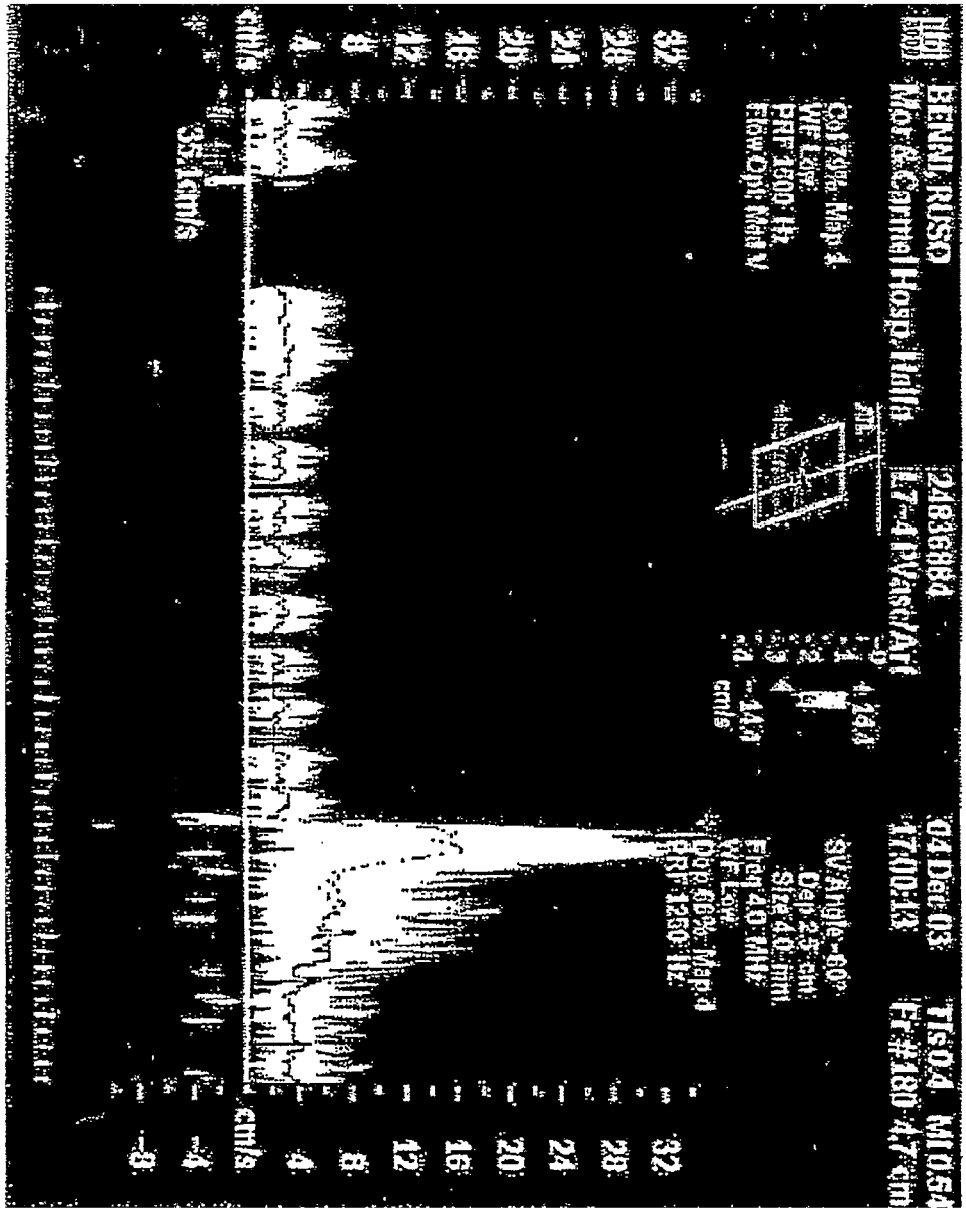
FIG. 27 is an example of Doppler ultrasound test results obtained by the application of the present invention in accordance with the embodiment of FIG. 9.

FIG. 27 shows an example of Doppler ultrasound test results obtained by the application of a device of the present invention. The results shown here were obtained by applying a device in accordance with embodiment 900 of FIG. 9 on a healthy man in the supine position, applying an intermittent pressure of about 50 mmHg. The device was applied to the right calf of the subject while measurements were taken of veins located distal to the device location, close to the right ankle. The measurements were taken by a commercial duplex Ultrasound/Doppler instrument. The white areas represent the blood flow in the distal vein while the thin black line passing through the white areas represents the momentary average flow. The blood flow in the veins of the subject before the device is put to action is seen on the left side of FIG. 27 and is referred to as the base line. As can be seen, activating the device to apply pressure on the calf initially causes the blood flow in the distal vein to temporarily drop towards zero (as represented by the black area following the baseline), then, while the device is still in the compressed state, the flow recovers to substantially the baseline value. Then, following the rapid release of pressure there is a significant increase in the blood flow as is clearly indicated by the peaks of white areas on the right side of the picture. FIG. 11 demonstrates the venous suction effect described above, namely the increase in perfusion through distal tissues due to the rapid fall in pressure at the end of the pressure cycle.

Figure 28A:
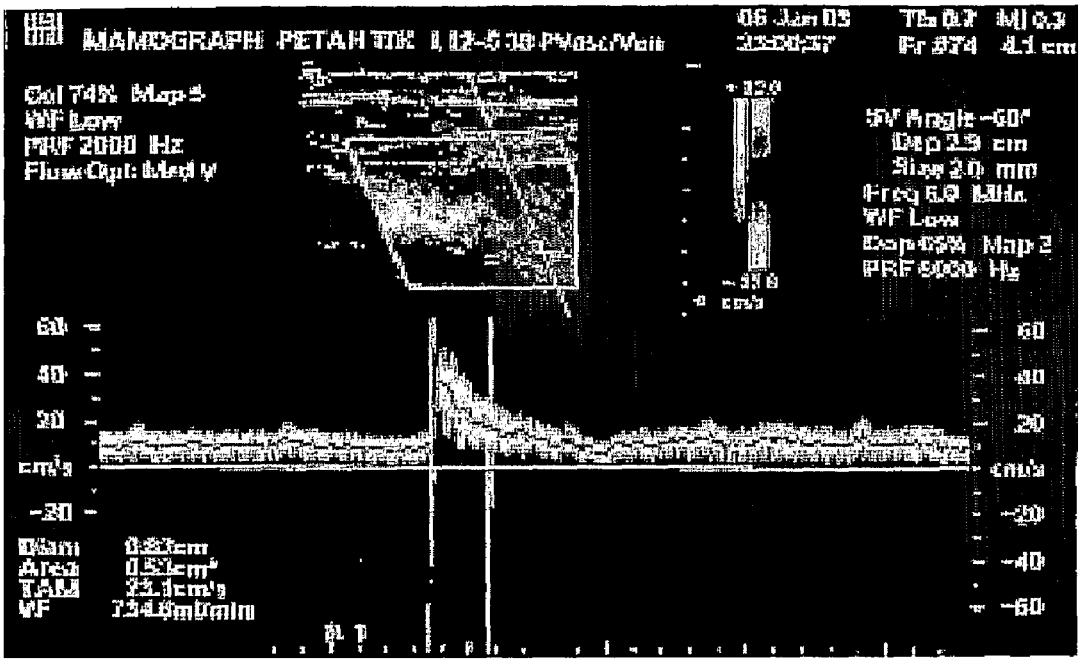
FIGS. 28A and 28B are examples of Doppler ultrasound test results obtained by the application of the embodiment of FIG. 8 of the present invention and by a commercially available IPC device, respectively.
Figure 28B:
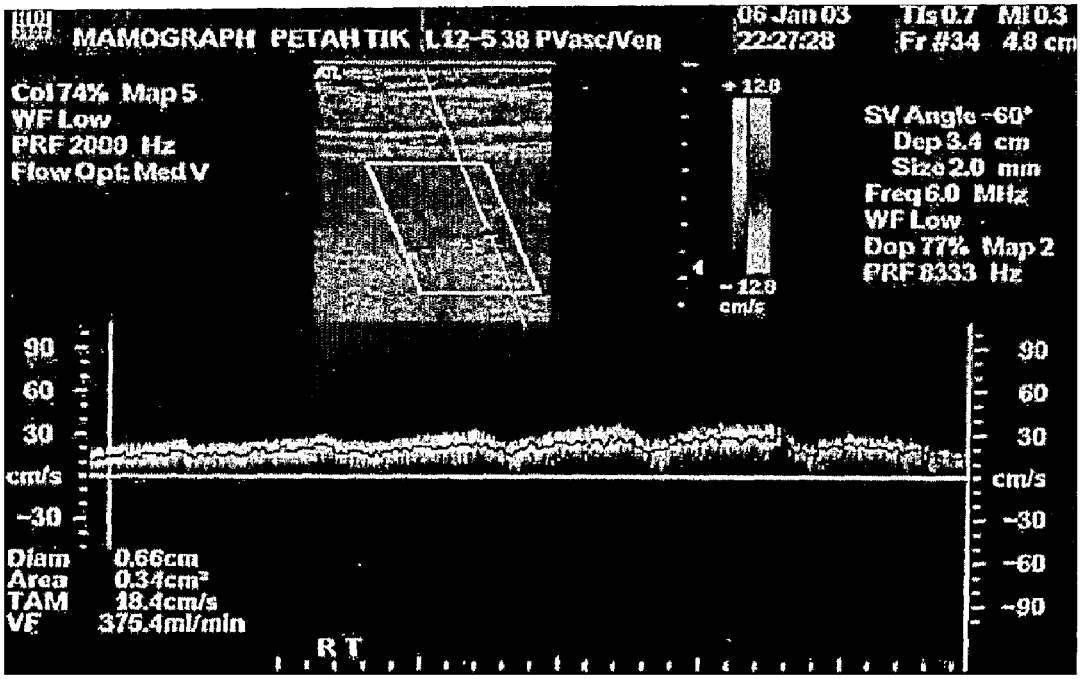

FIGS. 28A and 28B show two Doppler Ultrasound pictorial representations depicting flow velocity obtained by applying a device of present invention in accordance with embodiment 800 of FIG. 8 and by applying an existing commercial IPC device (three chamber Tyco), respectively, to the limb of a healthy 49 years old male. The pictures were taken by an ultrasound vascular expert using an Ultrasound\Doppler device, using a transducer operating at 200 Hz, for measuring blood flow and blood velocity in a deep wide vein cephalhead to the location of the device. The measurements were performed on a 7 millimeter vein located roughly 3 cm beneath the skin surface. Measurements were obtained during normal operation of both devices while working at 2 cycles per minute. The pressure applied by the device of the present invention was of about 25 mmHg while that applied by the commercial device was of 40 mmHg. The Doppler pictures clearly show that blood flow is increased to a greater extent after using the present invention when compared with an IPC device. It is assumed that the pressure profile of the present device, namely, the fast transitions between high and low pressure is responsible for this enhanced blood flow increase. FIGS. 27 and 28 are for demonstration only. Exact measurement were obtained and summarized in the Tables below.

Table 1 shows the average percentage increase of blood volume flow in the subject leg compared with the baseline blood flow when devices were not applied to the leg. The average results shown in table 1 were calculated from multiple test results to eliminate random measurement errors.

TABLE 1 average increase of blood volume flow measured during application of an IPC device and a present device as compared to baseline flow.

| Device | Peak Flow (%) | Average Flow (%) | Range Flow (%) |
|---|---|---|---|
| IPC | 224 | 102 | 113-215 |
| Present Device | 344 | 106 | 105-335 |

The results obtained for the Tyco device (IPC) used in this experiment concur with published data for this device and are comparable to other published results obtained for similar devices used in the art for enhancing blood flow in a limb. It can be clearly seen from the results above that the average increase of peak flow obtained for the present invention (344% of baseline) is significantly higher than that obtained for the IPC device (224% of baseline). It can be further seen that the average increase of the range of blood flow obtained for the present invention was wider (105-335% of baseline) than that obtained for the IPC device (113-215% of baseline). This is a significant result since it may imply that by using the present invention a greater suction effect is created within the veins in the limb of the subject which might be the cause for the significant enhancement of the blood flow and the circulation in the limb. It can also be seen that the average increase in the average blood flow above baseline is somewhat higher with the present invention than with the IPC device. The operational parameters of the IPC device used in this experiment are comparable to other similar devices used in the art. Thus, the technology of the present invention achieves with 25 mmHg at least the same flow velocities obtained by using IPC devices at 45 mmHg. Other data obtained by the present invention include a special measurement of blood flow in a vein distal to the location where the device is applied with the aim of obtaining data related to suction effect of the device. It was found that the present invention when compared with the IPC device creates a significant suction effect in veins distal to the device even though the pressures used are significantly lower.

In another experimental setup, 10 different subjects were treated with a device in accordance with embodiment 900 of the invention, applying the device to the calf of the subject while measuring flow velocity and flow volume at a superficial femoral vessel (SFV) using echo Doppler. The device was operated at 1 cycle per minute applying a pressure pulse of about 40 mmHg for 12 sec duration. Measurements were taken before the device was attached, after the device was attached to the subject but before it was turned on in order to obtain baseline values, during operation of the device and at rest after the device was turned off. Table 2 summarizes the average results obtained for the 10 cases.

TABLE 2

Average results obtained for 10 cases treated by 45 mmHg, 12 sec pressure pulses applied to the calf by a device of the invention:

| | SFV peak velocity (cm/sec) | SFV Volume Flow (m/min) |
|---|---|---|
| Baseline with no device | 8.86 | 60.86 |
| Baseline with device | 9.06 | 56.53 |
| Device on | 34.96 | 81.29 |
| rest | 9.02 | 51.92 |

A further set of tests was performed using a device in accordance with embodiment 900, applying pressure pulses of about 80 mmHg for about 3 sec. The device was attached to the calf. Tests were performed at 3 and at 6 cycles per minute. The parameters measured were femoral artery and femoral vein volume flow using echo Doppler, $TcpO_2$ and tissue Doppler. The average results obtained for 10 cases are summarized in Table 3.

TABLE 3

Average results obtained for 10 cases treated by 80 mmHg, 3 sec pressure pulses:

| | Baseline | 3 cycles/min | 6 cycles/min |
|---|---|---|---|
| Femoral Artery | 89.7 | 150.3 | 142.6 |
| % increase | | 68% | 59% |
| $TcpO_2$ | 57.9 | 62.5 | 67.4 |
| % increase | | 8% | 17% |
| Tissue Doppler | 2.58 | 2.98 | 3.23 |
| % increase | | 16% | 25% |
| Femoral Vein | 66.0 | 90.5 | 44.8 |
| % increase | | 37% | −32% |

The invention claimed is:

1. A device for enhancing circulation by intermittently tightening and relaxing a closure encircling a limb, the device comprising a motor, at least one rotating element and a mechanism driven by said motor for intermittently rotating said at least one rotating element in at least one of a first direction to tighten said closure and a second opposite direction to relax said closure, thereby applying a cyclic pressure on the limb;

wherein a pressure cycle comprises a first period of relaxed state followed by a first transition to a compressed state and a second period of a compressed state followed by a second transition back to the relaxed state, and wherein the mechanism includes at least one spring coupled to said rotating element, said at least one spring is configured to be charged by said motor during at least the first period and to be discharged to effectuate at least one of said first and second transitions.

2. The device of claim 1 wherein said motor is operating continuously.

3. The device of claim 2 wherein said motor is having a shaft continuously revolving in one direction.

4. The device of claim 1 wherein the mechanism includes a first clutch for locking/unlocking said rotating element.

5. The device of claim 4 wherein the mechanism includes a second clutch for coupling/decoupling between the motor and the at least one spring.

6. The device of claim 5 further comprising a first and a second disengaging elements for disengaging said first and second clutches.

7. The device of claim 5 further comprising a deceleration assembly interposed between said at least one spring and said rotating element.

8. The device of claim 7 wherein the rotating element, the at least one spring, the first and the second clutches and the deceleration assembly are arranged about one common axis.

9. The device of claim 1 wherein said closure comprises at least one strap portion connectable to said rotating element and wherein the strap portion is configured to wind about said at least one rotating element when the rotating element is rotated in the first direction and to unwind when the rotating element is rotated in the second opposite direction.

10. The device of claim 1 wherein said closure comprises at least one strap portion connected to said rotating element by means of a cable and wherein the cable is configured to wind about said at least one rotating element when the element is rotated in the first direction and to unwind when the element is rotated in the second opposite direction.

11. The device of claim 1 wherein the closure comprises two strap portions connected to said at least one rotating element and wherein each of said two strap portions is configured to wind about said at least one rotating element when the element is rotated in the first direction and to unwind when the rotating element is rotated in the second opposite direction.

12. The device according to claim 11 wherein said two strap portions are connectable to each other to form a loop.

13. The device according to claim 11 wherein the closure further comprises a sleeve wrapped around the limb and wherein each of said two strap portions is provided with attaching means to be attached to said sleeve.

14. The device of claim 1 further comprising two rollers coupled to said rotating element and wherein the closure comprises two strap portions, each of said two strap portions is connected to one of said two rollers so as to wind around the roller when the rotating element is rotated in the first direction and to unwind when the rotating element is rotated in the second opposite direction.

15. The device according to claim 14 wherein said two strap portions are connectable to each other to form a loop.

16. The device according to claim 14 wherein the closure further comprises a sleeve wrapped around the limb and wherein each of said two strap portions is provided with attaching means to be attached to said sleeve.

17. The device of claim 1 wherein the device further includes a power source for powering said motor.

18. The device of claim 17 wherein said power source is at least one battery.

19. The device of claim 18 wherein said battery is a chargeable battery.

20. The device of claim 17 wherein the device further comprises a detector and an indicator for detecting and indicating, respectively, a low battery condition.

21. The device of claim 17 further comprising an electronic circuit including an on/off switch for controlling said power source.

22. The device according to claim 21 wherein the device is further provided with a detector for detecting a transition from a compressed state to a relaxed state and wherein in response to switching said on/off switch to the off position, the electronic circuit switches off the power source at a predetermined time after said transition is detected.

23. The device of claim 1 further provided with a sensor for monitoring the device activity.

24. The device of claim 23 wherein monitoring the device activity includes detecting a loose strap condition and/or an over-tight strap condition and/or a malfunction condition.

25. The device of claim 24 wherein the device further includes at least one indicator for indicating a loose strap condition and/or a tight strap condition and/or a malfunction condition.

26. The device of claim 23 wherein the device is further provided with a memory component for storing information regarding the device activity.

27. The device of claim 26 wherein said information includes start and stop time records of operation periods of the device.

28. The device of claim 26 wherein the device is further provided with an output means coupled to said memory component for allowing unloading said information into an external computer device.

29. The device of claim 1 wherein the device is having a weight of less than 1 Kg.

30. The device of claim 1 wherein the device is having a weight in the range of 200-400 grams.

31. The device of claim 1 wherein the device is portable.

32. The device of claim 1 wherein the device is limb mounted.

33. A portable device for enhancing circulation by intermittently tightening and relaxing a closure encircling a limb, the device comprising:

a continuously operating motor;

at least one rotating element and a first clutch for locking/unlocking said at least one rotating element for preventing/allowing rotation of the element;

a mainspring having a first end coupled to said at least one rotating element and a second end coupled/decoupled to said motor by means of a second clutch; and a first and a second disengaging elements configured to intermittently unlock said first clutch and said second clutch, respectively.

34. The device of claim 33 wherein unlocking the first clutch effectuates rotation of said at least one rotating element in a first direction and wherein unlocking the second clutch effectuates rotation of the at least one rotating element in a second direction opposite to the first direction.

35. The device of claim 33 further comprising at least one strap portion coupled to said rotating element, the at least one strap portion is configured to be drawn inwardly when the rotating element is rotated in a first direction and to extend outwardly when the rotating element is rotated in a second direction opposite to the first direction.

36. The device of claim 35 further comprising a strap returning spring assembly biased to rotate said at least one rotating element in the second direction.

37. The device of claim 35 wherein the at least one strap portion is connected to said rotating element by means of a cable.

38. The device of claim 33 wherein the device further comprises two strap portions coupled to said rotating element, said strap portions are configured to be drawn inwardly when the rotating element is rotated in a first direction and to extend outwardly when the rotating element is rotated in a second direction opposite to the first direction.

39. The device of claim 38 further comprising two rollers coupled to said at least one rotating element and wherein each of said two strap portions is connected to one of said two rollers.

40. The device of claim 33 wherein said first and second disengaging elements are mounted on a camshaft driven by said motor.

41. The device of claim 40 further comprising a first speed reducing gear coupling between the motor and the camshaft and a second reducing gear coupling between the camshaft and the second end of the mainspring.

42. The device of claim 33 wherein the rotating element, the mainspring, the first and second clutches and the first and second disengaging elements are arranged around one common axis.

43. The device of claim 33 further comprising a mainspring housing, said mainspring housing comprises a first part and a second part, the first and the second parts of the mainspring housing are having a limited range of rotation with respect to each other, wherein the first end of the mainspring is fixedly connected to the first part of the mainspring housing and wherein the second end of the mainspring is fixedly connected to the second part of the mainspring housing.

44. The device of claim 43 wherein said first part of the mainspring housing is said at least one rotating element.

45. The device of claim 43 further comprising a deceleration assembly configured to slow down rotational motion of said at least one rotating element.

46. The device of claim 45 wherein said deceleration assembly comprises two parts, one part of the deceleration assembly is coupled to the first part of the mainspring housing and the second part of the deceleration assembly is coupled to the second part of the mainspring housing.

47. The device of claim 46 wherein said one part of the deceleration assembly is housed within the first part of the mainspring housing and the second part of the deceleration assembly is housed within the second part of the mainspring housing.

48. The device of claim 33 wherein the operative range of the mainspring is between 80% to 100% of a maximal torque built in the mainspring during operation of the device.

49. A device for enhancing circulation by intermittently tightening and relaxing a closure encircling a limb, the device comprising:

a motor, at least one rotating element:

a mechanism driven by said motor for intermittently rotating said at least one rotating element at least one of a first direction to tighten said closure and a second opposite direction to relax said closure: and a sensor for monitoring the device activity;

wherein said sensor is located opposite a rotating component that is coupled to the at least one rotating element, the rotating component reflects the rotational movement of said at least one rotating element, and wherein the rotating component is provided with at least one marker configured to be detected by the sensor.

50. The device of claim 49 wherein said sensor is an optocoupler comprising a light transmitter and a light detector and wherein said marker is configured to block/unblock light passage between said light transmitter and light detector.

51. The device of claim 49 wherein said sensor is an optical reader and wherein said at least one marker is at least one line marked on said rotating component configured to be detected by said optical reader.

* * * * *